US009454103B2

(12) United States Patent
Kubo et al.

(10) Patent No.: US 9,454,103 B2
(45) Date of Patent: Sep. 27, 2016

(54) IMAGE FORMING APPARATUS

(71) Applicant: CANON KABUSHIKI KAISHA, Tokyo (JP)

(72) Inventors: Kenta Kubo, Kamakura (JP); Tomohito Ishida, Saitama (JP); Shunichi Takada, Soka (JP); Koichi Hashimoto, Yokohama (JP); Tatsuya Tada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/612,531

(22) Filed: Feb. 3, 2015

(65) Prior Publication Data

US 2015/0227087 A1 Aug. 13, 2015

(30) Foreign Application Priority Data

Feb. 12, 2014 (JP) ..... 2014-024651

(51) Int. Cl.
*G03G 15/09* (2006.01)
*G03G 15/08* (2006.01)

(52) U.S. Cl.
CPC ..... *G03G 15/0921* (2013.01); *G03G 15/0818* (2013.01)

(58) Field of Classification Search
CPC ..... G03G 15/0921; G03G 15/0928; G03G 15/0942; G03G 15/0907; G03G 15/09
See application file for complete search history.

(56) References Cited

U.S. PATENT DOCUMENTS 5,153,376 A * 10/1992 Tomita ..... 399/276
7,826,781 B2 11/2010 Fujishima et al.
8,116,668 B2 2/2012 Koyanagi et al.
8,565,652 B2 10/2013 Terasaka et al.
8,824,932 B2 9/2014 Masuda et al.

(Continued)

FOREIGN PATENT DOCUMENTS

EP 2 363 756 A2 7/2011
EP 2 525 262 A1 11/2012

(Continued)

OTHER PUBLICATIONS

Kenta Kubo et al., U.S. Appl. No. 14/597,313, filed Jan. 15, 2015.

(Continued)

*Primary Examiner* — David Gray
*Assistant Examiner* — Sevan A Aydin
(74) *Attorney, Agent, or Firm* — Fitzpatrick, Cella, Harper & Scinto

(57) ABSTRACT

A developing device includes a developing member and a carrier collecting member. An outer surface of the developing member includes a plurality of protrusion portions aligned at regular intervals that are equal to or larger than an average particle diameter of toner particles and smaller than an average particle diameter of magnetic carrier particles. Each protrusion portion has a first face formed at one side of an apex of each protrusion portion and a second face formed at the other side of the apex, and an inclination angle of the first face is less than an inclination angle of the second face. In the circumferential direction of the developing member, when a downward direction of the first face is set to be positive, a relative velocity of a surface velocity of an image bearing member to a surface velocity of the developing member is set to be positive.

43 Claims, 36 Drawing Sheets

(56) References Cited

U.S. PATENT DOCUMENTS

| | | | | |
|---|---|---|---|---|
| 2003/0170050 | A1* | 9/2003 | Terai | 399/267 |
| 2004/0028428 | A1* | 2/2004 | Sugihara | 399/267 |
| 2007/0177908 | A1* | 8/2007 | Aruga et al. | 399/286 |
| 2008/0080905 | A1* | 4/2008 | Hirota et al. | 399/270 |
| 2008/0170891 | A1* | 7/2008 | Abe et al. | 399/277 |
| 2008/0232862 | A1 | 9/2008 | Fujishima et al. | |
| 2011/0069999 | A1* | 3/2011 | Oba et al. | 399/270 |
| 2011/0158697 | A1* | 6/2011 | Iwata et al. | 399/254 |
| 2011/0194874 | A1 | 8/2011 | Masuda et al. | |
| 2012/0294655 | A1 | 11/2012 | Terasaka et al. | |
| 2013/0149012 | A1* | 6/2013 | Nakao et al. | 399/277 |
| 2014/0023408 | A1* | 1/2014 | Kato et al. | 399/269 |
| 2014/0161493 | A1* | 6/2014 | Kubo et al. | 399/272 |

FOREIGN PATENT DOCUMENTS

| | | | | |
|---|---|---|---|---|
| JP | H09-211970 A | | 8/1997 | |
| JP | 2004020581 A | * | 1/2004 | G03G 15/08 |

OTHER PUBLICATIONS

Kenta Kubo et al., U.S. Appl. No. 14/613,608, filed Feb. 4, 2015.
European Search Report dated Oct. 1, 2015, in European Patent Application No. 15154336.0.

* cited by examiner

IMAGE FORMING APPARATUS

BACKGROUND OF THE INVENTION

1. Field of the Invention

The present invention relates to an image forming apparatus such as a copying machine, printer, facsimile, or the like using an electrophotographic system.

2. Description of the Related Art

As a prior art relating to a hybrid development method (hereinafter, referred to as an HV development method), an image forming apparatus described in Japanese Patent Laid-Open No. H9-211970 is known. Japanese Patent Laid-Open No. H9-211970 discloses an image forming apparatus including a developing roller which carries a toner facing a photosensitive drum, and a conveying roller which carries a two-component developer including the toner and a magnetic carrier facing the developing roller. In the image forming apparatus, electric fields are made to act between the developing roller and the conveying roller to form a toner layer on a surface of the developing roller, and develop an electrostatic image of the photosensitive drum.

In the HV development method, since the charging of the toner is performed by stirring the two-component developer, a sufficient charging amount may be easily obtained, and since the supply of the toner from the conveying roller to the developing roller is performed by an electrostatic force, a toner charged to opposite-polarity is not supplied to the developing roller. Therefore, an occurrence of fog may be prevented by avoiding a toner adhesion to a non-image area of a photosensitive drum 1. Further, since only the toner is supplied to the developing roller, there are advantages such as adhesion of the magnetic carrier to the photosensitive drum 1 also being prevented or the like.

FIG. 1 is a schematic view illustrating a development device 20 (hereinafter, referred to as an HV development device) having a configuration of Japanese Patent Laid-Open No. H9-211970 employing the HV development method. The two-component developer in a developing container 21 is supplied to a developer carrier 31 having a magnet fixedly disposed therein by a supply member 30. The supplied two-component developer is conveyed to a facing portion with a toner carrying member 27, while being controlled by a limiting member 32.

A potential difference ΔV is applied to the facing portion by a voltage applying portion 26. The toner of the developer in the facing portion is separated from the magnetic carrier on which the toner is electrostatically adhered by the ΔV, and projected in a direction of the toner carrying member 27 so as to be coated thereon. In this case, the ΔV and a charge amount Q/S in a unit area of the toner to be coated are in a proportional relationship as shown in Equation 1.

[Equation 1]

$$\Delta V \propto Q/S = M/S \times Q/M \quad (1)$$

Wherein, Q/S ($\mu C/cm^2$) is a product of a toner amount M/S ($g/cm^2$) in the unit area and the charge amount Q/M ($\mu C/g$) in a unit mass of the toner.

The toner coated on the toner carrying member 27 is conveyed to the facing portion with the photosensitive drum 1 to develop the electrostatic image on the photosensitive drum 1.

Meanwhile, in order to reduce energy consumption, a development device capable of outputting a high-quality image with a small toner amount is required. Therefore, speaking of the toner, by increasing an amount of pigment contained in the toner or improving dispersibility of the pigment, attempts to improve a density per toner have been made. However, in the HV development device, although the toner with improved density is used, it can be seen that an effect of suppressing the toner amount is limited.

FIG. 2A is a schematic view illustrating a toner (particle diameter=7.6 μm, specific gravity=1.1 $g/cm^3$, and M/S=0.47 $mg/cm^2$) developed on the photosensitive drum 1 by the HV development device. FIG. 2B is a schematic view when the toner is developed with a high density on the surface of the photosensitive drum 1 with the same toner amount.

As compared to a toner image (FIG. 2B) with a high density of the toner occupying the surface of the photosensitive drum 1, a toner image (FIG. 2A) with a low density is partially exposed due to the toner not completely covering the surface of the photosensitive drum 1 with the same toner amount. Therefore, when the toner image is transferred onto a sheet, due to the influence of a white background portion where the toner is not present, the image density is significantly reduced. In addition, it can be seen that density unevenness between a part having a large toner amount and a part having an extremely small toner amount is noticeably increased.

FIG. 2C is a schematic view illustrating a toner image (particle diameter=7.6 μm, specific gravity=1.1 $g/cm^3$, and M/S=0.65 $mg/cm^2$) when the image density is improved by increasing the potential difference ΔV of the HV development device. As illustrated in FIG. 2C, it can be seen that, in order to improve the image density, a much greater amount of toner than necessary is developed, and it is necessary to coat the surface of the photosensitive drum 1, and thus the effect of suppressing the toner amount is limited.

FIG. 3 is a graph illustrating results of a density of toner on media after fixing by an oven relative to a toner amount M/S ($mg/cm^2$) on the same media. The media used are Intelimer sheets (manufactured by Nitta Corporation) turnable on/off the adhesive force depending on a temperature condition.

A graph a of FIG. 3 is results in which the adhesive force of the Intelimer sheet is turned off depending on the temperature condition, and the toner image is fixed on the media by outputting a normal image by an image forming apparatus having the HV development device.

Meanwhile, a graph b of FIG. 3 is results in which the adhesive force of the Intelimer sheet is turned on depending on the temperature condition, and a high-density toner image as illustrated in FIG. 2B is achieved and fixed on the media by spreading the toner on the media and removing an excess toner by air. The HV development device does not reach a saturation density unless a large toner amount is developed to cover the surface of the photosensitive drum 1, whereas, if the high-density toner image is implemented, it is possible to cover the surface of the photosensitive drum 1 with a small toner amount and still reach a saturation density.

As described above, it is difficult to obtain a desired density with a small toner amount by using the HV development device and improve the density unevenness. Thereby, the present inventors examine the cause of a decrease in the density of the toner image developed on the photosensitive drum 1 in the HV development method. As a result, it can be seen that, in a method of coating the toner covered on the magnetic carrier by using the potential difference between both rollers as in the HV development device, the density of the toner image is easy to be reduced mainly by the following two reasons.

(1) When coating the toner on the surface of the toner carrying member 27 by the potential difference between the developer carrier 31 and the toner carrying member 27 illustrated in FIG. 1, since a force acts on the toner present in a space to which the electric fields are applied, such that the toner has multiple forces acting thereon, it is difficult to uniformly dispose the toner on the surface. In addition, the toner is multi-layered on the surface, such that the density of toner occupying the surface of the toner carrying member 27 is easy to be reduced as illustrated in FIG. 2A.

(2) Further, when the toner carried on the toner carrying member 27 is projected to the photosensitive drum 1, in the case of the toner being formed in a multi-layered non-uniform toner layer as illustrated in FIGS. 2A and 2C, since the adhered amount of the toner is different from each other, a development residue is easy to be generated, and the density of the toner image developed on the photosensitive drum 1 may be further reduced.

SUMMARY OF THE INVENTION

In consideration of the above-described circumstances, it is desirable to provide an image forming apparatus which obtains a high density image with a smaller toner amount.

An image forming apparatus includes:

a developing container which houses a developer having a non-magnetic toner and a magnetic carrier;

a concave-convex member which is rotatably disposed in the developing container, has a plurality of grooves formed in a rotation direction thereof, and is capable of carrying the developer;

a collecting portion which is disposed opposite the concave-convex member and collects the magnetic carrier carried on the concave-convex member; and a receiving member which contacts the concave-convex member on a downstream side from the collecting portion in the rotation direction of the concave-convex member, and receives the toner carried on the concave-convex member, wherein each groove formed in the concave-convex member has an inner surface configured to be in contact with the toner having an at least average particle diameter, and an apex having a smaller height than an apex of the toner in contact therewith, and each groove has side surfaces including a first side surface formed in one direction and a second side surface formed in the other direction in a circumferential direction of the concave-convex member, wherein the first side surface has a smaller inclination angle than the second side surface, and when a direction which moves down the first side surface in the circumferential direction of the concave-convex member is set to be positive, a relative velocity of a surface velocity of the concave-convex member to a surface velocity of the receiving member is set to be positive, at a position in which the concave-convex member and the receiving member come into contact with each other.

Further features of the present invention will become apparent from the following description of exemplary embodiments with reference to the attached drawings.

DESCRIPTION OF THE EMBODIMENTS

Figure 1:
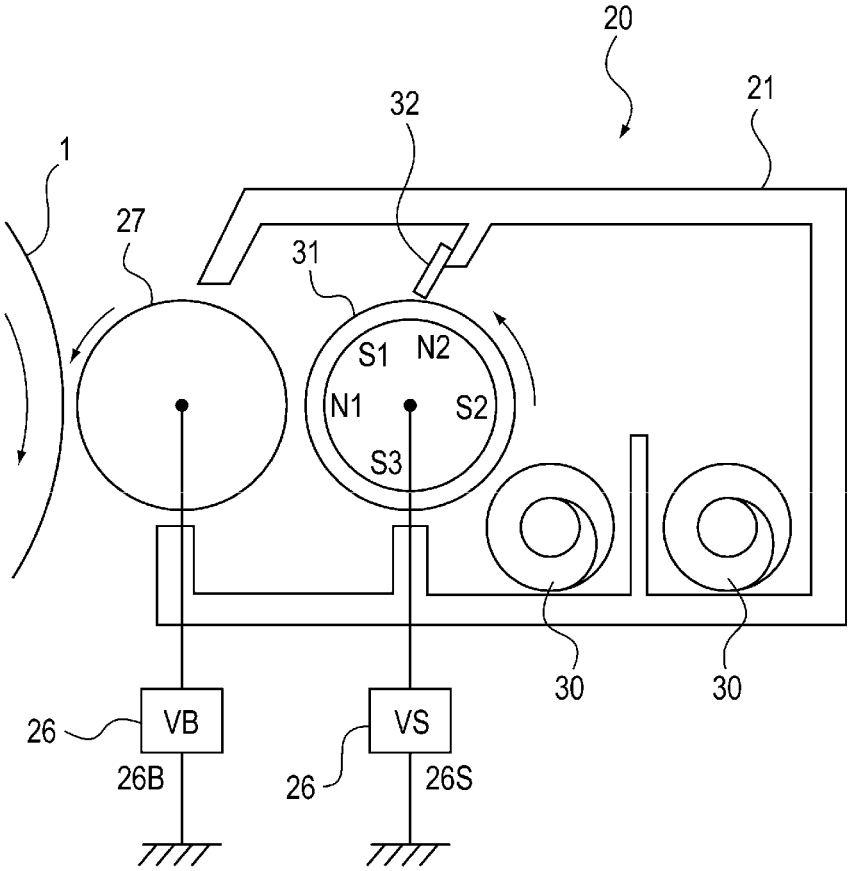
FIG. 1 is a schematic view illustrating a development device employing an HV development method.
Figure 2A:
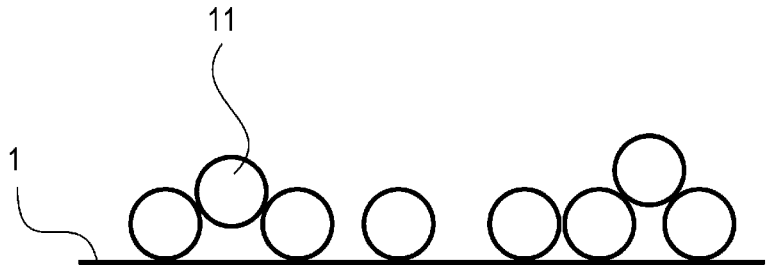
FIGS. 2A, 2B and 2C are schematic views illustrating a toner developed on a photosensitive drum by an HV development device.
Figure 2B:
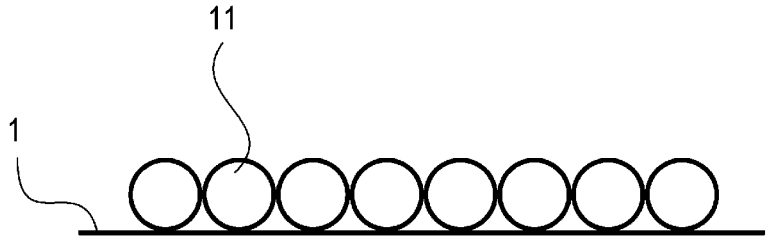
Figure 2C:
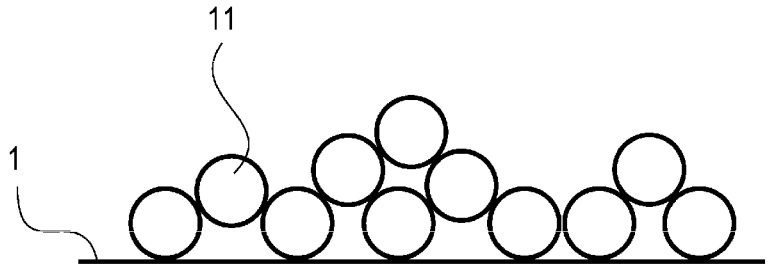
Figure 3:
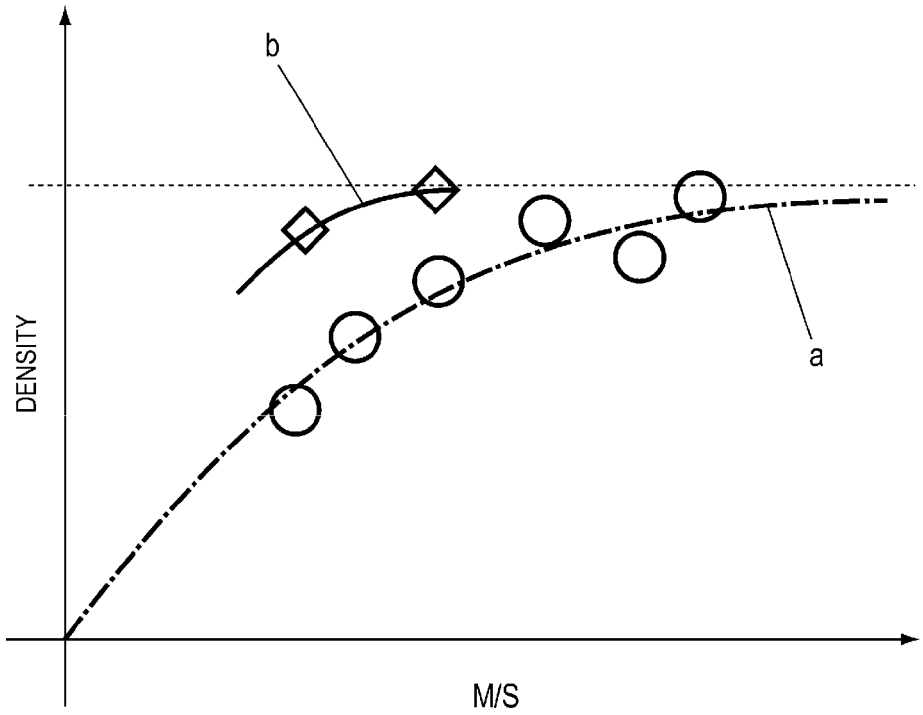
FIG. 3 is a graph illustrating results of a density of toner on media after fixing relative to a toner amount M/S (mg/cm$^2$) on the same media.
Figure 4:
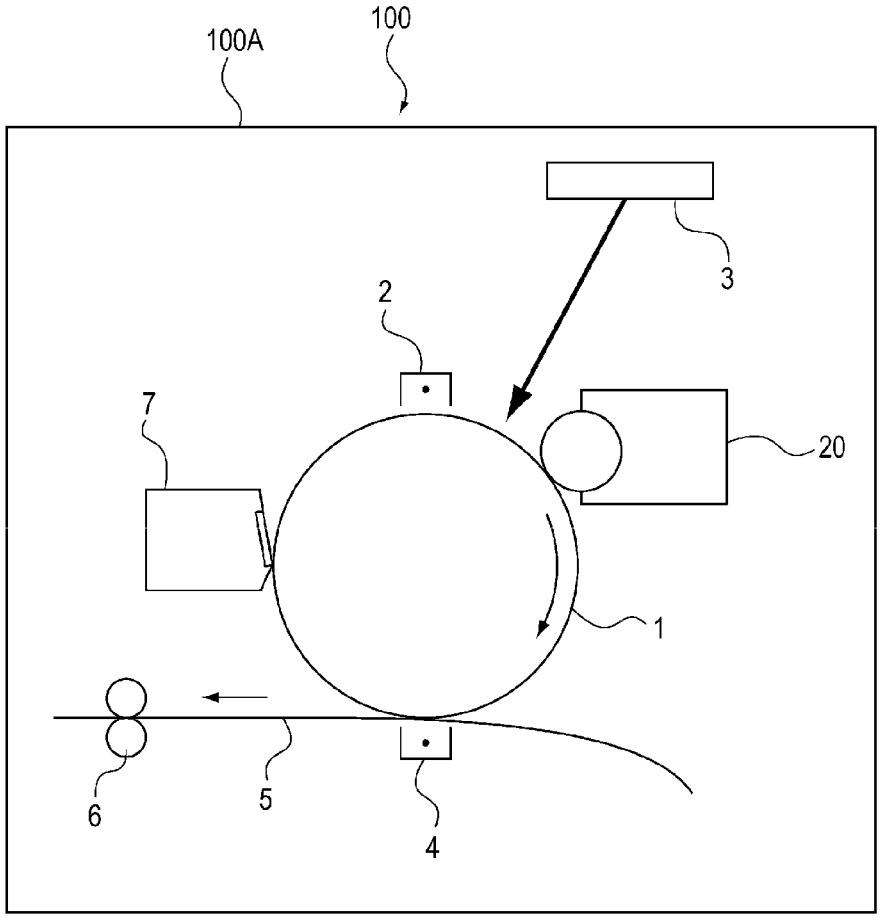
FIG. 4 is a cross-sectional view of an image forming apparatus using an electrophotographic system.

Hereinafter, development devices according to embodiments of the present invention will be described in detail with reference to the accompanying drawings. The present invention describes an apparatus embodied as an image forming apparatus using an electrophotographic system as illustrated in FIG. 4, however, dimensions, materials, shape, its relative positions, and the like of the components described in the embodiments are not intended to limit the scope of the present invention thereto. In addition, there are cases that reference numerals used in a previous embodiment are also used in a following embodiment, however, these are basically the same configuration, and a description for those of the previous embodiments are assumed to be incorporated.

FIG. 4 is a cross-sectional view of an image forming apparatus 100 using an electrophotographic system. The image forming apparatus 100 includes a photosensitive drum 1 rotatably installed inside of an apparatus body 100A as a drum-shaped "image bearing member" which includes a conductive substrate, and a photoconductive layer applied on the conductive substrate for holding an electrostatic image thereon.

The photosensitive drum 1 is uniformly charged by a charging device 2, and then an information signal is exposed by, for example, a laser exposure device 3 to form an electrostatic image, and the formed electrostatic image is visualized by a development device 20. Next, a toner image on a surface of the photosensitive drum 1 is transferred to a transfer sheet 5 by a transfer charger 4, and further fixed thereto by a fixing device 6. Further, a transferred residual toner on the photosensitive drum 1 is cleaned by a cleaning device 7.

Example 1

Figure 5:
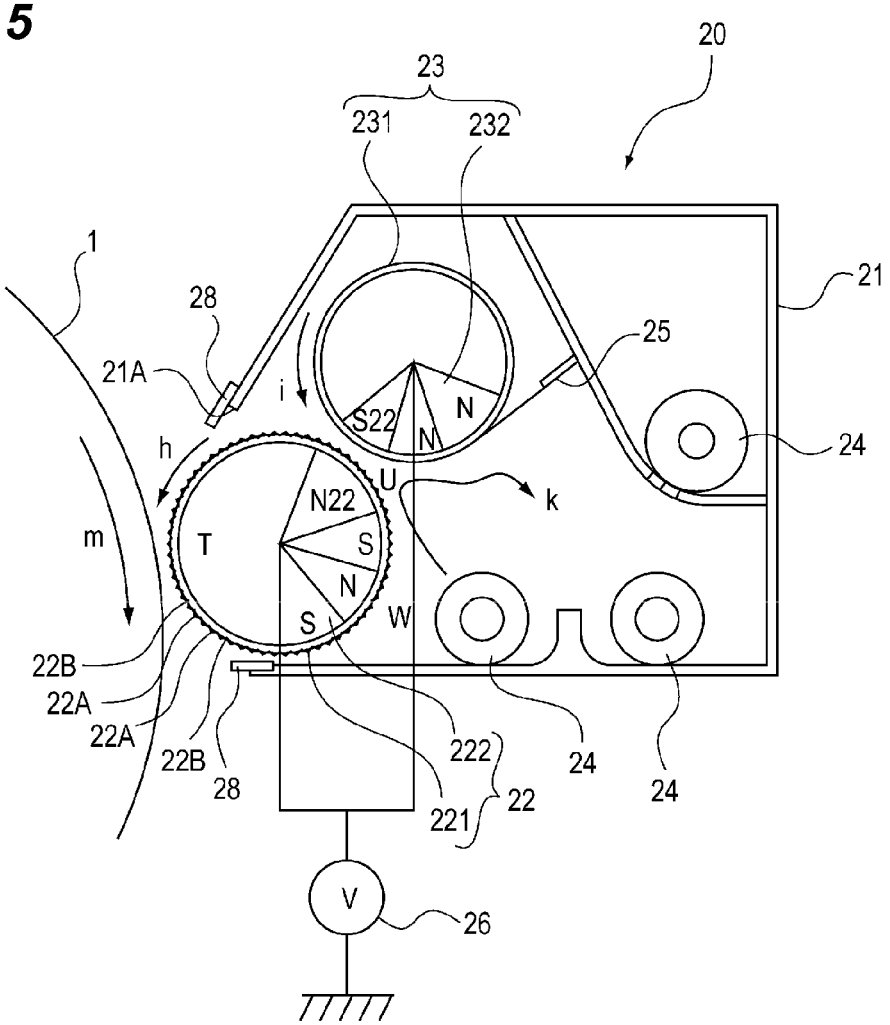
FIG. 5 is a cross-sectional view of a development device according to Example 1.

FIG. 5 is a cross-sectional view of the development device 20 according to Example 1. The development device 20 is disposed opposite the photosensitive drum 1. The development device 20 has a developing container 21. The developing container 21 houses a two-component developer 10 (see FIG. 8) having a toner (non-magnetic toner) and a carrier (magnetic carrier) therein. In addition, the development device 20 includes a concave-convex rotating member 22, supply members 24, and a collecting roller 23.

The concave-convex rotating member 22 as a concave-convex member is rotatably disposed in an opening 21A of the developing container 21 (inside of the developing container), and a plurality of convexes 22A having a predetermined height and a plurality of concaves 22B having a predetermined depth are formed on a surface thereof in a cross-sectional view as seen from a rotation axial direction thereof. The concave-convex rotating member 22 has a concave-convex structure in which the concaves 22B as a plurality of "grooves" is periodically formed in a rotation direction h. The concave-convex rotating member 22 is capable of carrying a toner 11 by the concaves 22B. The concave-convex rotating member 22 has a sleeve 221 rotatably supported in the developing container 21, and permanent magnets 222 which are non-rotatably supported inside of the sleeve 221 and have a plurality of magnetic poles.

The supply member 24 as a supply portion supplies the two-component developer 10 to the concave-convex rotating member 22. The supply member 24 is a screw for supplying the two-component developer 10 while stirring the same inside of the developing container 21.

The collecting roller 23 as a collecting portion is disposed opposite the concave-convex rotating member 22, and collects the two-component developer 10 (in particular, a magnetic carrier 12 carried on the concave-convex rotating member 22) which is not carried into the concaves 22B from the concave-convex rotating member 22. The collecting roller 23 has a sleeve 231 rotatably supported in the developing container 21, and permanent magnets 232 which are non-rotatably supported inside of the sleeve 231 and have a plurality of magnetic poles.

The photosensitive drum 1 as a "receiving member" is a member for carrying the electrostatic image. In addition, the photosensitive drum 1 contacts the concave-convex rotating member 22 on a downstream side from the collecting roller 23 in a rotation direction of the concave-convex rotating member 22, and receives the toner (the toner is transferred thereto) carried in the concaves 22B of the surface of the concave-convex rotating member 22. Additionally, the supply members 24, the collecting roller 23, and the photosensitive drum 1 are sequentially disposed at positions facing the surface of the concave-convex rotating member 22 from an upstream side in the rotation direction of the concave-convex rotating member 22.

Herein, the photosensitive drum 1 rotates in a rotation direction m, the concave-convex rotating member 22 rotates in a rotation direction h, and the collecting roller 23 rotates in an arrow i direction, respectively. A voltage from a voltage applying portion 26 is applied to the concave-convex rotating member 22 and the collecting roller 23.

Figure 6A:
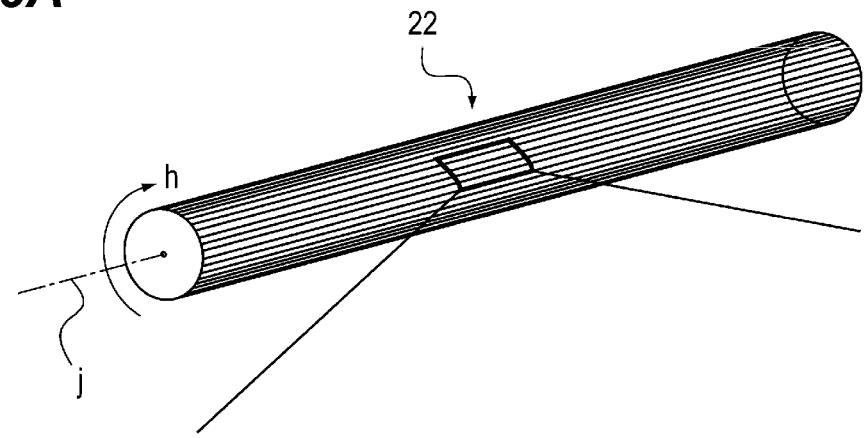
FIGS. 6A, 6B and 6C are views including perspective views of a concave-convex rotating member.

FIG. 6A is a perspective view of the concave-convex rotating member 22. As illustrated in FIG. 6A, the concave-convex rotating member 22 rotates in the rotation direction h about an axis j.

Figure 6B:
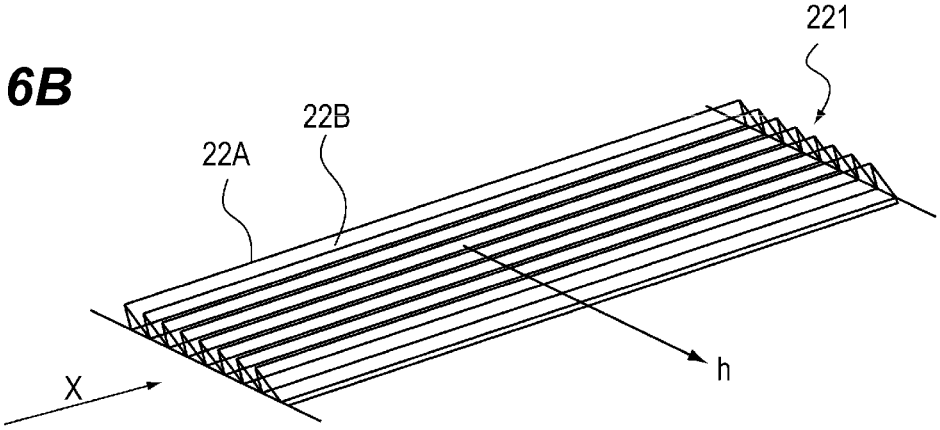

FIG. 6B is a partial enlarged perspective view of the sleeve 221 of the concave-convex rotating member 22. As illustrated in FIG. 6B, the convexes 22A of the surface of the sleeve 221 have surfaces along a direction of axis j (surfaces parallel to the direction of axis j), and are formed so as to be regularly arranged in convexes and concaves in the rotation direction h. The concaves 22B are formed between the convexes 22A.

Figure 6C:
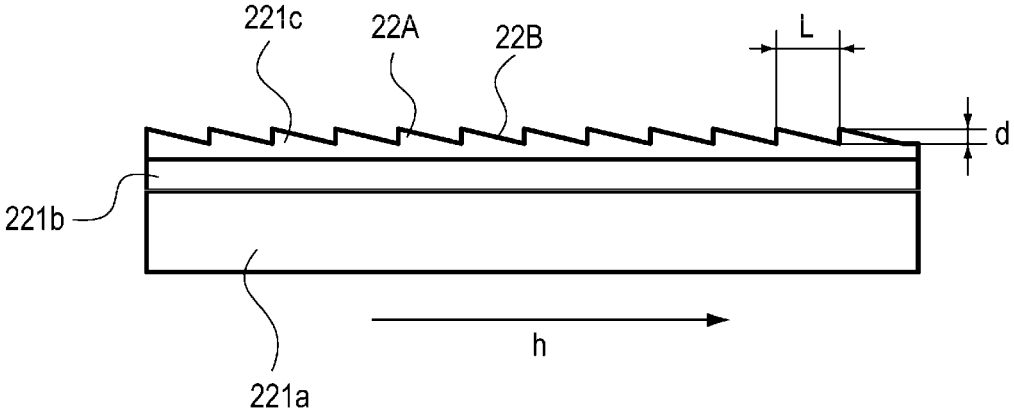

FIG. 6C is a cross-sectional view as seen from an arrow X direction in FIG. 6B. The sleeve 221 is formed by a member of a structure including a base layer 221*a* which is a cylindrical member made of a metal material, and an elastic layer 221*b* covered thereon. The sleeve 221 further includes a coating layer 221*c* formed on the elastic layer 221*b*.

The base layer 221*a* may be any material having conductive and rigid properties, and may be formed of SUS, iron, aluminum or the like.

The elastic layer 221*b* may include, as a base material, a rubber material having a suitable elasticity such as silicon rubber, acrylic rubber, nitrile rubber, urethane rubber, ethylene propylene rubber, isopropylene rubber, styrene-butadiene rubber or the like. The elastic layer 221*b* is a layer provided with conductive properties by adding conductive particles such as carbon, titanium oxide, metal fine particles or the like thereto. Besides the conductive fine particles, a spherical resin may be dispersed in the elastic layer 221*b* in order to control the surface roughness. In this example, the sleeve 221 includes the base layer 221*a* made of stainless steel, and the elastic layer 221*b* which is formed thereon and made of silicone rubber and urethane rubber with carbon dispersed therein.

The coating layer 221*c* is formed of a resin material. The convexes 22A are formed in the coating layer 221*c*. The plurality of convexes 22A is regularly arranged in the rotation direction h of the sleeve 221. Each of the convexes 22A are formed at an inclination pitch L, which is a dimension of the rotation direction h, and a height d.

Further, in order to increase adhesiveness of the coating layer 221*c* with the elastic layer 221*b*, a primer layer may be provided between both layers. In this example, the convexes 22A are formed in the coating layer on the elastic layer 221*b*, but the convexes 22A may be directly formed on the elastic layer 221*b*. In this regard, the coating layer may or may not be provided on the elastic layer.

In this example, the photosensitive drum 1 has the photosensitive layer on the roller-shaped base layer 221*a*, but a belt-shaped photosensitive belt may be used. In this regard, the elastic layer 221*b* may or may not be included in the sleeve 221. Specifically, the coating layer 221*c* made of a resin or metal may be provided on the base layer 221*a* and the convexes 22A may be formed in the coating layer 221*c*, or the convexes 22A may be directly formed on the base layer 221*a*.

Further, for preventing from being chipped or insulating processing, a high-hardness material and an insulating material may be coated on the coating layer having the convexes 22A, the elastic layer, or the base layer. In this case, it is necessary to form a thin coating layer enough to hold the convexes 22A thereon.

Figure 7:
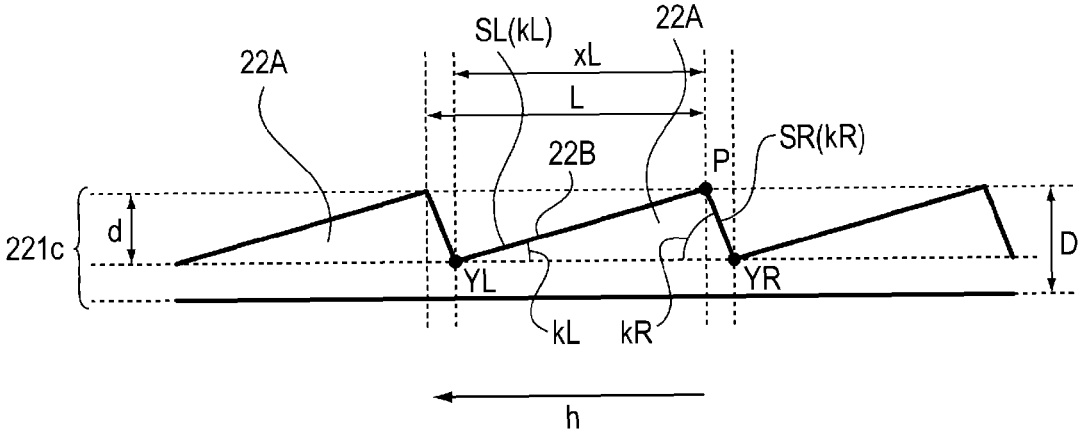
FIG. 7 is a cross-sectional view of a coating layer on which convexes are formed.

FIG. 7 is a cross-sectional view of the coating layer 221*c* in which the concaves 22B are formed. As illustrated in FIG. 7, each of the concaves 22B (each groove) has a gentle inclined surface SL (a first side surface formed in one direction) which is gently formed in a gentle inclination angle from an apex P to a left bottom point YL, in a circumferential direction of the concave-convex rotating member 22 (concave-convex member), and a steep inclined surface SR (a second side surface formed in the other direction) which is steeply formed in a steep inclination angle from the apex P to a right bottom point YR. A plurality of convexes 22A has inclinations with different angles from each other, as gentle inclination angle $|\kappa L|$<steep inclination angle $|\kappa R|$. Therefore, the inclination angle of the gentle inclined surface SL becomes less than that of the steep inclined surface SR.

A direction which moves up the steep inclined surface SR with a steep inclination angle which is formed between the plurality of convexes 22A (between convexes) then moves down the gentle inclined surface SL with a gentle inclination angle (a direction which moves down the first side surface of the concave-convex member in the circumferential direction thereof) is set to be a positive direction in the direction along the plane of the sleeve 221. The convexes 22A are formed in a concave-convex structure arranged at the inclination pitch L from the steep inclination angle $|\kappa R|$ to the gentle inclination angle $|\kappa L|$ in the rotation direction h. In this regard, the groove formed in the concave-convex structure is arranged at pitch L of the grooves so as to contact the toner with the inner surface thereof. In other words, the case in which the toner cannot contact the inner surface of the groove is not included therein. That is, a concave-convex structure having a smaller pitch L of the grooves than the particle diameter of the toner is not included therein.

In this example, the inclination pitch L is 8 μm, a width xL of the gentle inclined surface SL is 7.3 μm, a depth d thereof is 1.9 μm, a maximum inclination $\kappa R$ of the steep inclined surface SR is 2.7, and a maximum inclination $\kappa L$ of the gentle inclined surface SL is 0.26. In addition, a thickness D of the coating layer 221*c* is 7 μm. Herein, the gentle inclined surface SL and the steep inclined surface SR are formed so as to extend parallel to the axis j (see FIG. 6A), these surfaces may be formed so as to be inclined to the axis j.

The present invention is not limited to the above-described structure, and any structure corresponding to a determination method of the concave-convex structure to be described below, may be included. Further, methods of forming and determining the concave-convex structure will be described in detail below.

Figure 8:
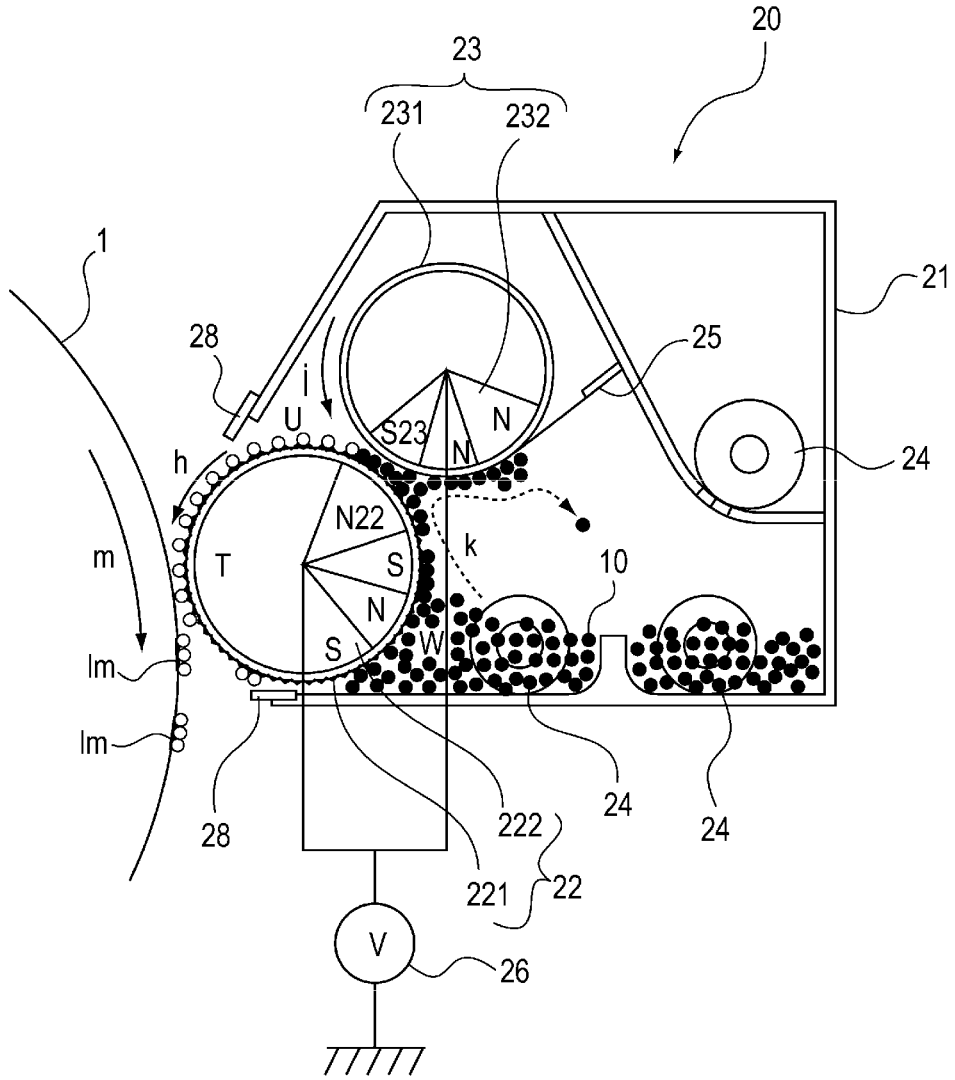
FIG. 8 is a cross-sectional view illustrating a state in which two-component developer is housed inside of the development device with the two-component developer being moved.

FIG. 8 is a cross-sectional view illustrating a state in which the two-component developer 10 is housed inside of the development device 20 with the two-component developer 10 being moved. The concave-convex rotating member 22 is disposed so as to contact the photosensitive drum 1, and rotatably provided in the rotation direction h in a developing portion T in which the toner is moved to the photosensitive drum 1, in the rotation direction m of the photosensitive drum 1. The supply members 24 and the collecting roller 23 are disposed opposite the concave-convex rotating member 22. Herein, a region of the photosensitive drum 1 side in the concave-convex rotating member 22 is referred to as the developing portion T, and a region of the supply members 24 side of the concave-convex rotating member 22 is referred to as a supply portion W.

The supply members 24 serve to stir the two-component developer 10 collected by the collecting roller 23 to be described below, convey to the supply portion W in which the concave-convex rotating member 22 and the supply members 24 face each other, and supply thereto by a magnetic force exerted by the permanent magnets 222.

Meanwhile, the sleeve 231 of the collecting roller 23 is rotatably provided so as to move in an opposite direction in a collecting portion U facing the concave-convex rotating member 22. A part of the two-component developer 10 supplied to the photosensitive drum 1 by the supply member 24 is collected by the magnetic force exerted by magnetic fields formed in cooperation with the permanent magnets 222 and permanent magnets 232, before being conveyed to the developing portion T. For this purpose, the collecting roller 23 may be disposed at a position upstream from the developing portion T and downstream from the supply portion W, in the rotation direction h of the concave-convex rotating member 22.

Next, coating the toner on the concave-convex rotating member 22 and developing the electrostatic image on the photosensitive drum 1 in the development device 20 will be described. A further detailed description will be described below. In the supply portion W, the two-component developer 10 is supplied by the supply members 24 to the concave-convex rotating member 22 having the concave-convex structure regularly arranged on the surface thereof.

During a conveying process of supplying the two-component developer 10 to the concave-convex rotating member 22 and collecting by the collecting roller 23, the toner of the two-component developer 10 in contact with the sleeve 221 of the concave-convex rotating member 22 contacts the concave-convex structure to be separated from the magnetic carrier, and is stably and uniformly coated thereon in a thin layer. The two-component developer 10 other than the coated toner is collected by the collecting roller 23 in the collecting portion U by a magnetic force, and stirred and again supplied to a path of an arrow k by the supply member 24, and then this process is repeated.

On the other hand, the toner which is not collected but is instead thinly and uniformly coated on the concave-convex rotating member 22 contacts the photosensitive drum 1 in the developing portion T, and is developed on the photosensitive drum 1 by the potential difference between the concave-convex rotating member 22 and the photosensitive drum 1. In this case, since coating of the concave-convex rotating member 22 is uniform in a regular manner, by properly setting a velocity ratio vh/vm determined by a moving velocity vh of the sleeve 221 and a moving velocity vm of the photosensitive drum 1, a uniform and high-density toner image may be developed on the photosensitive drum 1.

As an advantage compared to the HV development method which is a prior art, besides obtaining a uniform and high-density toner image, stability of the developing amount may be cited. For the HV development method, if the potential difference ΔV is determined, the coating amount depends on Q/M (following Equation 1).

[Equation 1]

$$\Delta V \propto Q/S = M/S \times Q/M \tag{1}$$

In other words, when the Q/M of the developer is varied due to environmental change or durability, the coating amount is varied, and the developing amount is largely varied according thereto. Therefore, in the HV development method, a complicated potential control by sensing the Q/M is required. In contrast, in the present invention, since the toner comes into multipoint contact with the inclined surface of the concave-convex structure formed on the concave-convex rotating member 22, it is possible to coat with a small electrostatic adhesion force as compared to the case of point contact with the plane. In other words, even when electrostatic adhesion force is varied due to the toner charge amount being varied, the toner amount coated on the concavo-convex structure is rarely varied, and therefore it is possible to achieve a stable coating amount, and achieve a stable developing amount without relying on a complicated control.

Hereinafter, coating the toner on the concave-convex rotating member 22 and developing the electrostatic image on the photosensitive drum 1 in the development device 20 will be described in detail. The two-component developer 10 in the developing container 21 is stirred and conveyed by the supply member 24 to the supply portion W. In this example, a positively charged toner is used having a number average particle diameter (D50) $r_t$ manufactured by a polymerization method of 7.6 μm, and an average circularity of 0.97. Because the toner is rotationally moved on the sleeve 221, the average circularity is preferably 0.95 or more.

As the magnetic carrier, a standard carrier P-01 (manufactured by the Imaging Society of Japan) having a number average particle diameter $r_c$ of 90 μm was used. Because a surface area capable of sufficiently contacting the toner to be coated and charging is required, the particle diameter rc of the magnetic carrier is preferably two times or more of the particle diameter rt of the toner. The number average particle diameter of the toner and magnetic carrier, and a method of measuring the average circularity of the toner will be described below.

The toner and magnetic carrier were mixed in a toner mass ratio (TD ratio x) of 7% to a total mass to prepare and use the two-component developer 10. In order to supply a sufficient toner amount to the sleeve 221, the TD ratio x is controlled so that a cover ratio S which is calculated as a rate of coating the magnetic carrier surface with the toner becomes 50% or more from the following Equation 2.

[Equation 2]

$$S(\%) = \frac{\rho_c r_c x}{4\rho_t r_t (100 - x)} \times 100 \tag{2}$$

Wherein, ρc denotes a real carrier density (4.8 g/cm$^3$), and ρt denotes a real toner density (1.05 g/cm$^3$). The toner and the magnetic carrier are not limited, and any toner and magnetic carrier generally used and publicly known in the related art may be used. The two-component developer 10 conveyed to the supply portion W is supplied to the sleeve 221 by the magnetic fields produced by the plurality of permanent magnets 222 fixedly disposed inside of the concave-convex rotating member 22. The supplied two-component developer 10 is magnetically brushed under the influence of the rotation of the sleeve 221 and the magnetic fields produced by the permanent magnets 222, and conveyed in the rotation direction h of the sleeve 221.

Figure 9A:
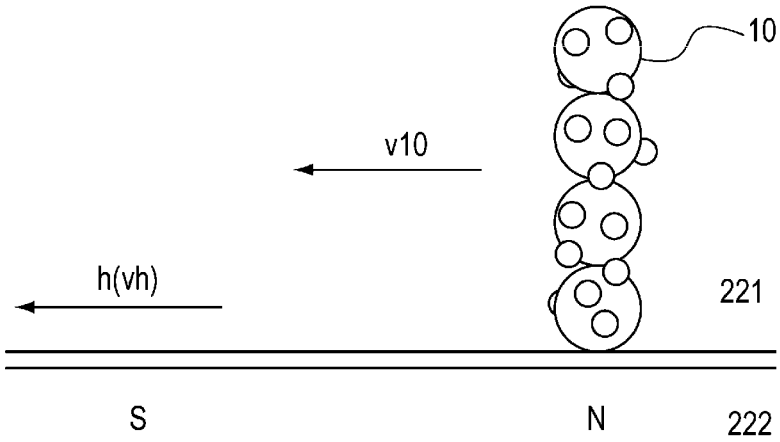
FIGS. 9A, 9B and 9C are schematic views describing a state of conveying the two-component developer.
Figure 9B:
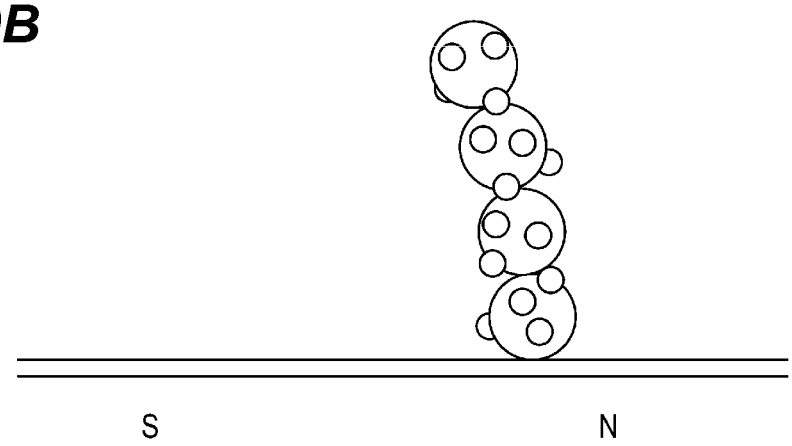
Figure 9C:
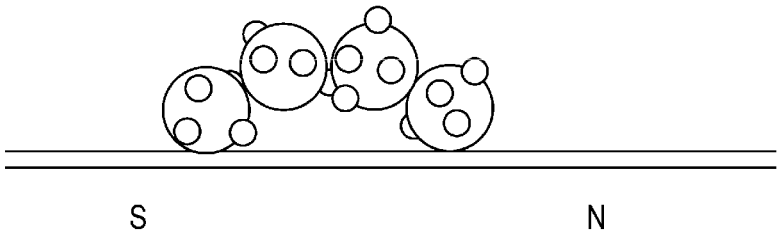

FIG. 9 is a schematic view describing a state of conveying the two-component developer 10. For convenience of drawing, the concave-convex structure formed on the surface of the sleeve 221 will not be illustrated. The two-component developer 10 is magnetically brushed by the magnetic field of the permanent magnets 222 (see FIG. 9A). With the movement (vh) of the sleeve 221, a magnetic brush begins to receive the influence of the adjacent poles (see FIG. 9B). If the sleeve 221 further moves, the developer is bound to the adjacent poles (see FIG. 9C). Thereafter, this process is repeated. Therefore, the average moving velocity v10 of the two-component developer 10 has a velocity difference (v10>vh) relative to the moving velocity vh of the sleeve 221.

Figure 10A:
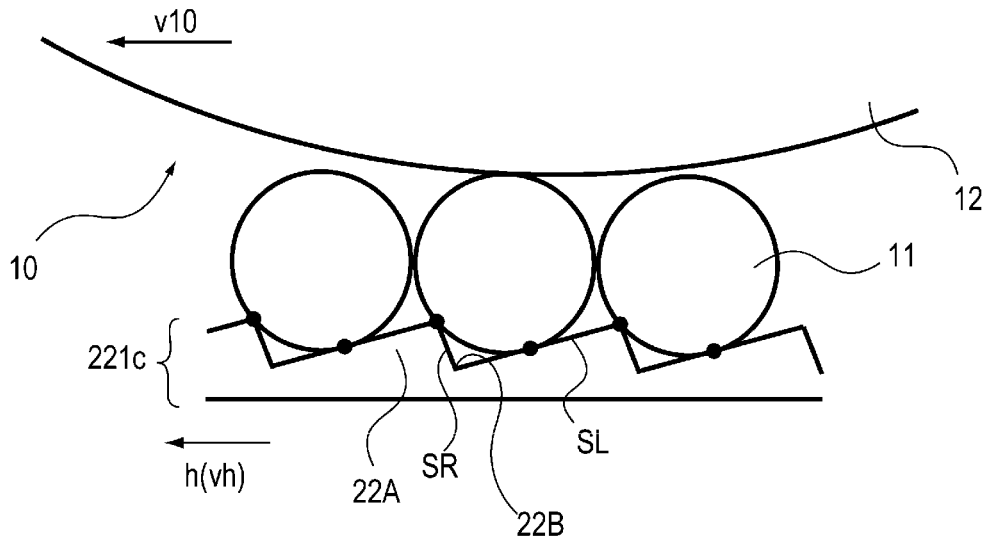
FIGS. 10A and 10B are schematic views describing a toner behavior during conveying the two-component developer in a sleeve.

FIG. 10A is a schematic view describing a toner behavior during conveying the two-component developer 10 in the sleeve 221. In FIG. 10A, only the magnetic carrier 12 is present in the vicinity of the convexes 22A formed on the surface of the coating layer 221*c* of the sleeve 221, but a plurality of magnetically-brushed magnetic carriers may be present in practice. As illustrated in FIG. 10A, the sleeve 221 has the concave-convex structure which is regularly arranged in the rotation direction h and uneven in a vertical direction.

While the two-component developer 10 is conveyed on the sleeve 221, among the toner coated to the magnetic carrier 12, the toner 11 in contact with the concave-convex structure comes into multipoint contact with the gentle inclined surface SL and the steep inclined surface SR. By this, the toner is bound on the concave-convex structure and separated from the magnetic carrier 12 to be coated on the concave-convex structure. In this case, since a binding force is applied only to the toner 11 in contact with the concave-convex structure, it is possible to uniformly coat the toner 11 in a thin layer on a regular structure.

Figure 10B:
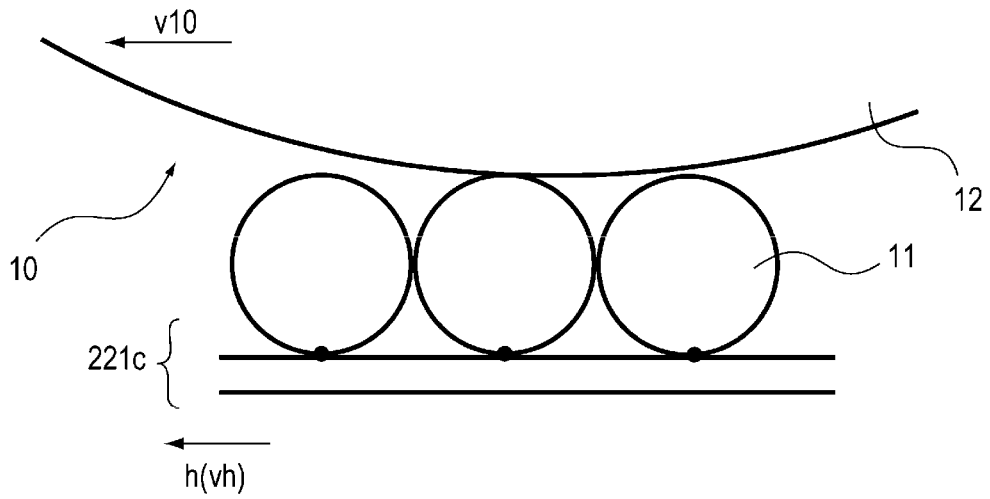

FIG. 10B is a schematic view describing the toner behavior during conveying the two-component developer 10 in the sleeve 221 without the concave-convex structure according to a comparative example. During the conveying process, the toner 11 in contact with the sleeve 221 has a smaller binding force than the concave-convex structure, and therefore is difficult to be coated on the sleeve 221.

Further, during the conveying process, the toner 11 adhered once on the sleeve 221 is also constantly in contact with the following conveyed magnetic carrier 12. When there is no concave-convex structure, since the toner adhered on the sleeve 221 has a smaller binding force than the concave-convex structure, the toner is easy to be collected in the magnetic carrier 12 in contact therewith. Therefore, scraping marks by the magnetic brush substantially parallel to the conveying direction of the two-component developer 10, herein, the rotation direction h of the sleeve 221, become significant, and it is not possible to uniformly coat the toner.

Figure 11A:
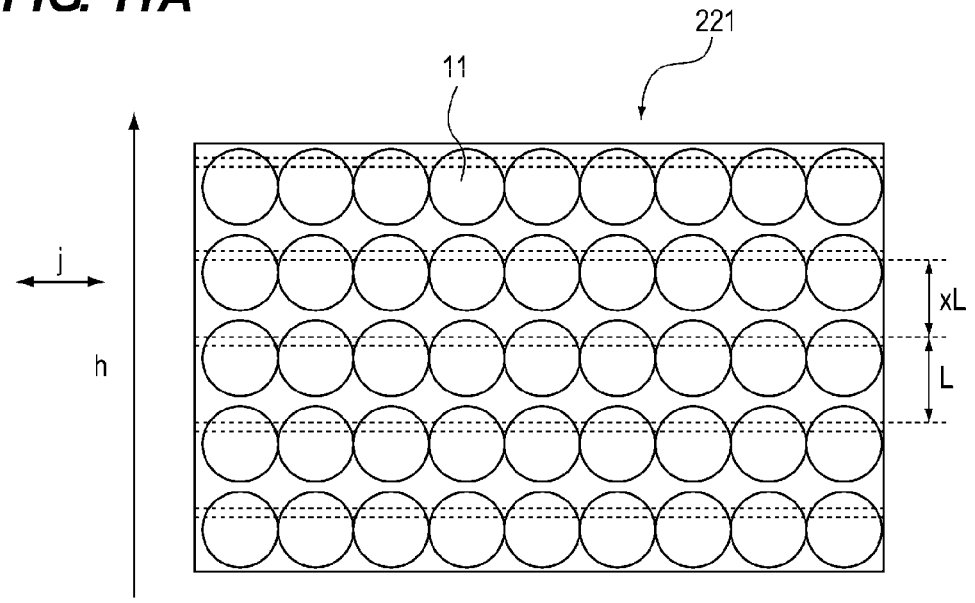
FIGS. 11A and 11B are schematic views illustrating a toner image coated on the sleeve after collecting the developer to be described below.
Figure 11B:
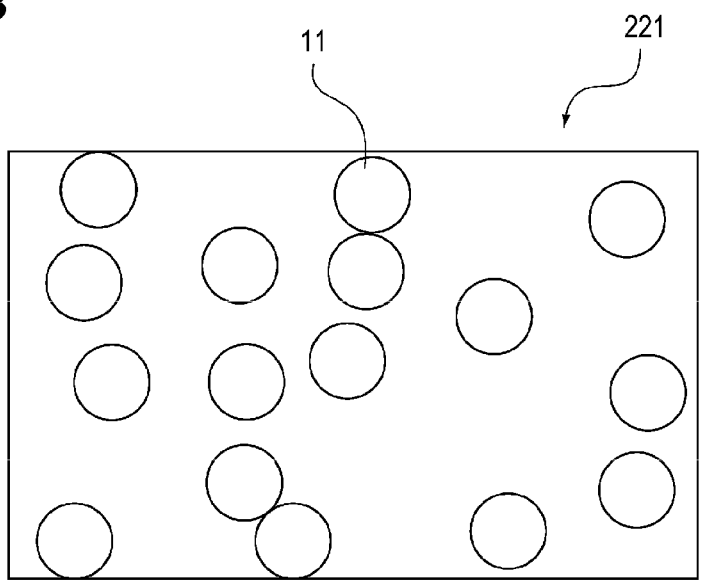

FIG. 11 are schematic views illustrating a toner image coated on the sleeve 221 after collecting the developer to be described below. When the sleeve 221 has the concavo-convex structure (see FIG. 11A), since the toner 11 is bound by the concave-convex structure, it is difficult to be scraped by the magnetic brush, and as such the toner 11 may be uniformly coated in a thin layer on the structure. That is, as illustrated in FIG. 11A, with the density of the toner 11 arranged in the direction of the axis j increased, the density of the toner 11 disposed in the rotation direction h is also increased.

On the other hand, when the sleeve 221 has no concave-convex structure (see FIG. 11B), since the binding force of the toner 11 is weak, and it is difficult to be adhered on the sleeve 221, as well as the toner 11 is easy to be scraped by the magnetic brush, it is not possible to uniformly coat the toner in a thin layer on the surface.

Figure 12A:
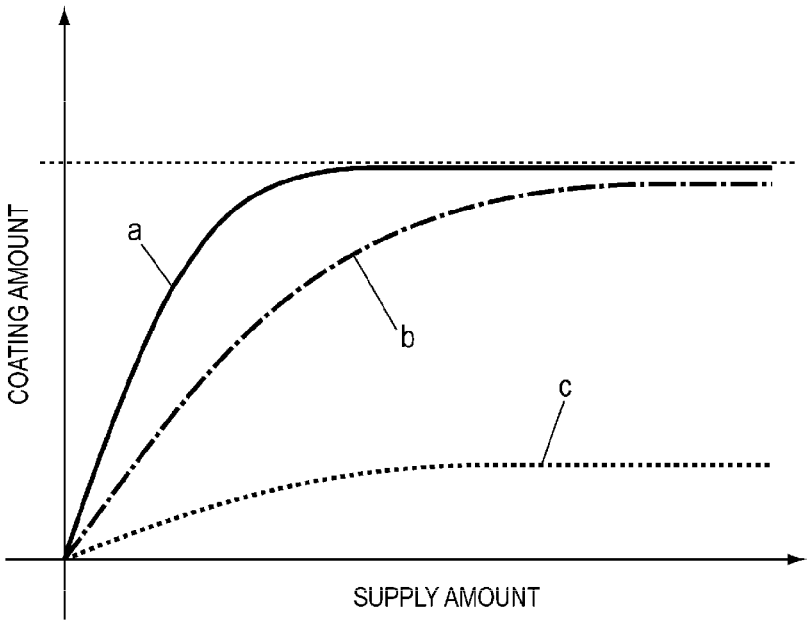
FIGS. 12A, 12B, 12C and 12D are views including a graph illustrating a coating amount relative to a supply amount of the two-component developer in a sleeve having structures a, b and c.
Figure 12B:
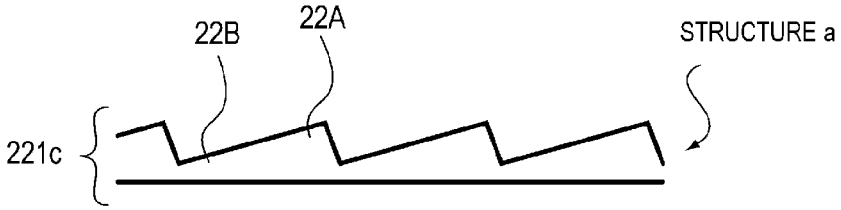
Figure 12C:
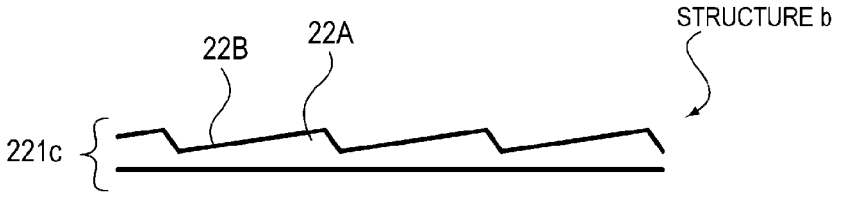
Figure 12D:
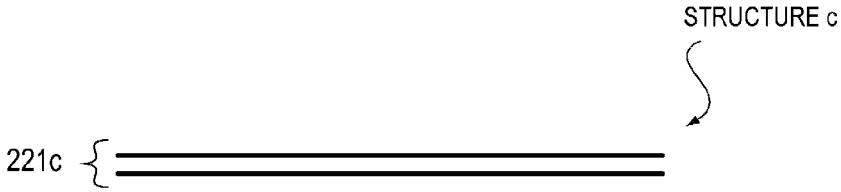

FIG. 12A is a graph illustrating a coating amount relative to a supply amount of the two-component developer 10 in the sleeve 221 having structures a, b and c. FIG. 12B is a cross-sectional view of the coating layer 221*c* corresponding to a graph a in FIG. 12A, and FIG. 12C is a cross-sectional view of the coating layer 221*c* corresponding to a graph b in FIG. 12A. FIG. 12D is a cross-sectional view of the coating layer corresponding to a graph c in FIG. 12A.

The structure a of FIG. 12B is a configuration having a large depth of the concaves 22B by increasing the height of the convexes 22A of the coating layer 221*c*, the structure b of FIG. 12C is a configuration having a small depth of the concaves 22B by decreasing the height of the convexes 22A of the coating layer 221*c*, and the structure c of FIG. 12D is a configuration with no concave or convex in the coating layer.

Since the structure a is a concavo-convex structure having a large depth of the concaves 22B by increasing the height of the convexes 22A, the binding force is increased, and therefore an adhesion probability Q1 that the toner in contact with the surface of the sleeve 221 is separated from the magnetic carrier and adhered to the structure surface is high. Further, a scraping probability Q2 that the toner is scraped by the following conveyed magnetic brush is low. Therefore, coating to the concave-convex structure may be completed with a smaller supply amount. This effect can be seen from the graph a in FIG. 12A.

Since the structure b has a smaller depth of the concaves 22B by decreasing the height of the convexes 22A than the structure a, the adhesion probability Q1 is low, and the scraping probability Q2 is high. Therefore, compared to the structure a, the supply amount required to complete the coating is increased. This effect can be seen from the graph b in FIG. 12A.

On the other hand, since the structure c has a smaller binding force of the toner than the structures a and b, the adhesion probability Q1 is significantly low, and the scraping probability Q2 is significantly high. Therefore, even when increasing the supply amount, it is not possible to sufficiently coat the toner on the surface of the sleeve 221. This effect can be seen from the graph c in FIG. 12A.

Figure 13A:
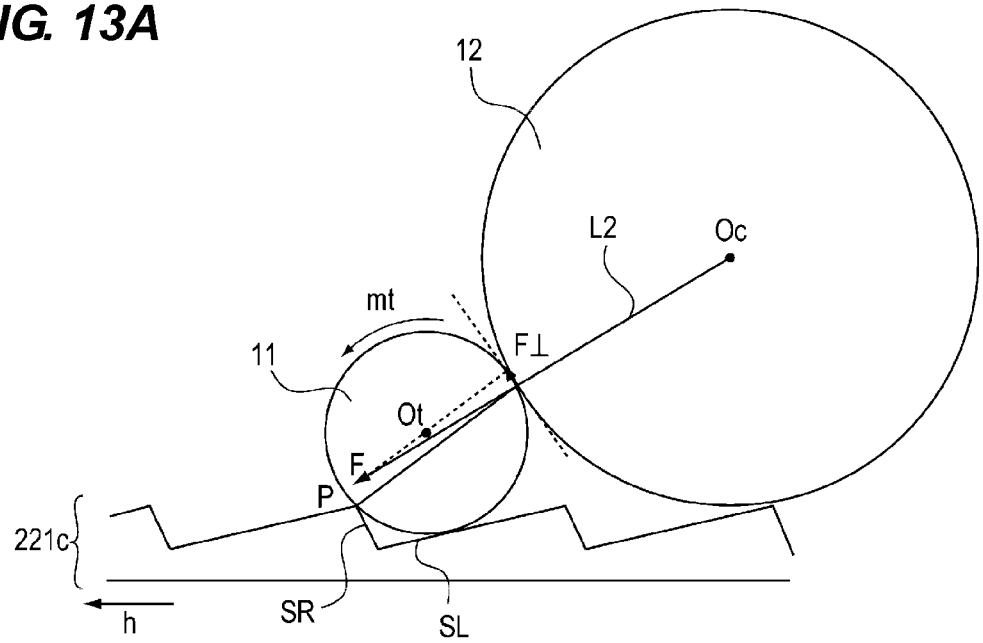
FIGS. 13A and 13B are schematic views illustrating when a toner bound on a concave-convex structure collides with a following conveyed magnetic carrier of the two-component developer.

FIG. 13A is a schematic view illustrating when the toner 11 bound on the concave-convex structure collides with the magnetic carrier 12 of the following conveyed two-component developer. The toner 11 receives a force F applied from a center Oc (center of gravity) of the magnetic carrier 12 to a center Ot (center of gravity) of the toner 11. In this case, it is possible to consider that a torque is applied to the toner 11 by a vertical component F⊥ of the force F about the toner 11 and the apex P on the steep inclined surface SR of the concave-convex structure, such that the toner rotates in an arrow mt direction in FIG. 13A, and goes beyond the steep inclined surface SR to be scraped by the magnetic carrier.

By forming the concave-convex structure on the concave-convex rotating member 22, the toner 11 is arranged in the axis j to be periodically carried by the two-point contact in the concaves 22B in the rotation direction h in the cross-sectional view (see FIG. 6). However, as described above, by setting the concave-convex structure, the diameter of the magnetic carrier 12, and the diameter of the toner 11, the probability that the magnetic carrier 12 scrapes the toner 11 may be reduced.

In addition, efficiently transferring the toner 11 which is not scraped by the magnetic carrier 12 to the photosensitive drum 1 is related to a direction which moves up the steep inclined surface SR then moves down the gentle inclined surface SL, and a relative velocity of the concave-convex rotating member 22 to the photosensitive drum 1. This will be described with reference to FIG. 10.

For example, in FIG. 10, a left direction which moves up the steep inclined surface SR then moves down the gentle inclined surface SL is set to be positive, and the relative moving velocity vh of the sleeve 221 to the moving velocity v10 of the photosensitive drum 1 is also set to be positive. That is, the steep and gentle order of the inclined surface of the concave-convex structure is the left direction, and when the sleeve 221 is rotated in the left direction it is higher than the photosensitive drum 1. In this case, the toner 11 is easy to move to the photosensitive drum 1 along the gentle inclined surface SL. Therefore, the development efficiency is increased.

On the other hand, for example, in FIG. 10, a left direction which moves up the steep inclined surface SR then moves down the gentle inclined surface SL is set to be positive, and the relative moving velocity Vh of the sleeve 221 to the moving velocity v10 of the photosensitive drum 1 is set to be negative. That is, the steep and gentle order of the inclined surface of the concave-convex structure is the left direction, and when the sleeve 221 is rotated in a right direction it is higher than the photosensitive drum 1. In this case, the toner 11 is caught on the apex P of the steep inclined surface SR so as to be difficult to move to the photosensitive drum 1. Therefore, the development efficiency is rapidly reduced, and it may be said that the setting is no good.

It is possible to consider that applying a torque to the toner 11 is the same as when coating the concave-convex structure, and by suppressing the toner 11 to be rotated in the arrow mt direction, the adhesion probability Q1 may be increased, and the scraping probability Q2 may be reduced.

Figure 13B:
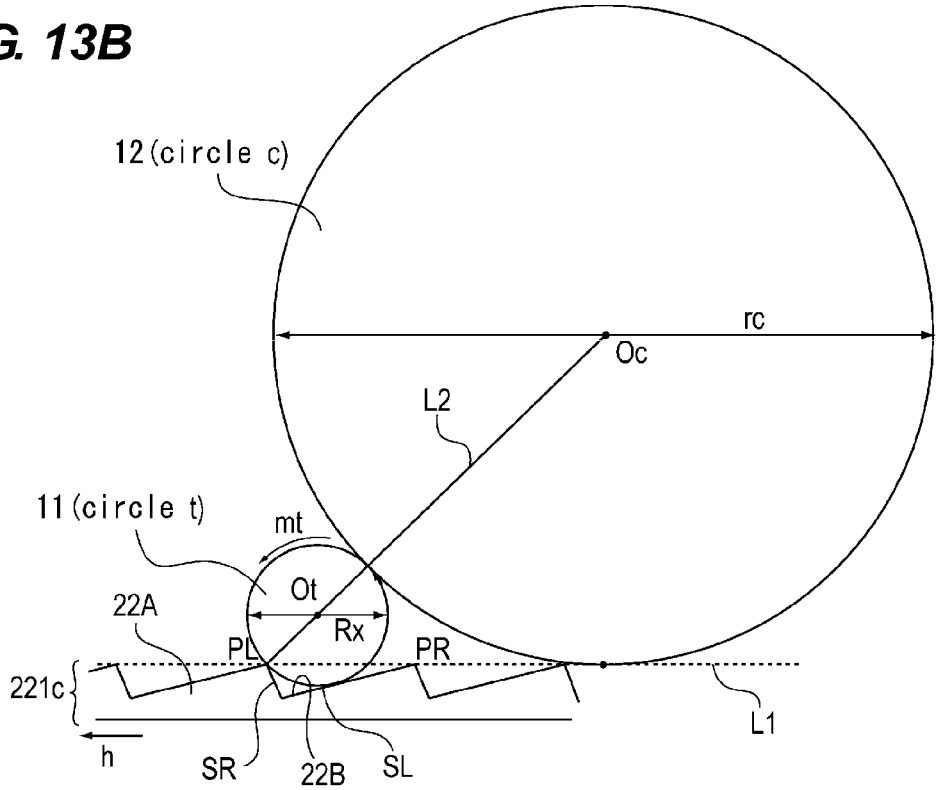

FIG. 13B is a schematic view describing a circle corresponding to the toner 11 and the magnetic carrier 12 under the following conditions with respect to the cross-sectional view of the concave-convex structure. Now, the maximum value Rx of the toner is calculated by using FIG. 13B. Further, the minimum value Rn of the toner is calculated by using FIG. 15A.

In the state of FIG. 13B, a second virtual line L2 passes through the apex PL of the inclined surface, but the particle diameter of the toner becomes the maximum value at this time, and it is set to the maximum value Rx. Herein, the second virtual line L2 is a line that connects the toner center (Ot) of the toner 11 (circle t) and the carrier center (Oc) of the carrier 12 (circle c). The toner (circle t) contacts with multiple points at the apex PL of one steep inclined surface SR of two inclined surfaces of the concaves 22B formed between the adjacent convexes 22A and the other gentle inclined surface SL.

The carrier (circle c) has a predetermined particle diameter rc in contact with a first virtual line L1 connecting the apexes PL and PR (apexes with each other) of the convexes 22A formed on the surface of the concave-convex rotating member 22 and the toner 11. In this case, a force generating a torque for rotating the toner in the arrow mt direction about the apex PL does not act on the circle t.

On the other hand, if the particle diameter of the circle t exceeds the Rx, the second virtual line L2 is shifted from the apex PL of the inclined surface, the vertical component F⊥ acts as illustrated in FIG. 13A, and a torque is generated to be rotated in the arrow mt direction. In other words, when the concave-convex structure and the particle diameter rc of the magnetic carrier 12 are determined, the upper limit of the particle diameter of the toner 11 that can be coated on the sleeve 221 is geometrically determined to be Rx. In addition, each of the concaves 22B formed in the concave-convex rotating member 22 (concave-convex member) is set in such a manner that the toner 11 having at least an average particle diameter can contact the inner surface of the concaves 22B, and the apex of the concaves 22B is lower than the apex of the toner 11.

The Rx which is the maximum particle diameter of the toner 11 is geometrically calculated from the concave-convex structure (L=8 μm, xL=7.3 μm, d=1.9 μm, κR=2.7, and κL=0.26) used in this example, and the particle diameter of the magnetic carrier 12 (rc=90 μm) is 12 μm. Further, since the particle diameter rc of the magnetic carrier 12 is sufficiently larger than the inclination pitch L and the depth d, a contact point of the magnetic carrier 12 approximates the first virtual line L1.

Figure 14:
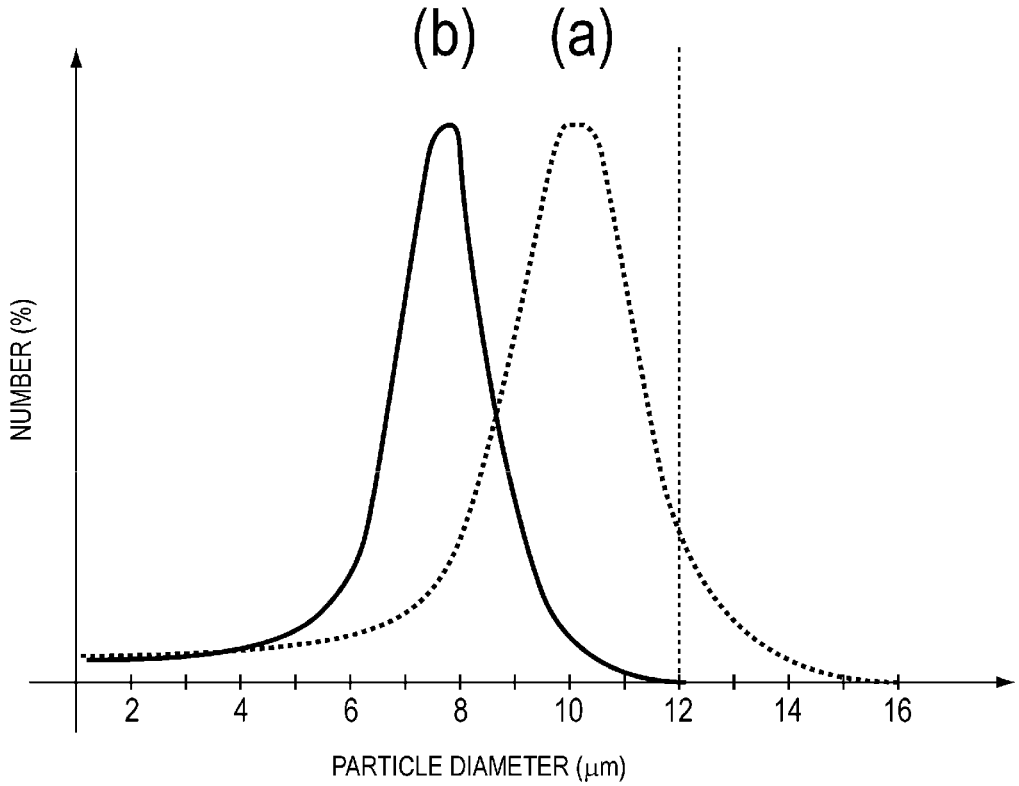
FIG. 14 is a graph illustrating results of a particle size distribution of the toner coated on the concave-convex structure measured by using a positively-charged toner (rt=9.7 μm and average circularity=0.97) obtained by varying manufacturing conditions of the toner (polymerization and classification conditions), and a standard carrier P-01.

FIG. 14 is a graph illustrating results of a particle size distribution of the toner coated on the concave-convex structure measured by using a positively-charged toner (rt=9.7 μm and average circularity=0.97) obtained by varying manufacturing conditions of the toner (polymerization and classification conditions), and the standard carrier P-01. Conditions of the concave-convex structure are set as L=8 μm, xL=7.3 μm, d=1.9 μm, κR=2.7, and κL=0.26.

A dotted line graph (a) is a particle size distribution of the toner 11 put into the developing container 21, and a solid line graph (b) is a particle size distribution of the toner 11 coated on the sleeve 221, after the developer is conveyed on the sleeve 221, and the two-component developer 10 is collected by the collecting portion of the developer to be described below. As illustrated in FIG. 14, it is confirmed that the toner having a larger Rx than 12 μm, which is the geometrically-determined maximum particle diameter of the toner, is not coated on the sleeve 221.

On the other hand, in order to uniformly coat on the sleeve 221 in a thin layer, it may be not necessary to adhere a plurality of toners 11 on the steep inclined surface SR having the concave-convex structure. In order to prevent two or more toners 11 from being adhered, it is necessary that each toner 11 has a certain particle diameter or more with respect to the concave-convex structure. This will be considered using the following FIG. 15A.

Figure 15A:
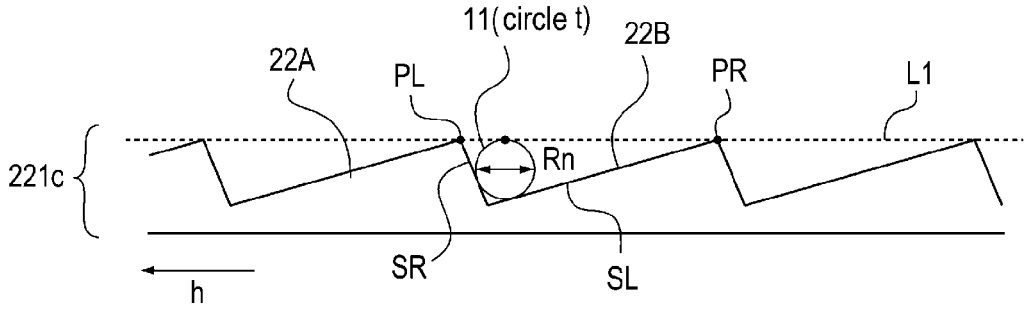
FIGS. 15A, 15B and 15C are cross-sectional views considering a minimum particle diameter of the toner.

FIG. 15A is a schematic view describing a circle corresponding to the toner 11 under the following conditions with respect to the cross-section of the concave-convex structure. In the state of FIG. 15A, the particle diameter of the toner 11 (circle t) in contact with the first virtual line L1 connecting the apexes PL and PR, as well as in contact with the two inclined surfaces, the steep inclined surface SR and the gentle inclined surface SL, formed between the adjacent convexes 22A at multipoints (two points) is set to Rn.

As illustrated in FIG. 15A, if the particle diameter of the toner is Rn or more, it is possible to prevent the plurality of toners from being adhered between the steep inclined surface SR and the gentle inclined surface SL. In other words, if the concave-convex structure is determined, the lower limit (minimum value) of the particle diameter of the toner 11 that can be thinly and uniformly coated on the sleeve 221 is geometrically determined to be Rn.

The Rn which is the minimum particle diameter of the toner geometrically calculated from the concave-convex structure (L=8 μm, xL=7.3 μm, d=1.9 μm, κR=2.7, and κL=0.26) used in this example is 1.7 μm.

From the above description, if the concave-convex structure and the particle diameter rc of the magnetic carrier 12 are determined, the particle diameter rt of the toner 11 that can be thinly and uniformly coated on the sleeve 221 has a relation of Rn≤particle diameter rt of the toner≤Rx, from the Rx and Rn geometrically calculated from FIGS. 13B and 15A.

Herein, this example will be described again with reference to FIG. 8. Thereafter, the two-component developer 10 on the concave-convex rotating member 22 is conveyed to the collecting portion U facing the collecting roller 23. The collecting roller 23 has permanent magnets 232 fixed inside thereof, and a rotatable sleeve 231 formed of a cylindrical non-magnetic metal material.

The sleeve 231 is rotatably provided so as to move in the opposite direction in the collecting portion U facing the concave-convex rotating member 22. The concave-convex rotating member 22 and the collecting roller 23 are in non-contact with each other, and disposed at an interval of 2 mm or less. In this example, a voltage is applied to the collecting roller 23 by the voltage applying portion 26 so as to be equipotential with the concave-convex rotating member 22, but a float may instead be used.

The permanent magnets 222 in the concave-convex rotating member 22 have N and S poles disposed alternately two by two, respectively. Meanwhile, the permanent magnets 232 in the collecting roller 23 have two N poles and one S pole, respectively. Herein, as illustrated in FIG. 8, magnetic poles N22 in the concave-convex rotating member 22 and magnetic poles S23 in the collecting roller 23 are disposed so as to face each other, so that both magnetic poles become different poles from each other in the collecting portion U facing the concave-convex rotating member 22 and the collecting roller 23. Further, the N poles are arranged on the downstream side in the rotation direction i of the collecting roller 23.

The size of the magnetic pole N22 and the magnetic pole S23 are set so that the width of the magnetic pole S23 is narrower than that of the magnetic pole N22, whereby the flux density of the magnetic field formed between the magnetic poles S23 and N22 changes so as to be increased from the concave-convex rotating member 22 toward the collecting roller 23 side. Therefore, the magnetic force acts on the magnetic carrier 12 from the concave-convex rotating member 22 to the collecting roller 23 in the collecting portion U, and the magnetic brush is formed along the magnetic field from the magnetic pole N22 to magnetic pole S23.

In addition, the sleeve 231 of the collecting roller 23 rotates in the rotation direction h of the sleeve 221 having the concave-convex structure, and in the arrow i direction of an opposite direction in the collecting portion U. Therefore, a conveying force directed inward of the developing container 21 from the collecting roller 23 is applied to the developer held by the magnetic force on the surface of the collecting roller 23, by the frictional force between the magnetic force thereof and the collecting roller 23 surface.

The developer carried on the surface of the collecting roller 23 is scraped by a scraper 25 whose one end is held by the developing container 21 in the vicinity of the position in which the N pole of the permanent magnet 232 is arranged, so as to be returned to the developing container 21. The developer returned to the developing container 21 is stirred with the newly replenished developer by the supply member 24, and again supplied to the concave-convex rotating member 22 in the supply portion W. That is, a circulation path in the developing container 21 for the two-component developer 10 containing the magnetic carrier 12 is illustrated by an arrow k in FIG. 8. Meanwhile, the toner which is not collected but is instead thinly and uniformly coated on the sleeve 221 is conveyed to the developing portion T facing the photosensitive drum 1.

Figure 15B:
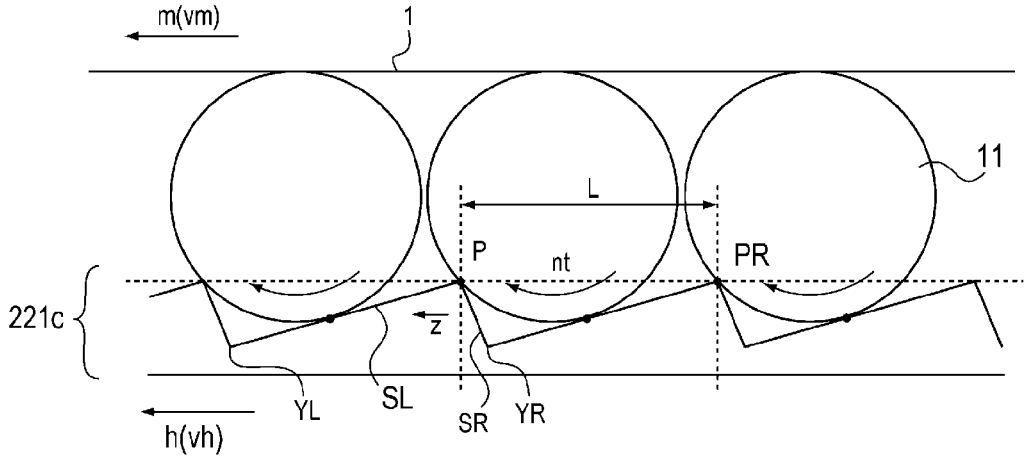

FIG. 15B is a schematic view of the developing portion T. The sleeve 221 and the photosensitive drum 1 are disposed in contact with each other, and an arrow z direction which moves up the steep inclined surface SR then moves down the gentle inclined surface SL against the apex P of the concave-convex structure on the sleeve 221 surface is set to be positive. In this case, the relative velocity of the moving velocity vh (surface velocity) of the sleeve 221 to the moving velocity vm (surface velocity) of the photosensitive drum 1 is set to be positive.

Further, a potential difference is generated between the concave-convex rotating member 22 and the photosensitive drum 1 by the voltage applying portion 26, and the toner 11 provides a force in the direction of the photosensitive drum 1. In this example, the sleeve 221 and the photosensitive drum 1 are in contact with each other so that an entering depth therebetween is about 50 μm, and the moving velocity vh of the sleeve 221 is controlled so that a circumferential velocity ratio thereof becomes to be 1.05 times higher than the moving velocity vm of the photosensitive drum 1.

Further, with respect to the latent image potential (VL=100 V) of the photosensitive drum 1, a DC voltage of +400 V is applied to the concave-convex rotating member 22 by the voltage applying portion 26. By the circumferential velocity ratio, a torque acts on the toner 11 bound on the concave-convex structure to be rotated in the arrow nt direction, and due to the contact point between the sleeve 221 and the toner 11 being decreased, the binding force is reduced. Therefore, it is possible to reliably move the toner 11 bound on the sleeve 221 to the image portion Im (see FIG. 8) on the photosensitive drum 1. In this example, the rotation direction h of the sleeve 221 is the same direction as the arrow z direction which moves up the steep inclined surface SR then moves down the gentle inclined surface SL, but, the reverse direction thereof is the same as described above.

Figure 15C:
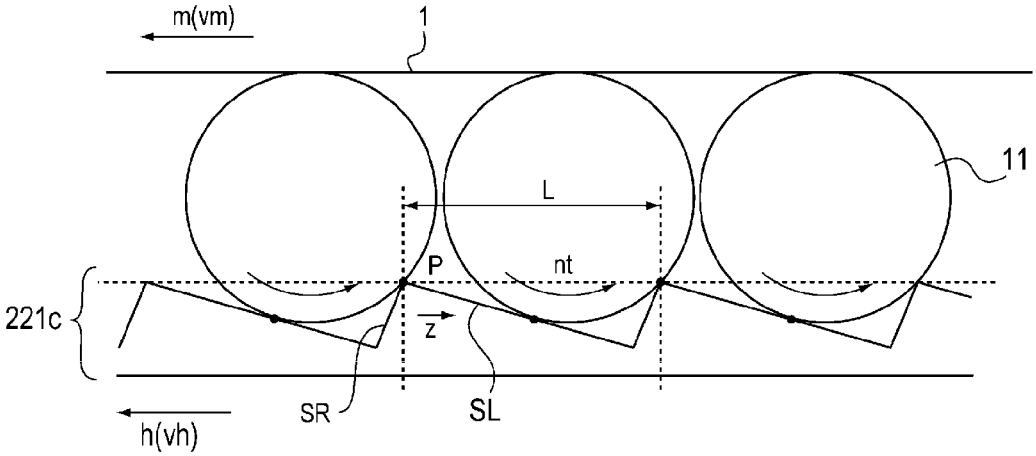

FIG. 15C is a schematic view of the developing portion T when the rotation direction h and the arrow z direction are opposite from each other. When the direction (arrow z direction in FIG. 15C) which moves up the steep inclined surface SR then moves down the gentle inclined surface SL is set to be positive, the case in which the relative velocity of the moving velocity vh of the sleeve 221 to the moving velocity vm of the photosensitive drum 1 is assumed to be positive. In this case, the moving velocity vh of the sleeve 221 will be lower than the moving velocity vm of the photosensitive drum 1. Only in this case, a torque for rotating the toner in the arrow nt direction in FIG. 15C acts on the toner bound on the concave-convex structure, and thereby the toner bound on the sleeve 221 may be moved to the image portion Im on the photosensitive drum 1.

As illustrated in FIG. 15C, when the photosensitive drum 1 has a higher velocity than the sleeve 221, the photosensitive drum 1 overtakes the sleeve 221 at a developing position, so that the toner density transferred to the photosensitive drum 1 is lower than the toner density on the sleeve 221. However, if the velocity of the photosensitive drum 1 is sufficiently close to the velocity of the sleeve 221, it is possible to transfer the toner while maintaining a high toner density being coated on the sleeve 221. Therefore, it is possible to obtain the effect of the invention by the above configuration.

Figure 16A:
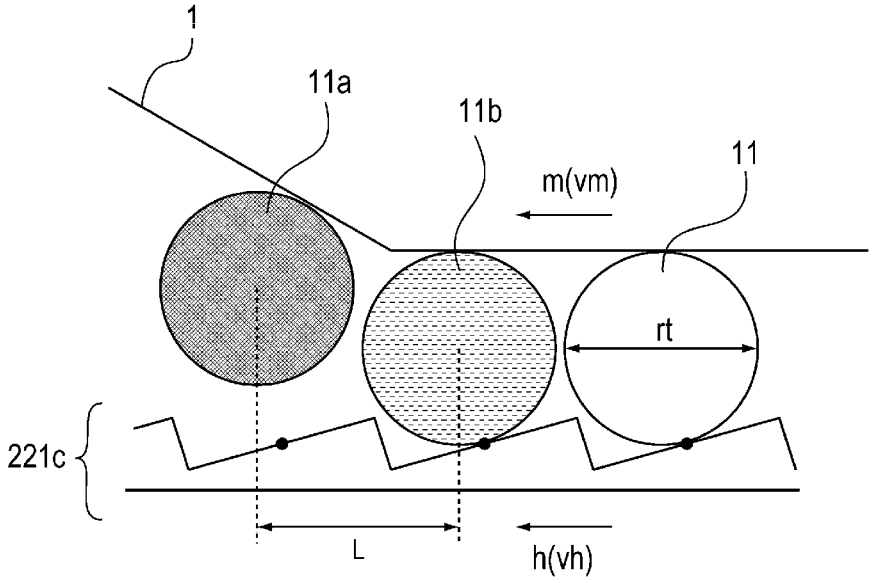
FIGS. 16A and 16B are schematic views illustrating a rear end of a developing portion.
Figure 16B:
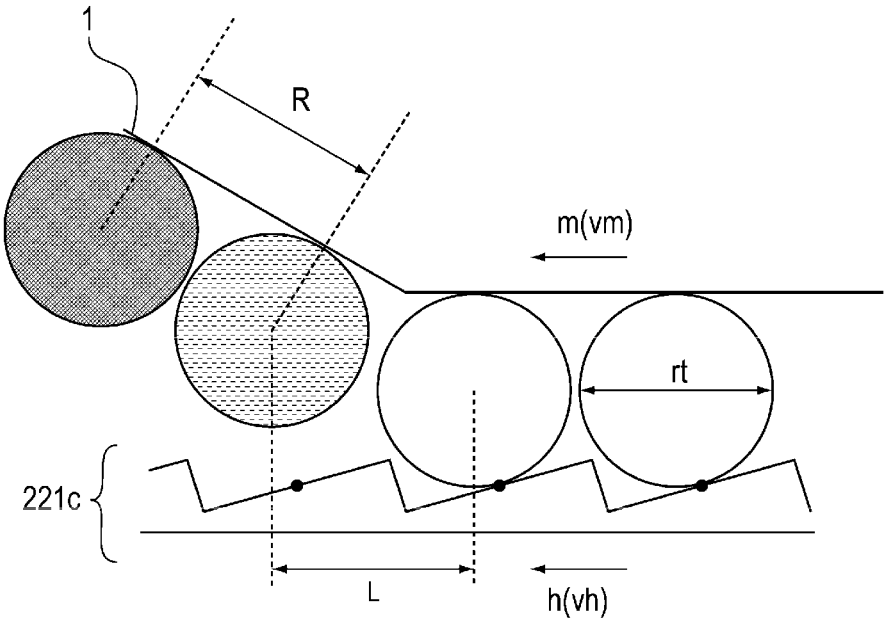

FIG. 16 are schematic views illustrating a rear end of a developing portion T. Specifically, FIG. 16 illustrates a state in which a leading toner 11*a* passes through the rear end of the developing portion T (see FIG. 16A), and a state in which an adjacent toner 11*b* passes through the rear end of the developing portion T after t seconds (see FIG. 16B). By the potential difference applied thereto, the toner is subjected to a force from the sleeve 221 in the direction of the photosensitive drum 1, and the relative velocity of the moving velocity vh of the sleeve 221 to the moving velocity vm of the photosensitive drum 1 in the developing portion T is set to be positive. By this, a torque is applied to the toner, and it is easy to be rotated.

Thereby, the adhesion force of the toner with the sleeve 221 is reduced, so as to be developed on the photosensitive drum 1. In this case, a condition for developing the toner on the photosensitive drum 1 in a high density is that the distance R between the centers of the toners 11*a* and 11*b* to be developed on the photosensitive drum 1 after t seconds is the $r_t$ or less.

The time t taken for the toner 11*a* to move the distance R is calculated by using the following Equation 3.

[Equation 3]

$$t = \frac{R}{v_m} = \frac{r_t}{v_m} \tag{3}$$

Since the toner 11*b* needs to move the distance of the inclination pitch L at time t, a relation shown in the following Equation 4 is obtained.

[Equation 4]

$$v_h t = L \tag{4}$$

From Equations 3 and 4, the velocity ratio vh/vm of the sleeve 221 to the moving velocity vm of the photosensitive drum 1 has a relation shown in the following Equation 5.

[Equation 5]

$$\frac{v_h}{v_m} = \frac{L}{R} = \frac{L}{r_t} \tag{5}$$

In other words, in this example (rt=7.6 μm, and L=8 μm), the velocity ratio vh/vm required for developing the toner on the photosensitive drum 1 in a high density is 1.05 or more.

Table 1 shows results of a developing amount when varying the velocity ratio vh/vm, toner cover ratio on the photosensitive drum 1, and density evaluation after fixing in the development device 20. In addition, each evaluation method will be described below.

TABLE 1

L = 8 μm, xL = 7.3 μm, d = 1.9 μm, κR = 2.7, κL = 0.26, rc = 90 μm, and rt = 7.6 μm, From Equation 4, vh/vm ≥ 1.05

| vh/vm (Times) | 0.95 | 1.0 | 1.05 | 1.2 | 1.4 |
|---|---|---|---|---|---|
| Developing amount (mg/cm$^2$) | 0 | 0.42 | 0.47 | 0.54 | 0.63 |
| Toner cover ratio (%) | 0 | 79 | 88 | 92 | 94 |
| Density evaluation | X | X | ○ | ○ | ○ |

When the relative velocity of the moving velocity vh of the sleeve 221 to the moving velocity vm of the photosensitive drum 1 is negative (vh/vm=0.95, vm=300 mm/s, and vh=286 mm/s), it is not possible to develop the toner from the sleeve 221 to the photosensitive drum 1.

Meanwhile, the relative velocity of the moving velocity vh of the sleeve 221 to the moving velocity vm of the photosensitive drum 1 is positive, and the velocity ratio vh/vm satisfying Equation 5 is set to 1.05. In this case, it is possible to develop the toner 11 on the photosensitive drum 1 in a high density with a small toner amount, and achieve a desired density. Further, when developing the toner 11 in a multi-layer, the circumferential velocity ratio may be set by multiplying the circumferential velocity ratio (1.05) by the number of the desired toner layers.

Also, the relative velocity of the moving velocity vm of the photosensitive drum 1 and the moving velocity vh of the sleeve 221 will be further described. In FIG. 16, when the moving velocity of the photosensitive drum 1 is higher than the moving velocity of the sleeve 221, gaps may be easily generated on the surface of the photosensitive drum 1 by the toners moving from the sleeve 221 to the photosensitive drum 1.

However, in FIG. 16, when the moving velocity of the sleeve 221 is higher than the moving velocity of the photosensitive drum 1, since the toner is sent from the sleeve 221 in rapid succession, the toners moving from the sleeve 221 to the photosensitive drum 1 are densely developed on the surface of the photosensitive drum 1.

Table 2 shows the results of the developing amount when varying the velocity ratio vh/vm, toner cover ratio on the photosensitive drum 1, and density evaluation after fixing, by using toners having different particle diameters rt from each other.

TABLE 2

L = 8 μm, xL = 7.3 μm, d = 1.9 μm, κR = 2.7, κL = 0.26, rc = 90 μm, and rt = 6.0 μm, From Equation 4, vh/vm ≥ 1.33

| vh/vm (Times) | 1.10 | 1.20 | 1.33 | 1.40 | 1.50 |
|---|---|---|---|---|---|
| Developing amount (mg/cm$^2$) | 0.31 | 0.34 | 0.38 | 0.40 | 0.43 |
| Toner cover ratio (%) | 73 | 79 | 89 | 92 | 94 |
| Density evaluation | X | X | ○ | ○ | ○ |

If the velocity ratio vh/vm satisfying Equation 5 is set to 1.33, it is possible to develop the toner 11 on the photosensitive drum 1 in a high density with a small toner amount, and achieve a desired density. Further, when developing the toner 11 in a multi-layer, the circumferential velocity ratio may be set by multiplying the circumferential velocity ratio (1.33) by the number of the desired toner layers.

Furthermore, a relational equation of the velocity ratio vh/vm required for developing the toner in a high density is divided into the cases as described below, and is dependent on the inclination pitch L and the particle diameter rt of the toner. In addition, when setting the particle diameter $r_t$ of the toner, an inclination pitch L which is an interval between the convexes 22A, a distance R between the centers of the toners 11 carried on the surface of the photosensitive drum 1, and natural numbers n and m, and a relation thereof is set to n+1<(L/rt)≤n+2, and m−1<(rt/L)≤m, the velocity ratio vh/vm of the moving velocity vh of the surface of the concave-convex rotating member 22 and the moving velocity vm of the surface of the photosensitive drum 1 is derived from the following conditions.

(*A*) $r_t \le L < 2r_t$

[Equation 6]

$$\frac{v_h}{v_m} \ge \frac{L}{R} = \frac{L}{r_t} \tag{6}$$

(*B*) $2r_t \le L$

[Equation 7]

$$\frac{v_h}{v_m} \ge \frac{L - nr_t}{R} = \frac{L - nr_t}{r_t} \tag{7}$$

(*C*) $r_t > L$

-continued

[Equation 8]

$$\frac{v_h}{v_m} \geq \frac{L}{R} = \frac{mL}{r_t} \quad (8)$$

FIG. 17 is schematic views illustrating the rear end of the developing portion T when the inclination pitch L is two times or more of the particle diameter rt of the toner (that is, in the case of the above-described (B)). For a better understanding as depicted in the drawings, there are toners which are not in contact with the photosensitive drum 1, however, in reality, since the toners are in contact with a sufficient entering depth (50 μm), almost all the toners are in contact with each other.

Figure 17A:
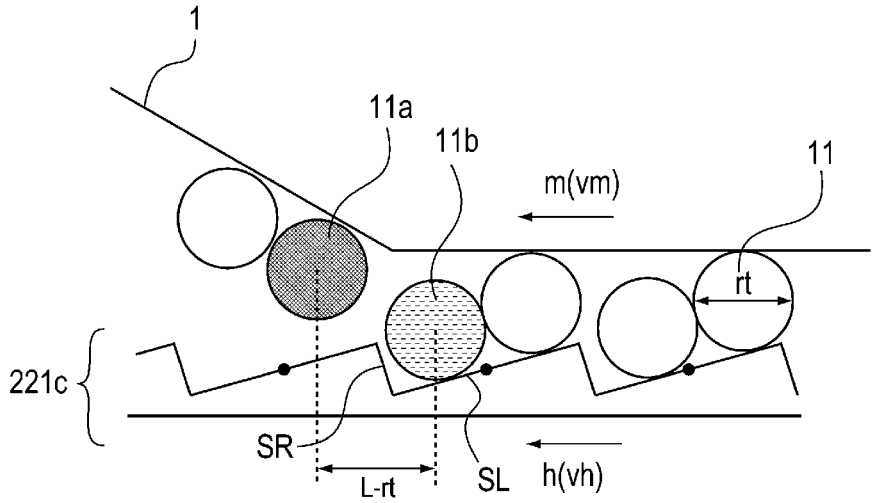
FIGS. 17A and 17B are schematic views illustrating the rear end of the developing portion when an inclination pitch L is two times or more of the particle diameter rt of the toner.
Figure 17B:
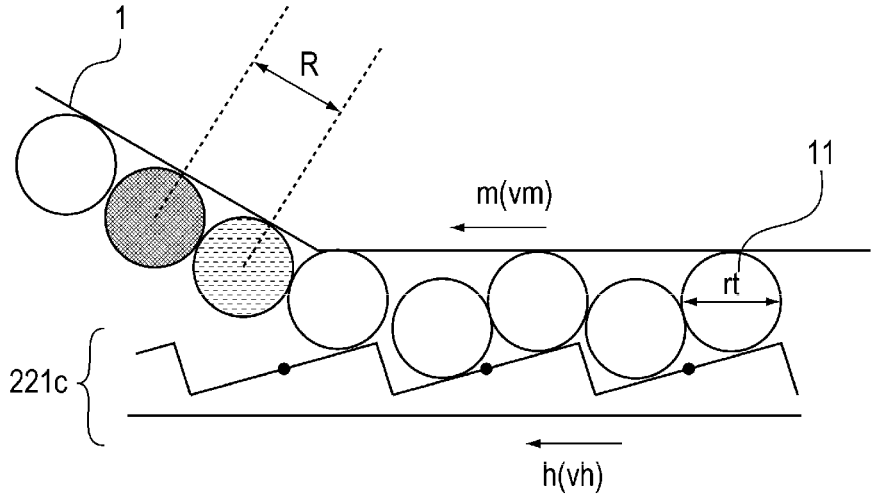

FIG. 17 illustrates a state in which the toner 11*a* passes through a rear end of a contact portion (see FIG. 17A), and a state in which the adjacent toner 11*b* passes through the rear end of the contact portion after t seconds (FIG. 17B). A condition for developing the toner on the photosensitive drum 1 in a high density is that the toner 11*b* moves a distance ($L-nr_t$) during when the toner 11*a* moves the distance R after t seconds, and is obtained by Equation 7.

Herein, the natural number n is determined by Equation 9.

[Equation 9]

$$n+1<(L/rt)\leq n+2 \quad (9)$$

Figure 18A:
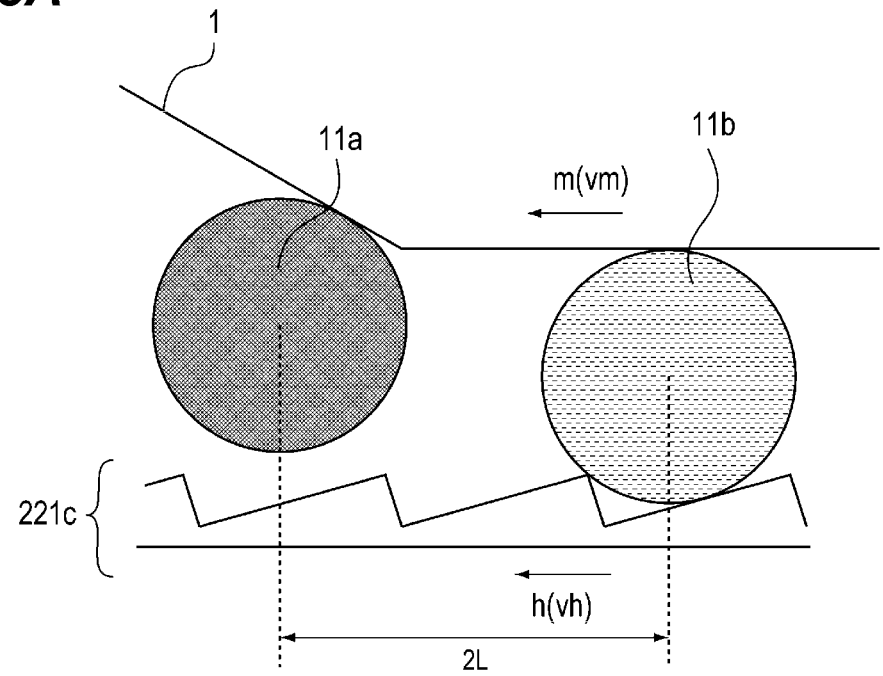
FIGS. 18A and 18B are schematic views illustrating the rear end of the developing portion when the inclination pitch is smaller than the particle diameter of the toner.
Figure 18B:
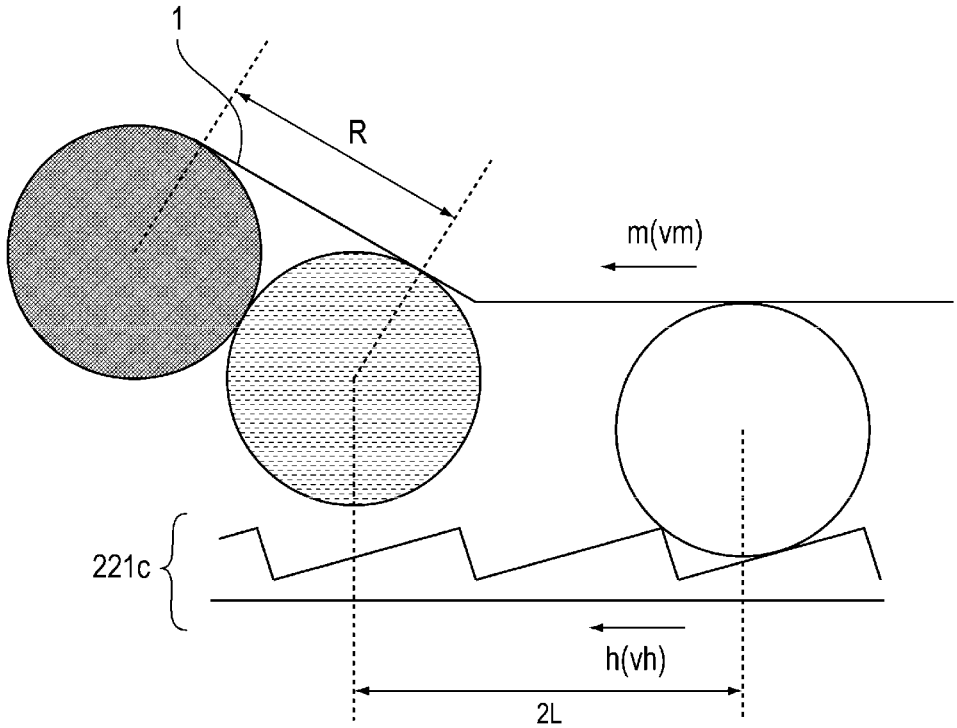

FIG. 18 is schematic views illustrating the rear end of the developing portion T when the inclination pitch L is smaller than the particle diameter rt of the toner (that is, the case of the above-described (C)). FIG. 18 illustrates a state in which the toner 11*a* passes through a rear end of the contact portion (see FIG. 18A), and a state in which the adjacent toner 11*b* passes through the rear end of the contact portion after t seconds (FIG. 18B). A condition for developing the toner on the photosensitive drum 1 in a high density is that the toner 11*b* moves a distance mL during when the toner 11*a* moves the distance R after t seconds, and is obtained by Equation 8.

Herein, the natural number m is determined by Equation 10.

[Equation 10]

$$m-1<(rt/L)\leq m \quad (10)$$

Tables 3 and 4 show results of the developing amount when developing the toner 11 on the photosensitive drum 1, the toner cover ratio on the photosensitive drum 1, the density evaluation after fixing, and image uniformity evaluation, which are obtained by the development device 20 of this example and the HV development device of the comparative example.

TABLE 3

L = 8 μm, xL = 7.3 μm, d = 1.9 μm, κR = 2.7, κL = 0.26, rc = 90 μm, rt = 7.6 μm, and vh/vm = 1.05

| | Developing amount (mg/cm$^2$) | Toner cover ratio (%) | Density evaluation | Image uniformity evaluation |
|---|---|---|---|---|
| Development device of present embodiment | 0.47 | 88 | ○ | ○ |
| HV development device | 0.47 | 76 | X | X |

In the development device 20 according to this example, it is possible to develop a high density toner image on the photosensitive drum 1 with a small toner amount, whereas in the HV development device, even though the toner amount is controlled so as to be the same developing amount as the development device 20, the toner density is low, and a plurality of second-layered toner is present.

TABLE 4

L = 8 μm, xL = 7.3 μm, d = 1.9 μm, κR = 2.7, κL = 0.26, rc = 90 μm, rt = 6.0 μm, and vh/vm = 1.33

| | Developing amount (mg/cm$^2$) | Toner cover ratio (%) | Density evaluation | Image uniformity evaluation |
|---|---|---|---|---|
| Development device of present embodiment | 0.38 | 89 | ○ | ○ |
| HV development device | 0.38 | 77 | X | X |

Figure 19:
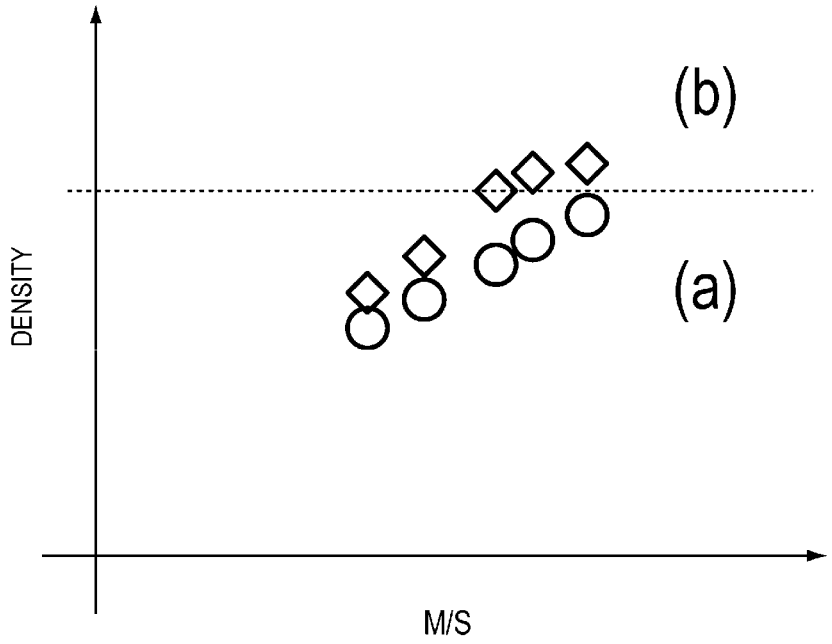
FIG. 19 is a graph illustrating results of a density after fixing relative to a toner amount M/S (mg/cm$^2$) on a sheet when using a toner having a particle diameter of 6 μm (Tables 2 and 4).

FIG. 19 is a graph illustrating results of a density after fixing relative to a toner amount M/S (mg/cm$^2$) on a sheet when using a toner having a particle diameter of 6 μm (Tables 2 and 4). In the HV development device (see graph (a) in FIG. 19), due to the influence of the white background portion over which the toner is not present, the image density is significantly reduced, and it is not possible to achieve a desired density with a small toner amount.

On the other hand, since the development device (see the graph (b) in FIG. 19B) can develop a high-density toner image, it is possible to achieve the desired image density with a small toner amount. Moreover, since the development apparatus has small density unevenness in a height direction of the toner image, the image uniformity is within an acceptable level, whereas the HV development device has large density unevenness in a height direction of the toner image, and the image uniformity has not reached the acceptable level.

Table 5 shows results of developing amount when using the positively-charged toner obtained by varying the manufacturing conditions of the toner (polymerization and classification conditions) and the standard carrier P-01, toner cover ratio on the photosensitive drum 1, and the density evaluation after fixing, in the development device according to this example.

TABLE 5

L = 8 μm, xL = 7.3 μm, d = 1.9 μm, κR = 2.7, κL = 0.26, and rc = 90 μm

| | Toner A | Toner B | Toner C | Toner D | Toner E |
|---|---|---|---|---|---|
| rt (μm) | 7.6 | 12 | 15 | 1.7 | 1.0 |
| rt10 (μm) | 4.2 | 4.7 | 4.7 | 0.81 | 0.35 |
| rt90 (μm) | 9.4 | 14 | 17 | 2.5 | 1.8 |
| vh/vm | 1.05 | 1.33 | 1.07 | 1.71 | 2.00 |
| Developing amount (mg/cm$^2$) | 0.47 | 0.73 | 0.81 | 0.10 | 0.63 |
| Toner cover ratio (%) | 88 | 83 | 78 | 89 | 85 |
| Density evaluation | ○ | ○ | X | ○ | ○ |
| Image uniformity evaluation | ○ | ○ | X | ○ | X |

The desired images are obtained by toners A, B and D, whereas not obtained by the toners C and E. Since the toner C has an Rx which is the geometrically-calculated maximum particle diameter of the toner exceeding 12 μm, it is not possible to uniformly coat the toner on the sleeve 221. Therefore, the toner does not completely cover the surface of the photosensitive drum 1 resulting in only a partial exposure over a large region. When the toner is transferred onto the sheet, due to the influence of the white background portion over which the toner is not present, the image density is significantly reduced. In addition, image uniformity is deteriorated by the density unevenness.

Since the toner E has an Rn which is the geometrically-calculated minimum particle diameter of the toner being less than 1.7 μm, the toner is coated on the sleeve 221 in a multi-layer. In addition, the contact of the toner with the photosensitive drum 1 is reduced during developing, and a toner that cannot be developed occurs. Therefore, unevenness in the toner height on the photosensitive drum 1 occurs, and image uniformity is deteriorated.

According to the configuration of Example 1, it is possible to achieve the object of the present invention. In addition, the particle diameter rt of the toner may be within a range (Rn≤rt≤Rx) which is geometrically determined by the concave-convex structure and the particle diameter rc of the magnetic carrier. Further, for the non-magnetic toner, the particle diameter of 10% in the cumulative particle size distribution is Rn or more, and the particle diameter of 90% in the cumulative particle size distribution is Rx or less, preferably.

That is, the particle diameter of the toner is preferably Rn≤rt10≤rt90≤Rx. Thereby, it is possible to reduce negative effects that fine or coarse powders not developed on the photosensitive drum 1 are accumulated in the developing container 21, the charge stability is reduced or the like. Herein, rt10 is a particle diameter of 10% in the cumulative distribution, and rt90 is a particle diameter of 90% in the cumulative distribution.

Figure 20A:
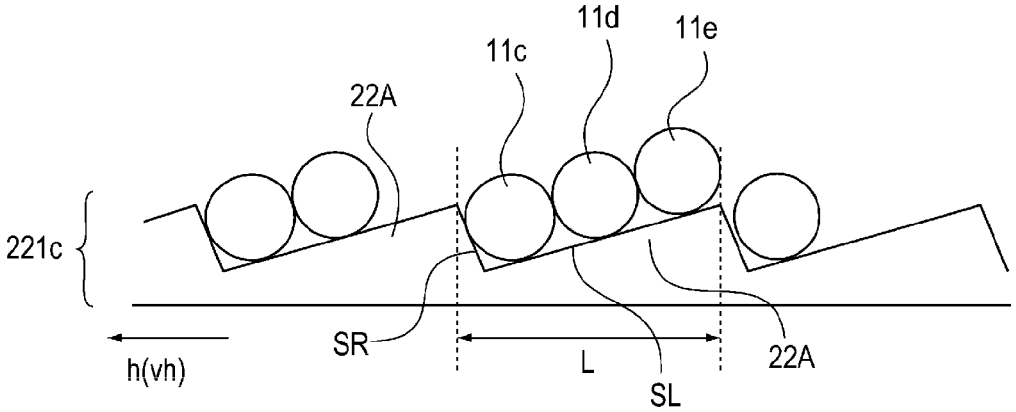
FIGS. 20A and 20B are schematic views illustrating a sleeve in which the inclination pitch is three times the particle diameter of the toner.

FIG. 20A is a schematic view illustrating the sleeve 221 in which the inclination pitch L is three times the particle diameter of the toner 11. As illustrated in FIG. 20A, the toner 11*c* which can come into multipoint contact with the steep inclined surface SR and the gentle inclined surface SL is bound on the sleeve 221. On the other hand, the toners 11*d* and 11*e* positioned above the toner 11*a* are in one point contact, and easy to be scraped from the magnetic carrier as they move upward. Therefore, the stability of the coating amount is decreased, and thereby, the stability of the developing amount is reduced. To avoid this, the number of toners to be bound by one pitch is limited.

The inclination pitch L of the concave-convex structure corresponds to the gap between the plurality of convexes 22A which are adjacent to each other in the rotation direction h, and may be less than three times the particle diameter rt of the toner, further preferably, is less than two times the particle diameter rt of the toner. Specifically, by limiting the inclination pitch L to two or less, further preferably, to one, variation in the coating amount between pitches may be suppressed, and the coating amount, and the stability of the developing amount may be improved.

Figure 20B:
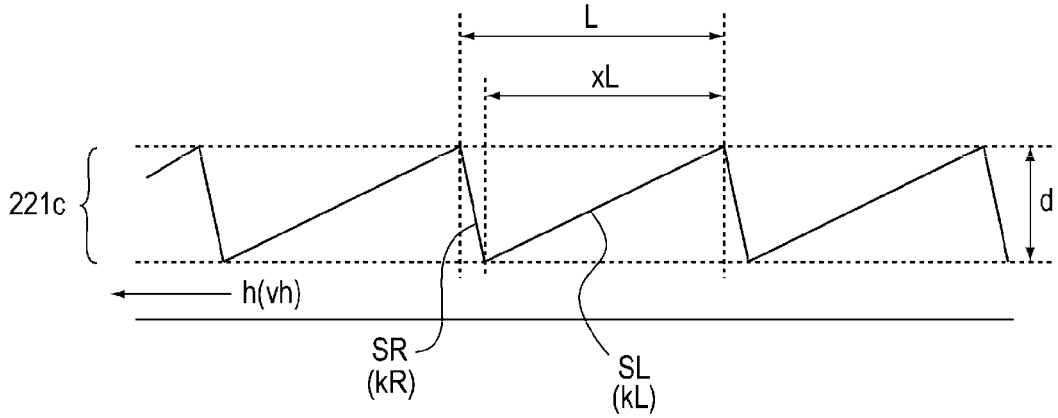

FIG. 20B is a cross-sectional view illustrating the dimensions of the concave-convex structure. In the concavo-convex structure, by varying the depth d and width xL thereof, the inclination κR and κL are controlled.

Table 6 shows the evaluation results when varying the structural shape on the sleeve 221 in the development device according to this example. In addition, a maximum inclination angle |κL| of the gentle inclined surface SL of the convex 22A of the concave-convex structure is 0.5 or less, and a maximum inclination angle |κR| of the steep inclined surface SR of the convex 22A is 1.0 or more, preferably.

TABLE 6

Toner A (rt = 7.6 μm) and standard carrier P-01 (rc = 90 μm)

| | Structure A | Structure B | Structure C | Structure D | Structure E |
|---|---|---|---|---|---|
| L (μm) | 8.0 | 8.0 | 8.0 | 8.0 | 8.0 |
| xL (μm) | 7.3 | 7.3 | 7.3 | 6.0 | 5.0 |
| d (μm) | 1.9 | 3.7 | 5.0 | 2.0 | 2.0 |
| κR | 2.7 | 5.3 | 7.1 | 1.0 | 0.67 |
| κL | 0.26 | 0.50 | 0.68 | 0.33 | 0.40 |
| Density evaluation | ○ | ○ | X | ○ | X |

In structures A, B and C, only structure C was not achieved to the desired density. It is caused by that, while sufficient toner amount is coated on the sleeve 221 of structure C, the toner on the sleeve 221 is difficult to develop on the photosensitive drum 1. It is possible to consider that, in structure C, due to the maximum inclination |κL| of the gentle inclined surface SL being greater than 0.5, even though the toner on the sleeve 221 is provided with a prescribed circumferential velocity ratio, it is not possible to rotationally move on the gentle inclined surface SL, and it is difficult to develop on the photosensitive drum 1. From the above description, the maximum inclination |κL| of the gentle inclined surface SL of the concave-convex structure is preferably 0.5 or less.

Meanwhile, in structures D and E, only structure E did not reach the desired density. It is caused by that, the |κL| of structures D and E is 0.5 or less, respectively, and almost all the toner on the sleeve 221 can be developed on the photosensitive drum 1, but a sufficient toner amount is not coated on the sleeve 221 of structure E. It is possible to consider that the maximum inclination |κR| of the steep inclined surface SR is less than 1.0, and thereby, it is difficult to be bound on the sleeve 221.

From the above description, the maximum inclination |κR| of the steep inclined surface SR is preferably 1.0 or more. If the electrostatic adhesion force at the contact point between the toner 11 and the sleeve 221 is large, the toner is easy to be bound on the sleeve 221, and the stability of the coating amount is improved. Further, during the conveying process of the developer, it is not necessary to excessively increase the contact frequency and friction of the toner with the sleeve 221, and it is possible to suppress the deterioration of the developer.

For this purpose, an electrification series (electrification columns) of the surface of the sleeve 221 of the concave-convex rotating member 22, the magnetic carrier 12, and the non-magnetic toner 11 may be defined so that the magnetic carrier 12 is arranged between the toner 11 and the surface (coating layers 221*c*) of the sleeve 221 of the concave-convex rotating member 22. Under this condition, a difference in the electrification series between the surface material of the toner 11 and the sleeve 221 is greater than the difference in the electrification series between the toner 11 and the magnetic carrier 12.

Therefore, when the toner 11 and the sleeve 221 is in contact and frictionally charged, compared to the electrostatic adhesion force of the toner 11 and the magnetic carrier 12, a strong electrostatic adhesion force is generated, and the toner 11 is easy to be separated from the magnetic carrier 12 and then adhered to the sleeve 221. In addition, a method for determining the electrification series will be described below.

<Method of Forming a Concave-Convex Structure>

The concave-convex structure on the sleeve 221 may be formed by a photo nanoimprint process using a photo-curable resin, a thermal nanoimprint process using a thermoplastic resin, a laser edging process performing edging by scanning with a laser or the like. Alternately, the concave-convex structure on the sleeve 221 may be formed by a diamond edging process of mechanically grinding by a diamond blade, and further, replication by an electroforming technique from a molding thereof or the like.

Figure 21A:
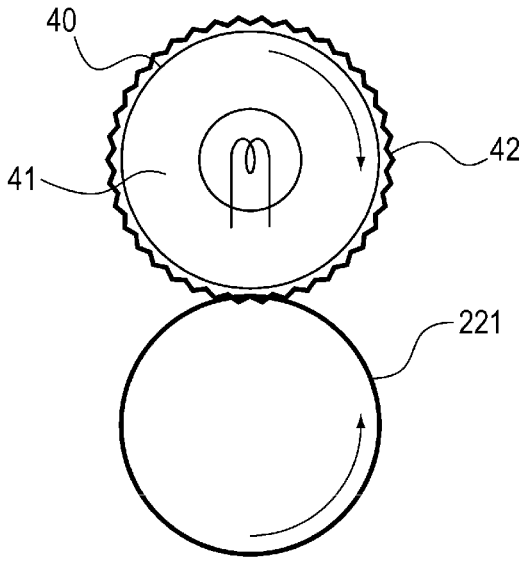
FIGS. 21A and 21B are schematic views illustrating a method of forming a concave-convex structure by a thermal nanoimprint process.

FIG. 21A is a schematic view illustrating a method of forming a concave-convex structure by the thermal nanoimprint process. In the thermal nanoimprint process, a film mold 42 having a structure of a shape opposite to a desired concave-convex structure is fixed on a transferring roller 40 including a halogen heater 41 therein, and then contacted and pressed to the sleeve 221. While rotating the transferring roller 40 and the sleeve 221 at a constant velocity, the film mold 42 is heated by the halogen heater to within a range of a melting point from the glass transition temperature, to form a concave-convex structure on the sleeve 221.

As described above, in this case, the concave-convex structure may be directly formed in the elastic layer 221*b* in the sleeve 221, or may be formed in the coating layer 221*c* by previously applying the coating layer 221*c* made of a thermoplastic resin on the elastic layer 221*b*. In the photo nanoimprint process, the photo-curable resin is applied to the surface of the sleeve 221, and UV irradiated by a UV light source installed in place of the halogen heater, to form the concave-convex structure.

The sleeve 221 used in this example is formed by the photo nanoimprint process, and several nm of a primer layer is provided on the elastic layer 221*b* having a thickness of 2 mm in order to increase adhesion, and a fluorine photo-curable resin of several μm is applied thereon, to form the concave-convex structure.

Figure 21B:
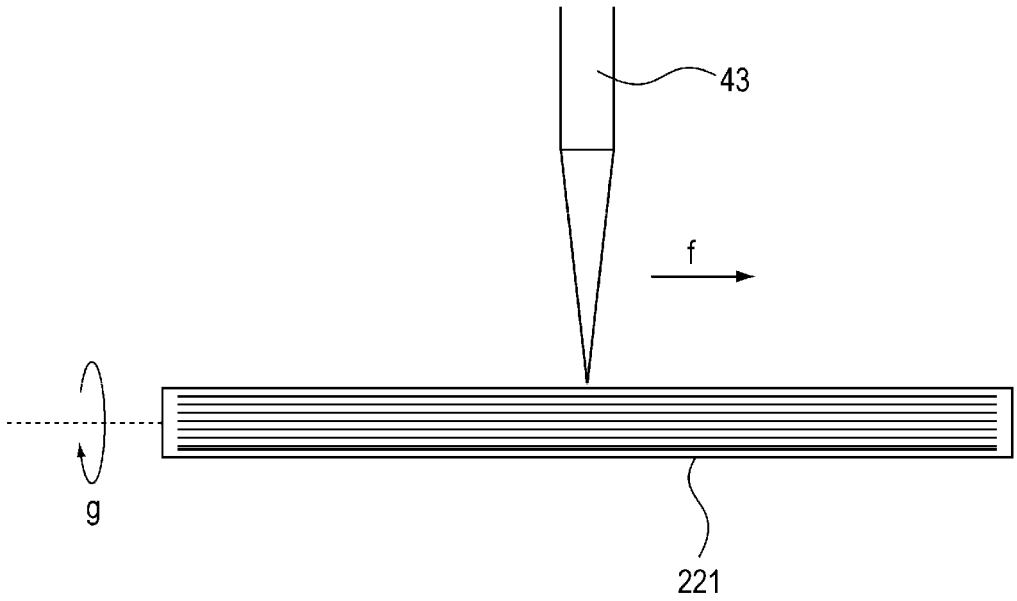

FIG. 21B is a schematic view illustrating a method of forming a concave-convex structure using a diamond edging process. This process includes scanning a needle 43 having a diamond blade whose tip is formed in a saw shape to the sleeve 221 in an arrow f direction, and mechanically chipping away the surface of the sleeve 221, to form the concave-convex structure. The process further includes slightly rotating the sleeve 221 in an arrow g direction, scanning again the needle 43 in an arrow f direction, and repeating this process, to form the concave-convex structure.

<Method of Determining a Concave-Convex Structure>

Determination of the concave-convex structure on the sleeve 221 is performed by using an atomic force microscope (AFM) (Nano-I made by Pacific Nanotechnology Inc.) and measurement is performed according to the operation manual of the measuring device. The method of determining a concave-convex structure will be described below.

Figure 22:
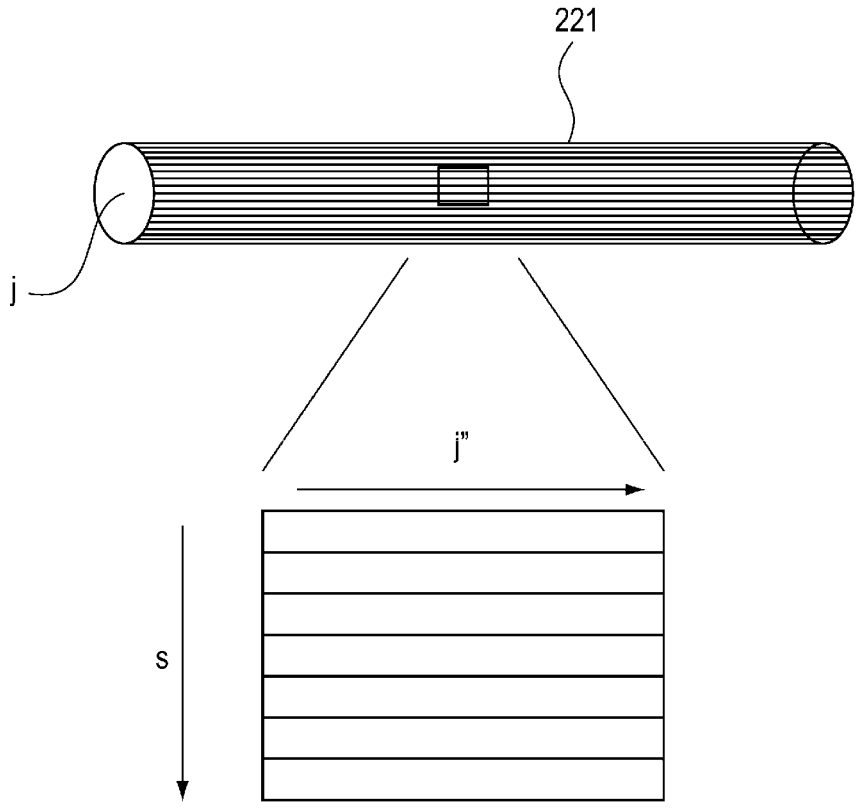
FIG. 22 is a schematic view describing a sampling.

FIG. 22 is a schematic view describing a sampling. For sampling, the surface of the sleeve 221 at the center portion thereof is cut by a cutter or laser etc., to be processed in a smooth sheet shape. Measuring using AFM is performed by scanning the surface of the sleeve 221 in an arrow s direction in FIG. 22 which is a direction perpendicular to a horizontal direction j" of an axis j of the sleeve 221. In addition, it may be possible to directly measure the surface of the sleeve 221, and then perform a cylindrical correction.

Figure 23:
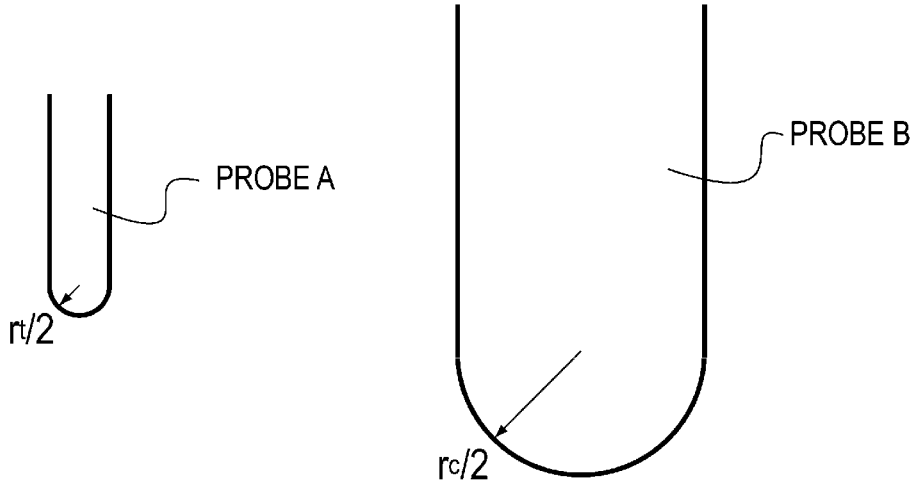
FIG. 23 is schematic views illustrating a tip shape of two types of a cantilever (probe) used in a measurement using AFM.

FIG. 23 is a schematic view illustrating a tip shape of two types of a cantilever (probe) used in the measurement using AFM. A probe A is a hemispherical probe having a tip corresponding to the particle diameter $r_t$ of the toner (see FIG. 23A), and a probe B is a hemispherical probe having a tip corresponding to the particle diameter $r_c$ of the magnetic carrier (see FIG. 23B).

Figure 24A:
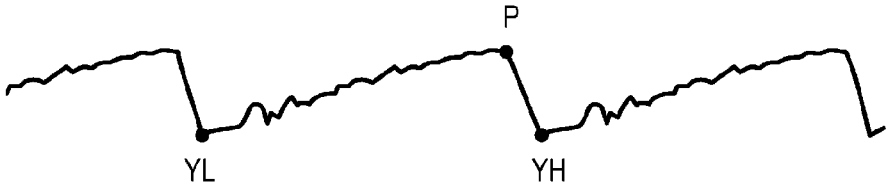
FIGS. 24A and 24B are views illustrating an example of a structure shape obtained by a measurement method of the concave-convex structure to be described below.
Figure 24B:
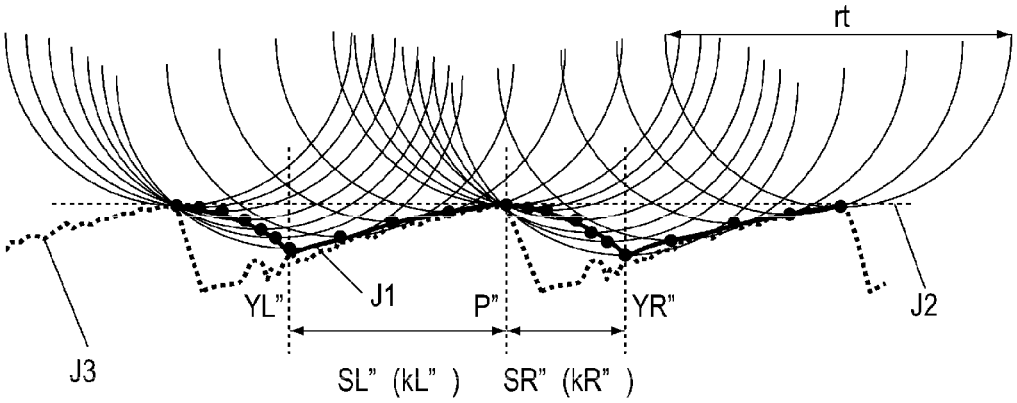

FIG. 24A is a view illustrating an example of a structural shape obtained by the method of measuring the concave-convex structure to be described below. FIG. 24B is a graph of shapes measured by the probes A and B. In FIG. 24B, a graph J1 illustrates a shape J1 (a solid line with a plurality of black dot plots) of the concave-convex structures measured using the AFM by the probe A. In FIG. 24B, a graph J2 illustrates a shape J2 (a dotted line corresponding to the horizontal line) of the concave-convex structure measured using the AFM by the probe B. Herein, tip positions of the probes A and B are measured in a scanning direction. In FIG. 24B, a graph J3 illustrates the concave-convex structure of the concave-convex rotating member 22 in FIG. 24A.

In this case, for a tip diameter $r_t$ of the probe, measurement is performed by sufficiently securing a resolution in the scanning direction. Specifically, it is preferably 1/10 or less of the tip diameter $r_t$. The measuring method includes taking a difference in the obtained shape (position of the graph J2−position of the graph J1), further taking a derivation thereof, determining an apex P", and determining bottom points YL" and YR" which are positioned on the left and right of the apex P", respectively. When the convex 22A between the YL" and YR" is formed in a unit structure, maximum inclinations κL" and κR" of the gentle inclined surface SL" (P" YL") and the steep inclined surface SR" (P" YR"), which are positioned on the left and right of the apex P" of the convex 22A, respectively, are calculated.

Figure 25A:
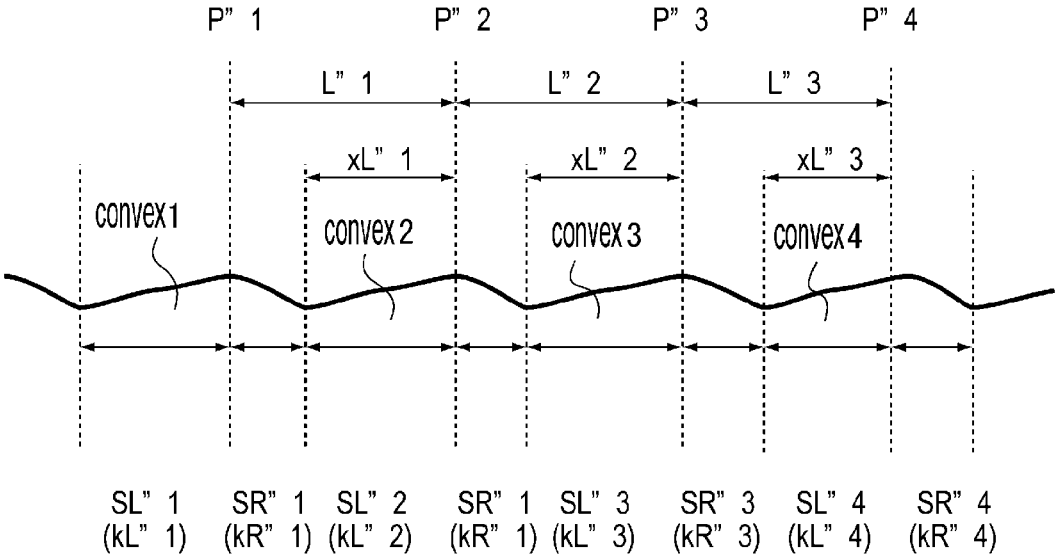
FIGS. 25A and 25B are views illustrating a difference (b−a) in shapes (a and b) measured by a method of measuring a structure in which convexes are arranged.

FIG. 25A is a view illustrating a difference (J2−J1) in the shapes (J1 and J2) measured by a method of measuring a structure in which the convexes 22A are arranged. Whether the structure is a concave-convex structure is determined by the following criteria for determining.

Condition 1 . . . The maximum inclinations κLn" and κRn" of the gentle inclined surface SLn" and the steep inclined surface SRn" of the adjacent ten convex n structures (convex 1 to convex 10) of the convex n structures formed of the apex P"n and the left and right bottom points satisfy |κLn"|<|κRn"|. Further, it may be a condition that an average value of the maximum inclinations κLn" and κRn" of the gentle inclined surface SLn" and the steep inclined surface SRn" of the predetermined number (for example, ten) of convex n structures which are adjacent to each other in the rotation direction h satisfies Σ (|κLn"|/n)<Σ(|κRn"|/n).

Condition 2 . . . An L"n (L"1 to L"10) of a distance between the adjacent apexes satisfies Equation 11, and a ratio (xL"1/L"1 to xL"10/L"10) of a width xL"n of the gentle inclined surface SL" to the L"n of the distance between the adjacent apexes satisfies Equation 12:

[Equation 11]

$$\left|L''n - \frac{1}{n}\sum_n L''n\right| \leq \frac{0.1}{n}\sum_n L''n \tag{11}$$

[Equation 12]

$$\left|\frac{xL''n}{L''n} - \frac{1}{n}\sum_n \frac{xL''n}{L''n}\right| \leq \frac{0.1}{n}\sum_n \frac{xL''n}{L''n} \tag{12}$$

Herein, Equation 11 will be described. For example, a case of measuring the distance between the apexes by five points will be illustrated. Wherein, when being set as L"n1=7.8 μm, L" n2=8.2 μm, L"n3=7.5 μm, L" n4=8.5 μm, and L"n5=8.0 μm, a right side, since it is 10% of the average value of L"1 to L"5, becomes 0.8 μm. In a left side, for example, if subtracting the average value of L"1 to L"5 from L"1, the absolute value becomes 0.2 μm. For these reasons, an error in a particular pitch width of the distance between the apexes is within the error range of the average pitch width of the distance between the apexes.

In addition, when measuring the distance between the apexes by five points, when being set as L"n1=9.0 μm, L"n2=7.0 μm, L"n3=10.0 μm, L"n4=6.0 μm, and L"n5=8.0 μm, the right side, since it is 10% of the average value of L"1 to L"5, becomes 0.8 μm. In a left side, for example, if subtracting the average value of L"1 to L"5 from L"1, the absolute value becomes 1.0 μm. For these reasons, the error in the particular pitch width of the distance between the apexes is not within the error range of the average pitch width of the distance between the apexes.

For these reasons, the above-described Equation 11 or 12 mean that the error in the distance between the apexes, and an error in gentle inclined surface width to the distance between the apexes are within 10%. Thus, the concave-convex structure has the concaves 22B and the convexes 22A with a predetermined regularity in the rotation direction h, respectively.

A structure that satisfies the above conditions 1 and 2 is a concave-convex structure in which the convexes 22A having different inclination angles are regularly arranged, and it is determined to be a concave-convex structure according to the present invention. In addition, for a microstructure that the probe A cannot follow, a structure with a short pitch, and a structure with a long pitch that the probe B can enter, even though such structures are included, if there is the concave-convex structure according to the present invention, it is possible to obtain the effect of the present invention. Therefore, the sleeve 221 may include the above-described structure on the surface thereof.

<Method of Measuring a Concave-Convex Structure and Method of Defining a Particle Diameter of the Toner>

When the concave-convex structure is determined by the method of determining a concavo-convex structure, a method of measuring a concave-convex structure and method of defining a particle diameter of the toner will be described. For measuring, the sample used in the determination method is subject to measurement according to an operation manual of the measuring device using a non-contact surface and layer cross-sectional shape measurement system R5200 (manufactured by Ryoka Systems Inc.).

Figure 25B:
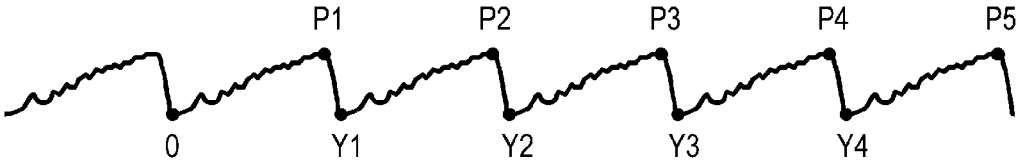

FIG. 25B is a view illustrating a shape obtained by the measurement. In this case, the measurement direction is, similar to the AFM measurement, a direction perpendicular to the horizontal axis j" of the axis j of the sleeve 221, and the measurement range is set to 10 times or more of the average distance between the apexes (1/nΣL"n) obtained by the AFM measurement. In this regard, the lowest point in the measurement range is set to an origin O, the highest point from the origin O to the average distance between the apexes is P1, the lowest point of from the P1 to the average distance between the apexes is Y1, and the highest point from the Y1 to the average distance between the apexes is P2, and then, this process is repeated, so as to determine from P1 to P11. Next, the average shape between adjacent apexes P (P1 to P2, P2 to P3 and P10 to P11) is calculated.

Figure 26A:
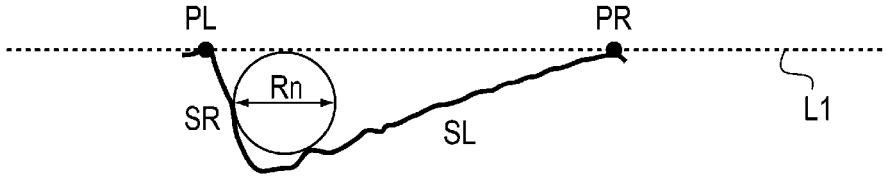
FIGS. 26A and 26B are views illustrating an average shape between apexes P in FIG. 25B.

FIG. 26A is a view illustrating an average shape between apexes P in FIG. 25B. In this case, a first virtual line L1 connecting between the apexes (PL and PR) and the diameter of a circle in contact with the steep and gentle inclined surfaces SR and SL are set to Rn which is the minimum particle diameter of the toner.

Figure 26B:
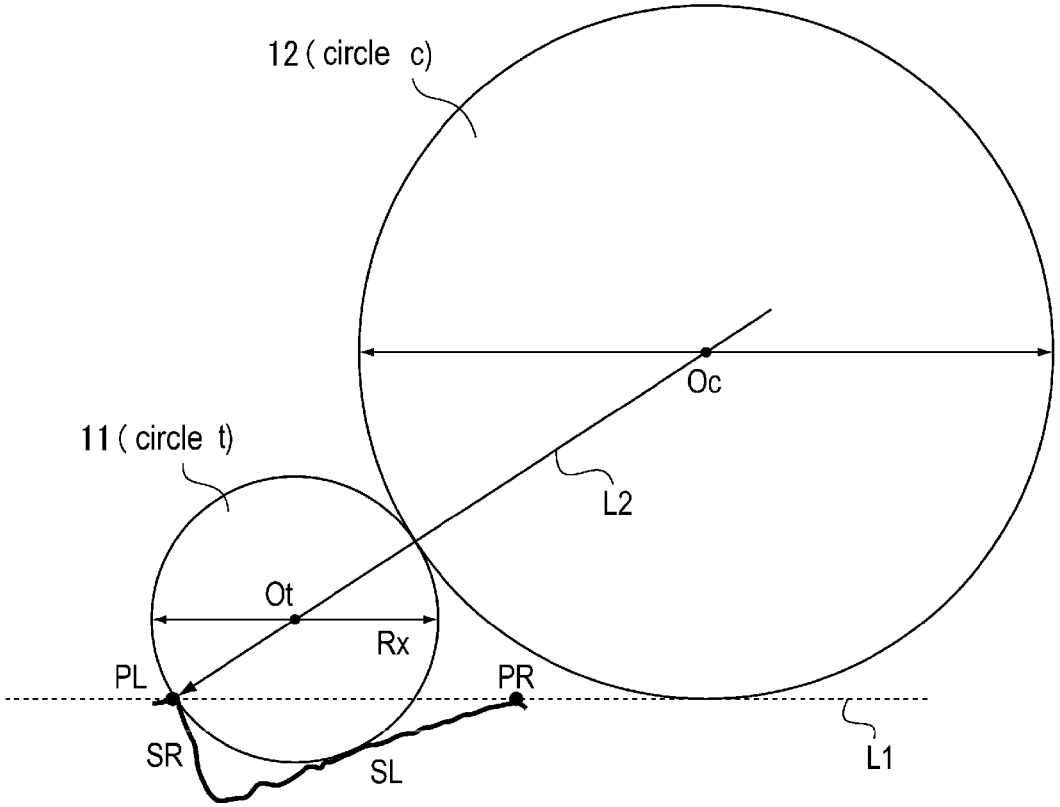

In FIG. 26B, with respect to the average shape, a circle c corresponding to the magnetic carrier 12 having a particle diameter rc contacts a circle t corresponding to the toner 11 which has a particle diameter Rx, and is in contact with the first virtual line L1, and in multipoint contact with the apex PL on the steep inclined surface SR and the gentle inclined surface SL. In this case, a second virtual line L2 connecting the center Oc of the circle c and the center Ot of the circle t is shown in a schematic view when passing through the apex PL. The diameter of the circle t obtained in this case is Rx, being the maximum particle diameter of the toner.

<Method of Measuring a Particle Diameter>

The particle diameter of the toner was measured using a Coulter Multisizer-III (Beckman Coulter, Inc.) according to the operation manual of the measuring device.

Specifically, 0.1 g of a surfactant as a dispersant was added to 100 ml of an electrolyte solution (ISOTON), and further, 5 mg of a measurement sample (toner) was added thereto. The electrolytic solution in which the sample is suspended was subjected to dispersion treatment with an ultrasonic disperser for about 2 minutes to use as a measurement sample. Using a 100 μm aperture, the number of the samples was measured for each channel, and a median diameter d50, 10% diameter d10 of the cumulative distribution, and 90% diameter d90 were calculated, and then the number average particle diameter $r_t$ of the sample was set to rt10 and rt90.

The particle diameter of the magnetic carrier was measured using a laser diffraction particle size distribution analyzer SALD-3000 (manufactured by Shimadzu Corporation) according to the operation manual of the measuring device. Specifically, 0.1 g of the magnetic carrier was introduced into the analyzer to perform a measurement, the number of samples was measured for each channel, and the median diameter d50 was calculated to determine the number average particle diameter $r_c$ of the sample.

<Method of Measuring Circularity>

A diameter, circularity and frequency distribution of the toner corresponding to the circle were measured using a FPIA-2100 type (manufactured by Sysmex Corporation), and calculated by using Equations 13 and 14.

[Equation 13]

$$\text{Diameter corresponding to circle}=(\text{Particle projected area}/\pi)^{1/2}\times 2 \quad (13)$$

[Equation 14]

$$\text{Circularity}=(\text{Circumferential length of circle of the same area as particle projected image})/(\text{Circumferential length of particle projected image}) \quad (14)$$

Herein, the "particle projected area" is an area of the binarized toner particle image, and the "circumferential length of particle projected image" is defined as a length of a contour line obtained by connecting edge points of the toner particle image.

The circularity in the present invention is an index illustrating the degree of concave-convexness of the toner particles, and is indicated as 1.00 when the toner particle has a completely spherical shape. As the surface shape is more complicated, the circularity becomes smaller. In addition, when the circularity (central value) at a division point i of particle size distribution is set to ci, and the frequency is set to fci, the average circularity C which means an average value of circularity frequency distribution is calculated from Equation 15.

[Equation 15]

$$\text{Average Circularity } C=\Sigma_{i=1}^{m}(Ci\times fci)/\Sigma_{i=1}^{m}(fci) \quad (15)$$

As a specific measuring method, 10 ml of ion-exchanged water from which solid impurities are previously removed was prepared in a container, and a surfactant as a dispersant, preferably alkylbenzene sulfonate was added thereto, and then 0.02 g of the measurement sample were further added, and evenly distributed. As a member for dispersing, an ultrasonic disperser Tetora 150 type (manufactured by Nikkaki Bios Co., Ltd.) was used, and the dispersion treatment was performed for 2 minutes, to use as a dispersion liquid for measuring. At that time, the dispersion liquid was appropriately cooled so that the temperature thereof did not increase to 40° C. or more.

For measuring a shape of the toner particles, a FPIA-2100 type was used, and the concentration of the dispersion liquid was controlled so that the toner particle density at the time of measurement was 3,000 to 10,000 particles/μl, such that more than 1000 particles were measured. After the measuring, the average circularity of the toner particles was calculated by using the measured data.

<Evaluation Method>

To determine the developing amount, the toner developed on the photosensitive drum 1 was sucked up, and the weight (mg) thereof and the area ($cm^2$) of the suction portion were measured, and then, the weight ($mg/cm^2$) of the unit area which is a division of them was calculated.

For the toner cover ratio, the surface of the photosensitive drum 1 on which the toner is developed is photographed by a microscope VHX-5000 (manufactured by Keyence Corporation), and required data was obtained from the image using image processing software Photoshop (manufactured by Adobe Systems Incorporated). Then, only an area of the toner unit (px) was extracted, and a ratio to a total area was calculated.

For density evaluation after fixing, developing, transferring, and fixing are sequentially performed to fix the toner image on a coated sheet, and evaluate the density thereof. For density evaluation, a reflection density Dr of the coated sheet was measured by a reflection densitometer 500 Series (manufactured by X-Rite Inc.), and with respect to a desired reflection density (CMY: Dr≥1.3, K: Dr≥1.5), the case of not achieving the desired reflection density is x, and the case of achieving the desired reflection density is ○.

For evaluation of image uniformity of fixing degree, a halftone image (lightness L*≈70) wherein the density unevenness is easily-noticeable is subject to evaluation according to the following evaluation criteria.

Level good (○): spotty density unevenness is hardly noticeable (0-3 points/$cm^2$).

Level bad (x): spotty density unevenness is noticeably observed (4 points or more/$cm^2$).

<Method of Determining Electrification Series>

Only the magnetic carrier is put in the developing container 21 of the development device 20, and a rotational operation in a normal development was performed for about 1 minute. In this case, an electric field applying portion is separated, and the concave-convex rotating member 22 and the collecting roller 23 were in a state of electrically floating.

A probe of a surface potential meter MODEL 347 (manufactured by Trek Inc.) is installed at a position of the developing portion T so as to face the concave-convex rotating member 22, and the surface potential of the concave-convex rotating member 22 was measured. The potential difference before and after the rotation operation (post-operation potential−potential before operation) was measured, and if the potential difference is plus or minus, it is possible to determine whether the sleeve 221 of the concave-convex rotating member 22 is positive side or negative side in terms of the electrification series, respectively, as compared to the magnetic carrier.

Meanwhile, by the triboelectric charging between the magnetic carrier and the toner, it is possible to determine whether the toner is either a positive side or negative side in terms of the electrification series as compared to the magnetic carrier, and thereby it is possible to determine the relative electrification series of three parties.

Modified Example

Tables 7 and 8 show the results of image evaluation performed by the development device 20 according to Example 1 under the following conditions 1 and 2. The sleeve 221 used in this example is formed by a thermal nanoimprint process. Several nm of a primer layer was deposited on the elastic layer 221*b* having a thickness of 2 mm in order to increase adhesion on the sleeve 221, and several μm of an amide thermoplastic resin was applied thereon, to form a concave-convex structure by the thermal nanoimprint process. The magnetic carrier was manufactured by controlling the particle diameter of a core by varying the sintering condition of a ferrite, and coating the ferrite core with a silicone resin. In addition, an HV development device using a developer used in conditions 1 and 2 was used in the comparative example.

<Condition 1>

Toner (negatively charged): rt=1.7 μm, and average circularity=0.96.

Magnetic carrier: rc=35 μm.

TD ratio: 4%.

Concave-convex structure (FIG. 20B): L=2 μm, xL=1.8 μm, d=0.45 μm, κR=2.3, and κL=0.25

Velocity ratio vh/vm=1.2.

<Condition 2>

Toner (negatively charged): rt=45 μm, and average circularity=0.95.

Magnetic carrier: rc=500 μm.

TD ratio: 7%.

Concave-convex structure (FIG. 20B): L=50 μm, xL=45 μm, d=12 μm, κR=2.4, and κL=0.27.

Velocity ratio vh/vm=1.1

TABLE 7

| Condition 1 | Developing amount ($mg/cm^2$) | Toner cover ratio (%) | Density evaluation | Image uniformity evaluation |
|---|---|---|---|---|
| Development device of present embodiment | 0.10 | 90 | ○ | ○ |
| HV development device | 0.10 | 77 | X | X |

TABLE 8

| Condition 2 | Developing amount ($mg/cm^2$) | Toner cover ratio (%) | Density evaluation | Image uniformity evaluation |
|---|---|---|---|---|
| Development device of present embodiment | 2.8 | 82 | ○ | ○ |
| HV development device | 2.8 | 71 | X | X |

Regardless of the particle diameter and charge polarity of the toner, the effects of the present development device were confirmed. In other words, regardless of the particle diameter and charge polarity of the toner, since a high density toner image may be developed with a small toner amount, it is possible to obtain the desired density, and improve the density unevenness.

Example 2

FIG. 27 are cross-sectional views of a concave-convex structure of a coating layer 221*c* according to Example 2 of the present invention. FIG. 27A is a cross-sectional view in which flat portions M2 are formed on valleys of the concave-convex structure. As illustrated in FIG. 27A, gentle inclined surfaces SL of the concavo-convex structure are formed by a plurality of inclined surfaces. In particular, the flat portions M2 are formed in the bottom of the gentle inclined surfaces SL. According to this configuration, fine toner remains in the structure, and it is possible to improve the toner fusion caused by continuously receiving the rubbing of the developer and the photosensitive drum 1.

In this case, a width LFa of the flat portion M2 is smaller than three times the particle diameter rt of the toner, and is preferably smaller than two times thereof. Thereby, it is possible to coat a stable toner amount on the concave-convex structure. Of course, also in the structure, a relation between the maximum inclination κL and κR of the gentle inclined surface SL (PYL) and a steep inclined surface SR (PYR) which are positioned on the left and right of the apex P is $|\kappa L|<|\kappa R|$, as well as $|\kappa L|$ is 0.5 or less, and $|\kappa R|$ is 1.0 or more, preferably. Although not illustrated, the concave-convex structure may be a U-shaped inclination in which the gentle inclined surfaces SL and the steep inclined surfaces SR are continuously changed.

Figure 27A:
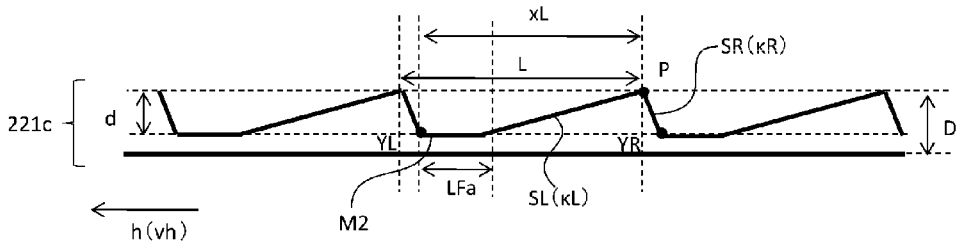
FIGS. 27A, 27B, 27C and 27D are cross-sectional views of a concave-convex structure of a coating layer according to modified example of the present invention.
Figure 27B:
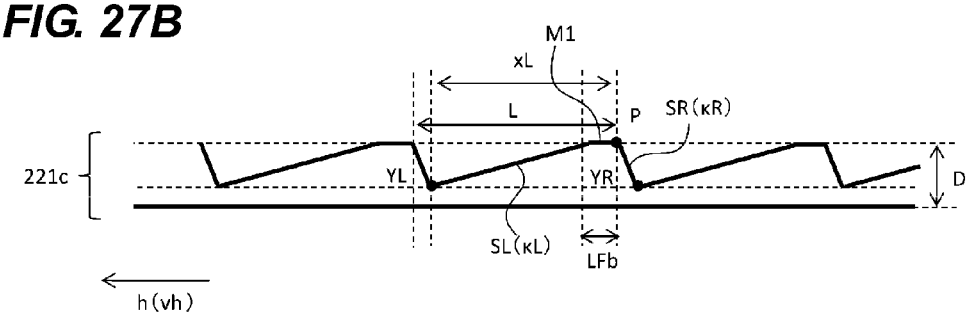

FIG. 27B is a cross-sectional view in which flat portions M1 are formed on peaks of the concave-convex structure. As illustrated in FIG. 27B, the steep inclined surfaces SR of the concavo-convex structures are formed by a plurality of inclined surfaces. In particular, the flat portions M1 are formed on tops of the steep inclined surfaces SR. According to this configuration, it is possible to suppress the concave-convex structure being worn by rubbing between the developer and the photosensitive drum 1 and changed in shape.

In this case, a width LFb of the flat portion M1 may be smaller than the particle diameter rt of the toner. Thereby, the toner to be coated on the flat portion M1 is limited, and it is possible to coat a stable toner amount on the concave-convex structure. Of course, also in the structure, a relation between the maximum inclination κL and κR of the gentle inclined surface SL (PYL) and a steep inclined surface SR (PYR) which are positioned on the left and right of the apex P is $|\kappa L|<|\kappa R|$, as well as $|\kappa L|$ is 0.5 or less, and $|\kappa R|$ is 1.0 or more, preferably.

It is preferable to set the aperture width Z to 1 μm or more and 100 μm or less.

Figure 36:
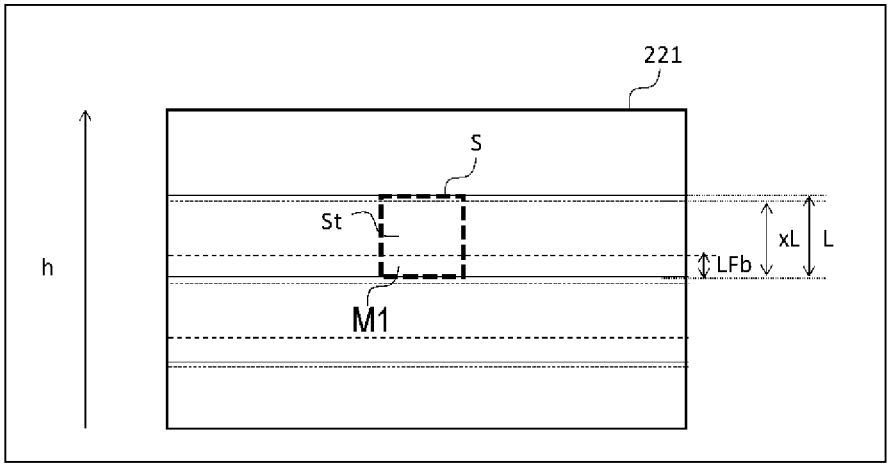
FIG. 36 is views of a flat plan of a surface of the sleeve.

The proportion of the flat portion M1 (at the convex portion) on the sleeve 221 is preferably set to 45% or less. FIG. 36 shows the region S (dashed line) on the sleeve 221, the aperture portion St with the aperture width L-Lfb on the region S and the flat portion M1 with the width LFb on the region S. The toner is coated on the aperture portion St. As described above, the toner of which amount is equal to or larger than that of the toner on the sleeve 221 is used for development on the photosensitive member 1.

On the other hand, the toner amount required on the photosensitive member 1 is about the amount of toner with which toner particles are adhered to each other without any gap after fixing and a sheet can be covered with a toner image. Specifically, the total volume of the toner coated in the aperture portion St is more than the volume of the cube determined by the product of the toner layer thickness dt after fixing and the area Sa of the region S.

[Equation 16]

$$\frac{Sta\cdot\kappa}{\rho} \geq Sa\cdot dt \tag{16}$$

(Sta: the area ($cm^2$) of the aperture portion St, Sa: the area ($cm^2$) of the region S, ρ: toner true specific gravity ($g/cm^3$), dt: toner layer thickness (cm) after fixing, κ: toner amount ($g/cm^2$) at the aperture portion St)

The toner amount κ in the aperture portion St can be approximated by the following equation since the toner particles are substantially filled in the close-packed.

[Equation 17]

$$\kappa = \frac{\pi\cdot\rho\cdot rt}{3\sqrt{3}}\times 10^{-4} \tag{17}$$

The toner layer thickness dt after fixing can be approximated by the following equation from the above two equations since it is possible to crush the toner particles to about ⅓ of the toner particle diameter rt, in the case of average condition.

[Equation 18]

$$\frac{Sta}{Sa} \geq 0.55 \tag{18}$$

In other words, when the proportion of the flat portion M1 on the sleeve 221 is 45% or less, it is possible to fix toner without any gap.

Figure 27C:
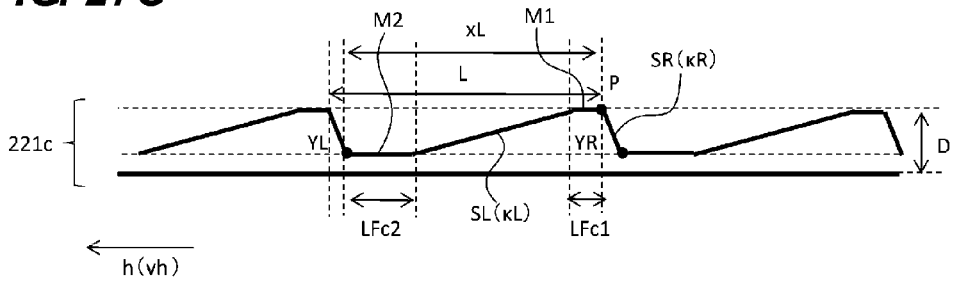

FIG. 27C is a cross-sectional view in which flat portions M1 and M2 are formed on the peak and the valley of the concave-convex structure, respectively. As illustrated in FIG. 27C, this concave-convex structure is a structure which combines the features of FIGS. 27A and 27B, and thereby it is possible to suppress the toner fusion or wearing of the structure. The width LFc1 of the flat portion M1 and the width LFc2 of the flat portion M2 may be set (which is the same as FIG. 27D to be described below).

Figure 27D:
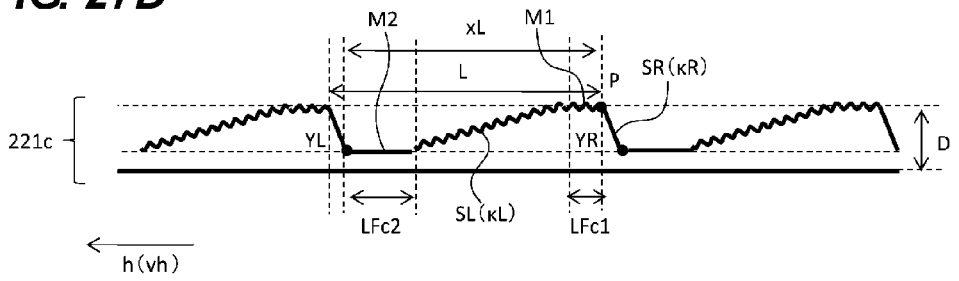

FIG. 27D is a cross-sectional view in which the surface roughness of a portion of the gentle inclined surfaces SL in FIG. 27C is enlarged compared to the steep inclined surfaces SR. Thereby, the adhesion force between the gentle inclined surface SL and the toner may lowered, while maintaining the coating properties to the concavo-convex structure, and the developability on the photosensitive drum 1 may be improved. It is possible to also obtain the same effect in the concave-convex structure other than FIG. 27C.

Example 3

In case of the development device structures of Examples 1 and 2, when developing the toner image in a multi-layer on the photosensitive drum 1, the circumferential velocity ratio may be set by multiplying the values calculated under the conditions of Equations 6 to 8 by the number of desired toner layers. However, by increasing the circumferential velocity ratio, an image defect referred to as sweep-out may be generated.

Figure 28:
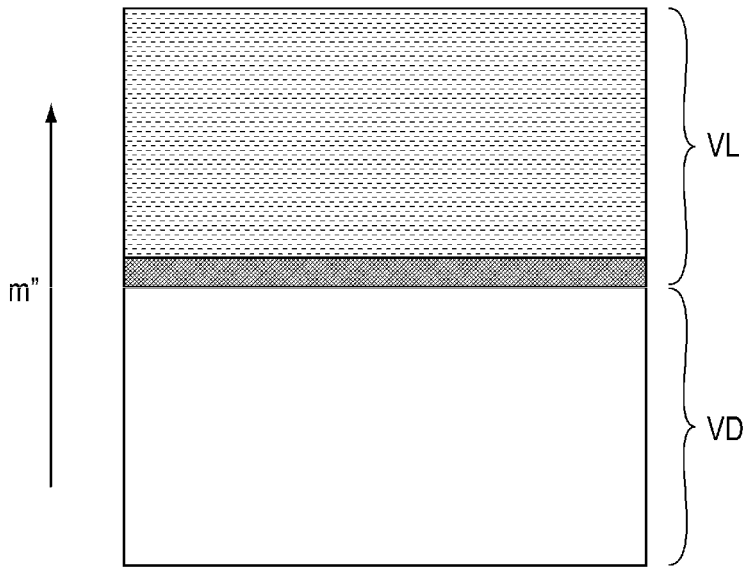
FIG. 28 is a schematic view describing a sweep-out.

FIG. 28 is a schematic view illustrating the sweep-out. The sweep-out refers to an image in which, when an image in which a high-density portion such as a solid black portion VL and a low-density portion such as a solid white portion VD are adjacent to each other are output in a traveling direction m of the photosensitive drum 1, the density of the rear end of the solid black portion VL is thickly output. The reason for the occurrence of sweep-out is that, by increasing the circumferential velocity ratio, the toner which is not developed in the upstream portion (solid white portion) and remains coated on the toner carrying member is developed, when the toner overtakes the rear end of the photosensitive drum 1.

Figure 29A:
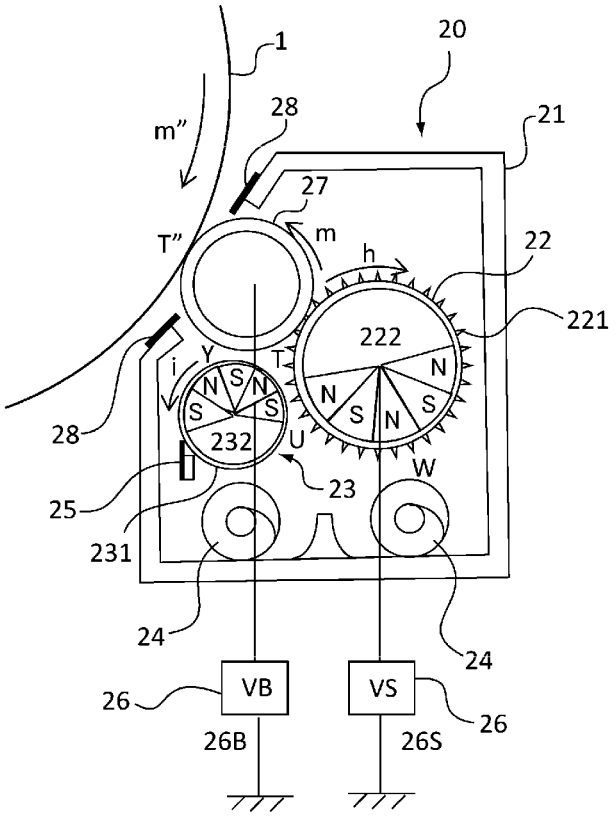
FIGS. 29A and 29B are views illustrating a configuration example of the development device using the concave-convex structure according to the present invention.

FIG. 29A illustrates an example of the configuration of the development device 20 using the concavo-convex structure, and depicts a means to improve image defects. The development device 20 is disposed opposite the photosensitive drum 1, and a toner carrying member 27, which is a "receiving member" for receiving the toner in this configuration, is disposed in an opening of the developing container 21. The toner carrying member 27 is formed of a member including a cylindrical member having a metal material as a base layer, and an elastic layer covered thereon. The toner carrying member 27 carries the toner.

The base layer may be any material having conductive and rigid properties, and may be formed of SUS, iron, aluminum or the like. The elastic layer includes, as a base material, a rubber material having a suitable elasticity such as silicone rubber, acrylic rubber, nitrile rubber, urethane rubber, ethylene-propylene rubber, isopropylene rubber, styrene-butadiene rubber or the like. The elastic layer is a layer provided with conductive properties in which conductive fine particles such as carbon, titanium oxide, or metal fine particles are added to a base material thereof.

Besides the conductive fine particles, a spherical resin may be dispersed in the elastic layer in order to control the surface roughness. In this example, the toner carrying member 27 including a base layer made of stainless steel, on which the elastic layer made of silicone rubber and urethane rubber with carbon dispersed therein is formed is used. The toner carrying member 27 is disposed so as to contact the photosensitive drum 1, and rotatably provided so as to move in the same direction at the developing portion T" in the rotation direction of the photosensitive drum 1, as well as, is set so as to ensure both velocities are substantially equal to each other. Herein, the circumferential velocity ratio of both velocities is preferably 1 time or more but 1.1 times or less.

In this example, the toner carrying member 27 and the photosensitive drum 1 come in contact with each other, and for so-called contact developing, the toner carrying member 27 is made of a member having elastic or flexible properties, but, for non-contact developing, it is made of a material having conductive and rigid properties, and for example, may be formed of SUS, iron, aluminum or the like. The concave-convex rotating member 22 is disposed inside of the developing container 21 to face the toner carrying member 27 so as to come in contact therewith.

Therefore, at least one of the toner carrying member 27 and the concave-convex rotating member 22 needs to be made of a member having elasticity and flexibility. The concave-convex rotating member 22 includes a sleeve 221 which conveys the toner to the developing portion T" facing the toner carrying member 27, and the plurality of permanent magnets 222 fixedly disposed therein. Further, the concave-convex structure according to the present invention is formed on the surface of the sleeve 221.

In this example, for the Ni—P layer of the sleeve 221 surface, the concave-convex structure is formed by the diamond edging process. The sleeve 221 is rotatably provided so as to move in the same direction as the toner carrying member 27 in the developing portion T", and both velocities are set so as to have a circumferential velocity ratio determined by Equations 6 to 8, by the particle diameter rt of the toner and the concave-convex structure.

In this example, the particle diameter of the toner is 7.6 μm, and a particle diameter rc of the magnetic carrier is 90 μm. In addition, conditions of the concave-convex structure (FIG. 20B) are set as L=8 μm, xL=7.3 μm, d=1.9 μm, κR=2.7, and κL=0.26. The circumferential velocity ratio is set to 2.1 times and is obtained by multiplying the value (1.05) calculated from Equation 6 by 2 times the total number of toners.

In this example, the toner carrying member 27 and the concave-convex rotating member 22 are rotated so as to move in the same direction, but they may move in the reverse direction. The collecting roller 23 is disposed opposite the concave-convex rotating member 22 and toner carrying member 27 with a gap, at a position upstream from the developing portion T and downstream from the supply portion W which supplies the developer to the concave-convex structure by the supply members 24 in the rotation direction of the sleeve 221.

Figure 29B:
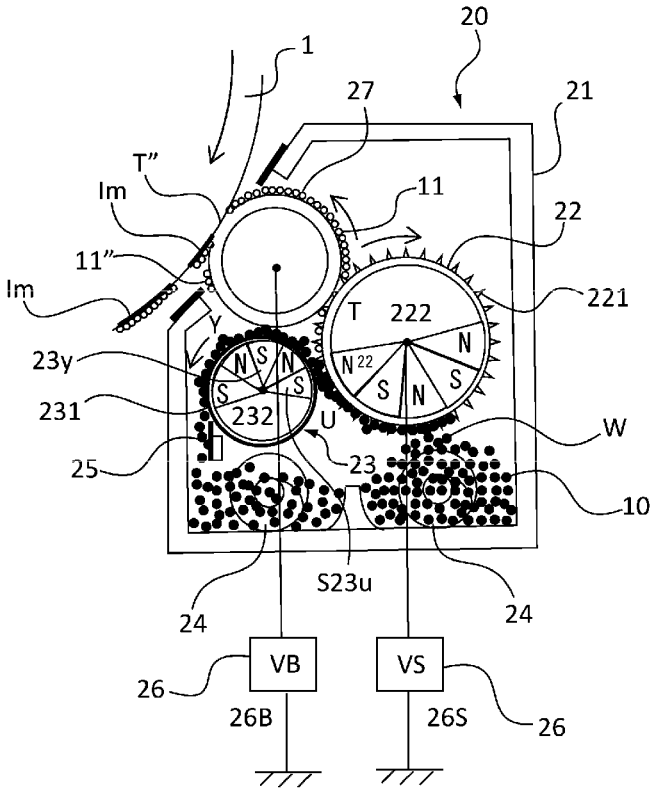

The collecting roller 23 includes a sleeve 231 which collects the developer by the magnetic force and conveys the collected developer to the facing portion with the scraper 25 in the collecting portion U facing the concave-convex rotating member 22, and the plurality of permanent magnets 232 fixedly disposed inside thereof. Next, coating the toner on the toner carrying member 27 and developing the electrostatic image on the photosensitive drum 1 in the development device 20 which is a feature of the present invention will be described with reference to FIG. 29B.

The two-component developer 10 is supplied to the concave-convex rotating member 22 having the concave-convex structure on the surface thereof by the supply member 24. During a conveying process from supplying the two-component developer 10 to the sleeve 221 to collecting by the collecting roller 23 to be described below, the negatively charged toner of the two-component developer 10 in contact with the sleeve 221 is stably and uniformly coated thereon in a thin layer.

The two-component developer 10 other than the coated toner is collected by the collecting roller 23 in the collecting portion U by the magnetic force. On the other hand, the toner which is not collected but is instead thinly and uniformly coated on the concave-convex rotating member 22 contacts the toner carrying member 27 in the developing portion T, and is coated on the toner carrying member 27 by the potential difference generated by the voltage applying portion 26.

In this example, DC −400 V and DC −700 V voltages are applied to the concave-convex rotating member 22 by a voltage applying portion 26B and a voltage applying portion 26S, respectively. In this case, a direction which moves up the steep inclined surface then moves down the gentle inclined surface of the concave-convex structure is set to be positive, and the relative velocity of the moving velocity vh of the concave-convex rotating member 22 to the surface velocity vm of the toner carrying member 27 is positive. By properly setting the velocity ratio vh/vm of the concave-convex rotating member 22 to the toner carrying member 27, multi-layered and high-density toner coating on the toner carrying member 27 may be achieved.

Thereafter, the toner 11 carried on the toner carrying member 27 is conveyed to the developing portion T" facing the photosensitive drum 1, and is developed under a condition in which the circumferential velocities of the photosensitive drum 1 and the toner carrying member 27 are substantially the same velocity. Therefore, it is possible to develop a high-density toner image with reduced sweep-out on the photosensitive drum 1.

Next, collecting of a residual toner 11" remaining on the toner carrying member 27 without being developed will be described. The residual toner 11" is conveyed to the collecting portion Y facing the collecting roller 23 by the toner carrying member 27. In this case, the toner 11" contacts the two-component developer 10 carried on the collecting roller 23. Since the concave-convex rotating member 22 is coated with the toner in advance, the two-component developer 10 has a lowered TD ratio.

Therefore, since the developer has an ability for collecting the toner, and by contacting with the toner without being developed, the residual toner 11" is separated from the toner carrying member 27, and is collected in the two-component developer 10 carried on the collecting roller 23. In this example, the collecting roller 23 is in an electrically floating state without applying a voltage thereto, but a voltage may be applied thereto.

In this case, in order to collect the residual toner 11" in the collecting portion Y, the voltage applied to the collecting roller 23 is preferably a DC voltage VB or more (when using the positively charged toner, VB or less) applied to the toner carrying member 27. Meanwhile, when the voltage is applied to the collecting roller 23, the electric fields also act on the collecting portion U. Even under such a condition, the binding force of a component perpendicular to the direction of the electric field is generated in the toner coated on the sleeve 221 by the concave-convex structure.

Meanwhile, since the other developer is collected on the collecting roller 23, more stable and uniform thin-layer coating on the concave-convex rotating member 22 may be achieved. Further preferably, the magnetic poles (S23*y* pole) of the permanent magnets 232 disposed opposite the collecting portion Y and the magnetic poles (S23*u* pole) of the permanent magnets 232 disposed opposite the collecting portion U are the same polarity. A reason thereof will be described with reference to FIG. 30.

Figures 30A, 30B, 30C:
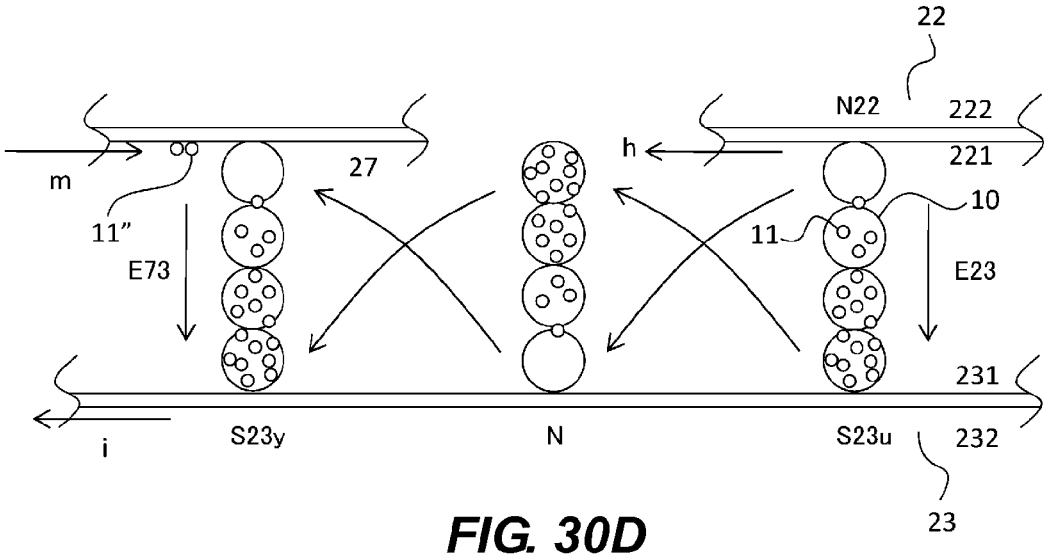
FIGS. 30A, 30B, 30C and 30D are schematic views illustrating a conveyance of a magnetic brush from a collecting portion U to a collecting portion Y.

FIGS. 30A, 30B and 30C are schematic views illustrating a conveyance of the magnetic brush from the collecting portion U to the collecting portion Y. In the collecting portion U, due to an electric field E23, the toner other than the toner coated on the sleeve 221 is projected in the collecting roller 23 direction, and thereby the amount of toner near the collecting roller 23 is increased (see FIG. 30A). By the rotation of the sleeve 231 and the magnetic field produced by the permanent magnet 232, the magnetic brush is conveyed (see FIG. 30B), and in the magnetic brush conveyed to the collection portion Y, the toner amount near the toner carrying member 27 is decreased (see FIG. 30C).

Therefore, since the residual toner 11" is easy to be collected by the magnetic carrier, it is possible to collect the residual toner 11" with a lower electric field E73. Herein, it is not limited to the magnetic pole configuration, and the magnetic pole of the permanent magnet 232 disposed opposite the collecting portion Y and the magnetic pole of the permanent magnets 232 disposed opposite the collecting portion U may have the same poles as each other. In the collecting portions U and Y, the collected developer and the residual toner 11" are returned to the developing container 21 by the magnetic field and the scraper 25, are agitated and conveyed by the supply member 24 again, and are supplied to the concave-convex rotating member 22 in the supply portion W.

Figure 30D:
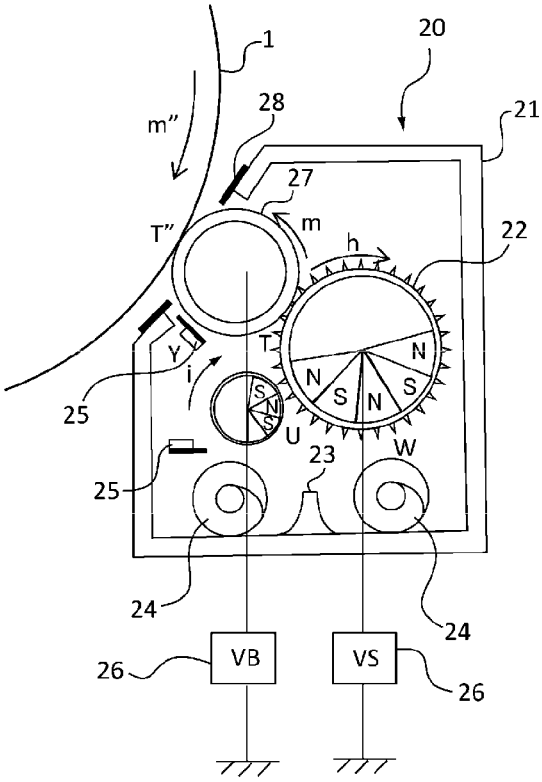

FIG. 30D illustrates a configuration for collecting the residual toner by the scraper 25. As illustrated in FIG. 30D, a configuration of collecting the residual toner by an independent collecting member may be used. In this example, the scraper is used as the collecting member, but a rotation member such as a sleeve carrying a sponge roller or a magnetic carrier also may be used.

Example 4

Figure 31:
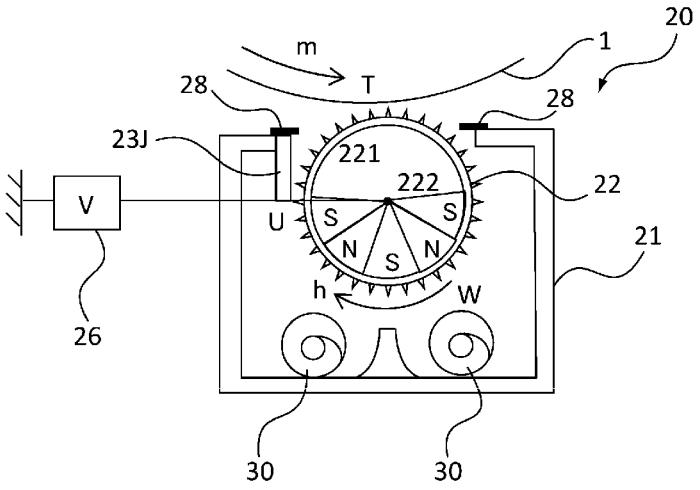
FIG. 31 is a cross-sectional view of a development device according to Example 4.

FIG. 31 is a cross-sectional view of a development device according to Example 4. The concave-convex rotating member 22 has a rotatable sleeve 221 in the rotation direction h and rotatably supported in the developing container 21, permanent magnets 222 which are non-rotatably supported inside of the sleeve 221 and have a plurality of magnetic poles. The sleeve 221 has a concave-convex structure formed by arranging in the moving direction thereof, and is disposed so that the concave-convex structure and the photosensitive drum 1 which is a "receiving member" for receiving the toner in this configuration come in contact with each other.

The photosensitive drum 1 as a "toner carrying member" carries the toner. In addition, when a direction which moves up the steep inclined surface of the concave-convex structure then moves down the gentle inclined surface of the concave-convex structure is set to a positive, the relative velocity of the surface velocity of the concave-convex rotating member 22 to the surface velocity of the photosensitive drum 1 may be a positive.

In this example, the sleeve 221 includes, the base layer 221*a* made of stainless steel, the elastic layer 221*b* formed thereon in a thickness of about 3 mm and made of silicone rubber with carbon dispersed therein, and a coating layer 221*c* formed thereon in a thickness of about 7 μm. The concave-convex structure in the coating layer 221*c* is formed by curing a fluorine photo-curable resin by the photo nanoimprint process.

The developing container 21 has a supply member 24 for supplying the developer to the concave-convex rotating member 22, and a collecting member 23J for collecting the developer on the concave-convex rotating member 22, which are fixedly disposed inside thereof at intervals and face the concave-convex rotating member 22.

The supply member 24 conveys the two-component developer 10 collected by the collecting member 23J to be described below while stirring the same inside of the developing container 21 to the supply portion W in which the concave-convex rotating member 22 and the supply member 24 face each other, and the developer is supplied to the concave-convex rotating member 22 by the magnetic force exerted by the permanent magnets 222.

Meanwhile, the collecting member 23J as a "collecting portion" is formed of a magnetic material or a metal material having a higher magnetic permeability than a predetermined amount. The collecting member 23J collects the developer by the magnetic force exerted by the magnetic fields formed in cooperation with the permanent magnets 222. The collecting member 23J may be disposed at a position upstream from the developing portion T which moves the toner on the concave-convex structure to the photosensitive drum 1 and downstream from the supply portion W, in the rotation direction h of the sleeve 221. An anti-scattering sheet 28 for preventing the toner 11 from being scattered to an outside of the developing container 21 is provided in an opening of the developing container 21.

Herein, coating the toner on the concave-convex rotating member 22 and developing the electrostatic image on the photosensitive drum 1 in the development device 20 will be described. In the supply portion W, the developer supplied to the concave-convex rotating member 22 by the supply member 24 is conveyed in an arrow h direction in FIG. 31, by the rotation of the sleeve 221 (in h direction in FIG. 31) and the magnetic force exerted by the magnetic fields produced by the permanent magnets 222. The conveyed developer 10 is bound in the collecting portion U in which the collecting member 23J and the concave-convex rotating member 22 face each other, by the magnetic force exerted by the magnetic fields formed in cooperation with the collecting member 23J and the permanent magnets 222, and finally fall into the developing container 21 by gravity.

Meanwhile, during the conveying process, since the toner which contacts the sleeve 221 to be coated thereon is not bound by the magnetic force, the toner passes through the collecting portion U and is conveyed to the developing portion T facing the photosensitive drum 1. A voltage is applied to the concave-convex rotating member 22 by the voltage applying portion 26, and a potential difference is generated between the concave-convex rotating member 22 and the photosensitive drum 1. In addition, the velocity ratio vh/vm of the moving velocity vh of the concave-convex rotating member 22 to the moving velocity vm of the photosensitive drum 1 is set so as to have a circumferential velocity ratio determined by Equations 6 to 8.

Figure 32:
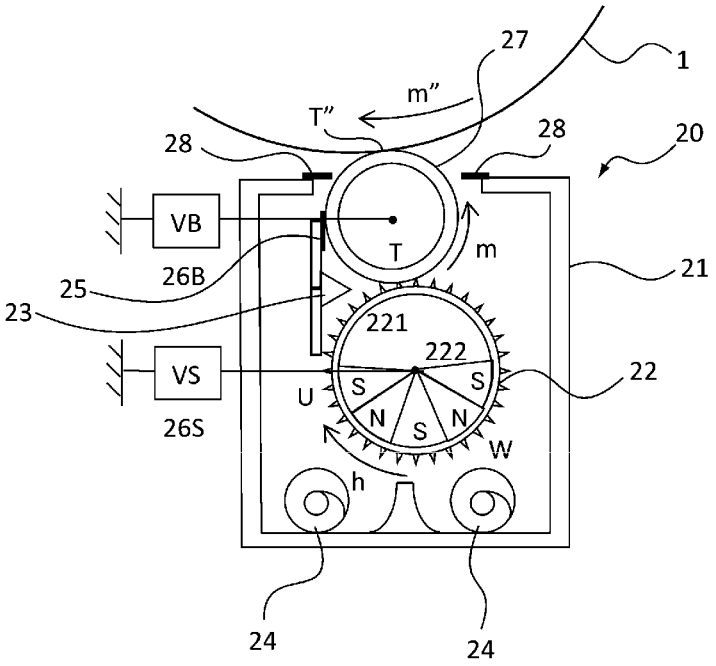
FIG. 32 is a cross-sectional view illustrating a configuration of a development device in which a toner carrying member receiving a toner in this configuration is disposed between the concave-convex rotating member and the photosensitive drum for suppressing the sweep-out.

FIG. 32 is a cross-sectional view of a development device in which a toner carrying member 27 which is a "receiving member" for receiving the toner in this configuration is disposed between the concave-convex rotating member 22 and the photosensitive drum 1 for suppressing the sweep-out. In the developing portion T", since the photosensitive drum 1 and the toner carrying member 27 rotate at substantially the same velocity, a high-density toner image with reduced sweep-out may be developed on the photosensitive drum 1.

As described above, in the development device according to this example, it is also possible to stably develop a high-density image on the photosensitive drum 1 with a small toner amount, obtain a desired density, and improve the image uniformity. Further, since the development device according to the present invention includes the collecting portion having a simplified configuration, it is possible to adapt a decrease in size of the development device.

Example 5

Figure 33A:
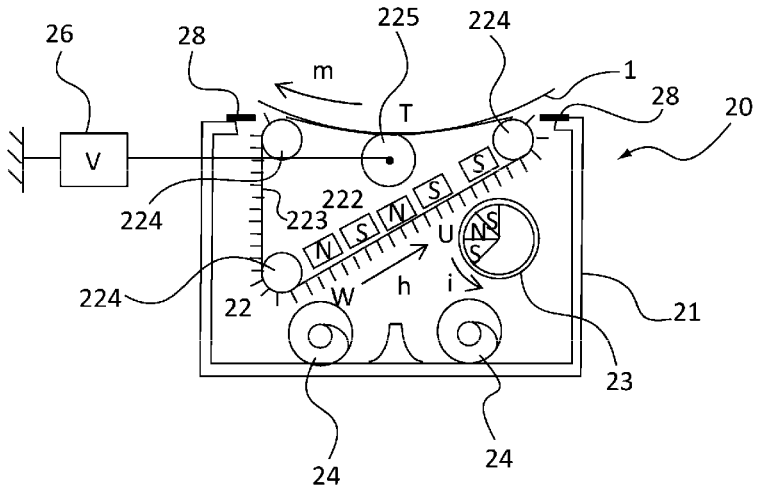
FIGS. 33A and 33B are cross-sectional views of a development device according to Example 5.
Figure 33B:
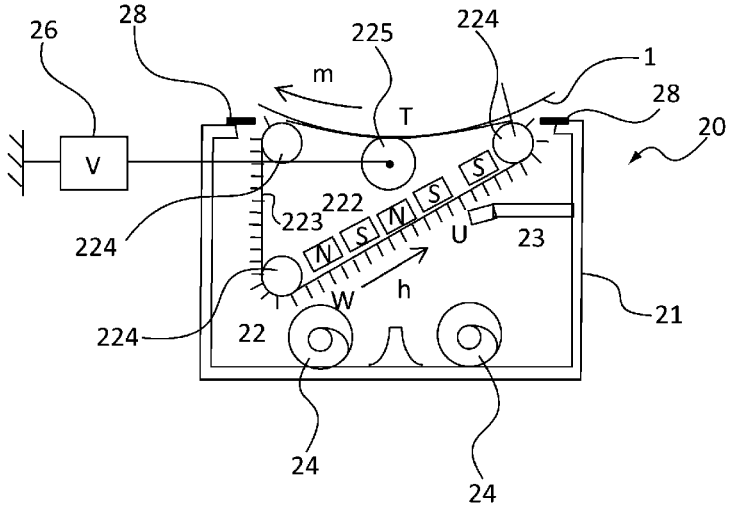

FIG. 33A is a cross-sectional view of a development device 20 according to Example 5. FIG. 33B is a cross-sectional view of a development device 20 according to a modified example. The concave-convex rotating member 22 has a belt 223 which is rotatably supported in the developing container 21 and has a concave-convex structure formed on the surface thereof, permanent magnets 222 which are non-rotatably supported inside of the belt 223 and have a plurality of magnetic poles, driving rollers 224 as a "plurality of rollers" for suspending the belt 223, and an elastic roller 225. In FIG. 33A, a collecting roller 23 is disposed at a position facing the belt 223, and in FIG. 33B, a collecting member 23J is disposed in a position facing the belt 223.

In this example, by using the belt 223, the concave-convex structure according to the present invention is directly formed on a base material thereof made of polyimide by the thermal nanoimprint process. Additionally, as another belt member, a coating layer formed of a thermosetting resin or photo-curable resin may be provided on the base material, and then a concave-convex structure may be formed on the coating layer by the nanoimprint process. In addition, a metal layer such as Ni—P having a low magnetic permeability may be provided on a base material of SUS by electroforming, and then a concave-convex structure may be formed on the metal layer by the diamond edging process.

Further, in order to prevent from being chipped or insulating processing, a high-hardness material and an insulating material may be coated on the concave-convex structure. In this case, it is necessary to form a thin coating layer enough to hold the concave-convex structure thereon. In this example, a power is fed to the elastic roller 225 disposed inside of the belt 223, but the power may be directly fed to the base material of the belt member. Instead of the elastic roller 225, the belt 223 may be provided with the elastic layer. In the development device according to this example, by using the belt 223, a conveying distance from the supply portion W to the collecting portion U may be changed, as necessary, and thereby, the limitation of an installation space may be prevented, as well as the conveying distance may be easily ensured.

Example 6

Figure 34A:
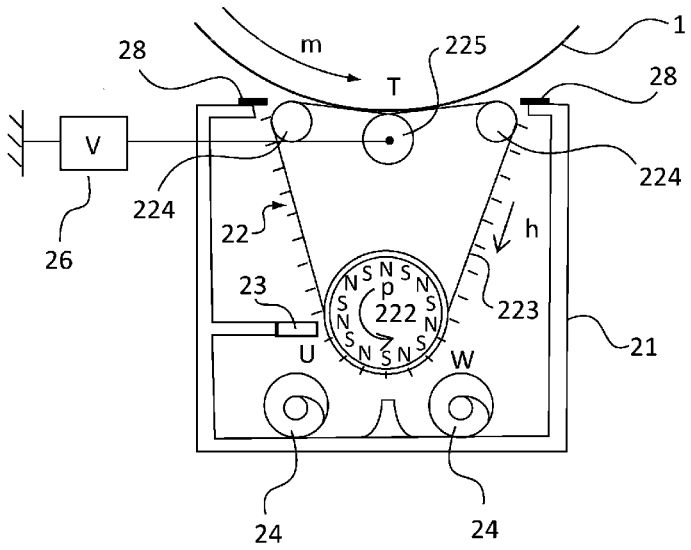
FIGS. 34A and 34B are cross-sectional views of a development device according to Example 6.

FIG. 34A is a cross-sectional view of a development device 20 according to Example 6. The concave-convex rotating member 22 has the belt 223 which is rotatably supported in the developing container 21 and has a concave-convex structure formed on the surface thereof, the permanent magnets 222 which are non-rotatably supported inside of the belt 223 and have a plurality of magnetic poles. Further, the concave-convex rotating member 22 has the driving rollers 224 as a "plurality of rollers" for suspending the belt 223, and the elastic roller 225.

In this example, by using the belt 223, the concave-convex structure is directly formed on a base material thereof made of polyimide by the thermal nanoimprint process. The collecting member 23J which is fixedly disposed on a position facing the permanent magnets 222 is preferably formed of a metal material such as iron having a higher magnetic permeability. In this example, the collecting member 23J is fixedly disposed, but it may be rotatably disposed such as a metal roller.

Figure 34B:
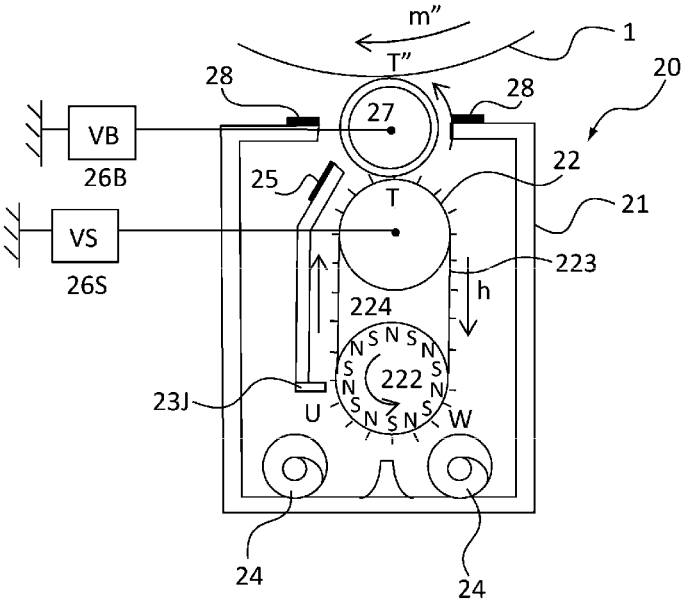

FIG. 34B is a cross-sectional view of a development device 20 according to a modified example. As illustrated in FIG. 34B, in order to suppress the sweep-out, a toner carrying member 27 which is a "receiving member" for receiving the toner in this configuration between the concave-convex rotating member 22 and the photosensitive drum 1. The toner carrying member 27 carries the toner. In the developing portion T", since the photosensitive drum 1 and the toner carrying member 27 rotate at substantially the same velocity, a high-density toner image with reduced sweep-out may be developed on the photosensitive drum 1.

In the development device according to this example, by rotating the permanent magnets 222 disposed inside of the belt 223, the magnetic brush is conveyed while rotating on the belt 223. Therefore, it is possible to increase the contact frequency between the belt 223 and the toner by a short conveying distance and conveying time. In addition, by controlling the rotation velocity of the permanent magnets 222, variation in the coating amount may be suppressed without affecting other configurations.

Example 7

Figure 35A:
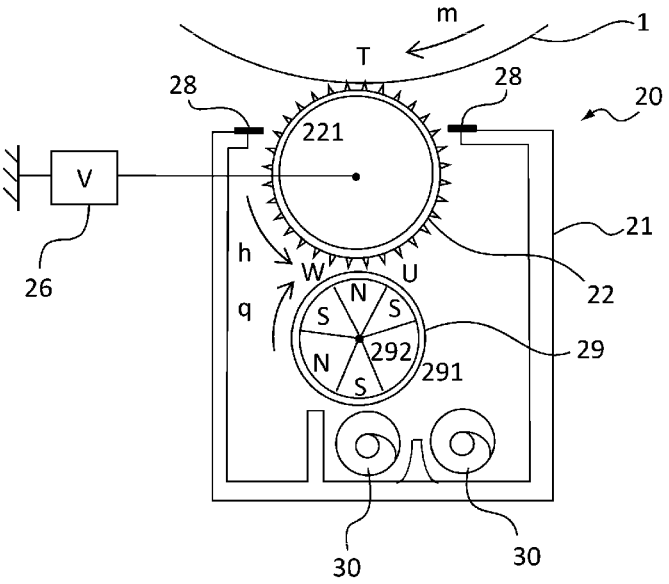
FIGS. 35A and 35B are cross-sectional views of a development device according to Example 7.

FIG. 35A is a cross-sectional view of a development device 20 according to Example 7. The concave-convex rotating member 22 is the sleeve 221 which is rotatably supported in the developing container 21 in the rotation direction h thereof. In this example, the sleeve 221 has the base layer 221*a* made of stainless steel, the elastic layer 221*b* formed thereon in a thickness of about 3 mm and made of silicone rubber with carbon dispersed therein, and the coating layer 221*c* formed thereon in a thickness of about 7 μm.

The concave-convex structure in the coating layer 221*c* is formed by curing a fluorine photo-curable resin by the photo nanoimprint process. In this example, a supply and collecting member 29 plays a role of the supply member and the collecting member. The supply and collecting member 29 includes a sleeve 291 which is rotatably supported in the developing container 21, and permanent magnets 292 which are non-rotatably supported inside of the sleeve 291 and have a plurality of magnetic poles. The supply and collecting member 29 may be disposed so that the carried developer comes in contact with the concave-convex rotating member 22.

A process in which the toner is coated on the concave-convex rotating member 22 will be described. The developer supplied to the supply and collecting member 29 by a supply member 30 is conveyed in an arrow q direction in FIG. 35A, by the rotation of the sleeve 291 and the magnetic force exerted by the magnetic fields produced by the permanent magnets 292. The conveyed developer contacts the concave-convex rotating member 22 in the supply portion W, and collected by the supply and collecting member 29 in the collecting portion U, by the magnetic force exerted by the magnetic fields formed by the permanent magnets 292.

Meanwhile, since the toner which contacts the sleeve 221 to be coated thereon is not bound by the magnetic force, the toner passes through the collecting portion U and is conveyed to the developing portion T facing the photosensitive drum 1. In this case, a potential difference is generated between the concave-convex rotating member 22 and the photosensitive drum 1 by the voltage applying portion 26. In addition, the velocity ratio vh/vm of the moving velocity vh of the concave-convex rotating member 22 to the moving velocity vm of the photosensitive drum 1 is set so as to have a circumferential velocity ratio determined by Equations 6 to 8.

Figure 35B:
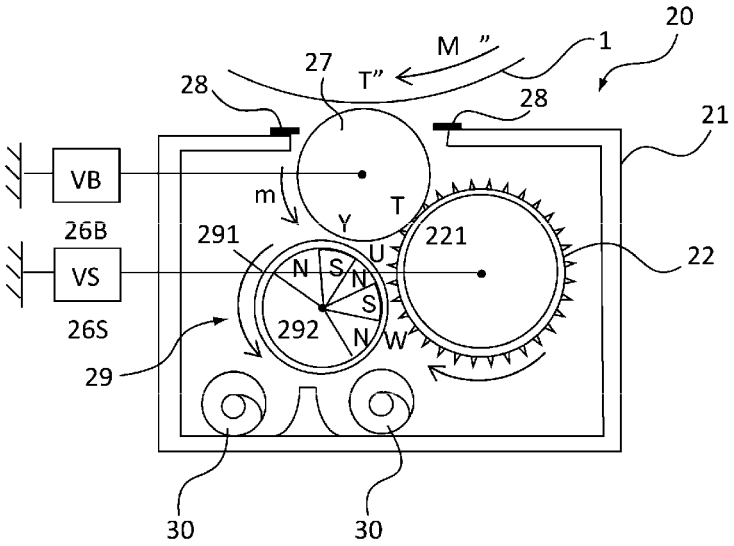

FIG. 35B is a cross-sectional view of a development device 20 according to a modified example. As illustrated in FIG. 35B, in order to suppress the sweep-out, this modified example includes a development device in which the toner carrying member 27 which is a "receiving member" for receiving the toner in this configuration is disposed between the concave-convex rotating member 22 and the photosensitive drum 1. The toner carrying member 27 carries the toner.

In the developing portion T", since the photosensitive drum 1 and the toner carrying member 27 rotate at substantially the same velocity, a high-density toner image with reduced sweep-out may be developed on the photosensitive drum 1. Herein, collecting of a residual toner remaining on the toner carrying member 27 will be described. Since the concave-convex rotating member 22 is coated with the developer collected by the supply and collecting member 29 in advance in the collecting portion U, the TD ratio is lowered.

Therefore, since the developer has an ability for collecting the toner, and by contacting with the residual toner without being developed, the residual toner may be collected. In this example, the supply and collecting member 29 is in an electrically floating state without applying a voltage thereto, but a voltage may be applied thereto. In this case, in order to collect the residual toner in the collecting portion Y, the voltage applied to the supply and collecting member 29 is preferably smaller than the DC voltage VB (when using the negatively charged toner, larger than the VB) applied to the toner carrying member 27.

Moreover, the magnetic pole of the permanent magnets 292 disposed opposite the collecting portion Y and the magnetic pole of the permanent magnets 292 disposed opposite the supply portion W have the same poles as each other, preferably. In addition, a configuration of collecting the residual toner by an independent collecting member may be used, as described in Example 3. In the development device according to this example, the supply and collecting member plays a role of the developer supply member and the collecting member. Therefore, there is no need to convey the developer between different members from each other, and it is difficult to generate a conveyance failure which can cause an immobile layer during conveying or the like. Accordingly, it is difficult to share the developer, and it is possible to improve the durability.

According to the configurations of Examples 1 to 7, during the supplying and conveying the two-component developer 10 on the plurality of convexes 22A of the surface of the concave-convex rotating member 22, the toner is uniformly coated thereon. In other words, the member carrying the non-magnetic toner may uniformly carry the non-magnetic toner of the developer. Further, after collecting the two-component developer 10 other than the uniformly coated toner, the toner between the plurality of convexes 22A moves to the receiving member.

In particular, when a direction which moves up the steep inclined surface SR with a steep inclination angle which is formed between the plurality of convexes 22A then moves down the gentle inclined surface SL with a gentle inclination angle is set to be positive, the relative velocity of the surface velocity of the concave-convex rotating member 22 to the surface velocity of the receiving member is set to the positive. Therefore, the toner carried between the plurality of convexes 22A reliably moves to the receiving member. In addition, a high density image is developed with a smaller toner amount from a monolayer to a multi-layer on the surface of the photosensitive drum 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This Application claims the benefit of Japanese Patent Application No. 2014-024651, filed Feb. 12, 2014, which is hereby incorporated by reference herein in its entirety.

What is claimed is:

1. A developing device configured to develop an electrostatic image formed on an image bearing member by using a developer containing non-magnetic toner particles and magnetic carrier particles, comprising:

a developing member configured to develop the electrostatic image formed on the image bearing member at a developing position, the developing member being disposed rotatably to contact with the image bearing member at the developing position and bearing the developer from a supplied position where developer is supplied to a collected position where magnetic carrier particles are collected and bearing toner particles from the collected position to the developing position; and a carrier collecting member configured to collect the magnetic carrier particles from the developing member at the collected position, the carrier collecting member having a magnet to form a magnetic field between the magnet and the developing member for collecting the magnetic carrier particles from the developing member, wherein an outer surface of the developing member includes a plurality of protrusion portions which extend along the outer surface of the developing member in a direction intersecting the rotational direction of the developing member and are aligned with a regular interval between adjacent protrusion portions, wherein the regular interval is equal to or larger than a particle diameter of a toner particle having an average particle diameter from among the particle diameters of the toner particles and smaller than a carrier particle diameter of a magnetic carrier particle having an average particle diameter from among the particle diameters of the magnetic carrier particles, and wherein the protrusion portions protrude from the outer surface of the developing member with a height that is smaller than the average particle diameter of the toner particles, and wherein each protrusion portion has a first face formed at one side in a circumferential direction of the developing member of an apex of each protrusion portion and a second face formed at the other side in the circumferential direction of the developing member of the apex of each protrusion portion, and an inclination angle of the first face is less than an inclination angle of the second face, and wherein in the circumferential direction of the developing member, when a downward direction of the first face is set to be positive, a relative velocity of a surface velocity of the developing member to a surface velocity of the image bearing member is set to be positive at the developing position.

2. The developing device according to claim 1, wherein the regular interval in the rotation direction is smaller than three times the particle diameter of the toner.

3. The developing device according to claim 1, wherein a maximum inclination angle |κL| of the first side surface is 0.5 degree or less, and a maximum inclination angle |κR| of the second side surface is 1.0 degree or more.

4. The developing device according to claim 1, wherein, when setting a particle diameter $r_t$ of the toner particles, a pitch L of the regular interval, a distance R between centers of the toner particles carried on the surface of the image bearing member, and natural numbers n and m, and a relation thereof is set to n+1<(L/rt)≤n+2, and m−1<(rt/L)≤m, a velocity ratio vh/vm of a moving velocity vh of the surface of the developing member to a moving velocity vm of the surface of the image bearing member satisfies the following conditions:

[Equation 16]

$$(A)\ \frac{v_h}{v_m} \geq \frac{L}{R} = \frac{L}{r_t} \tag{16}$$

[Equation 17]

$$(B)\ \frac{v_h}{v_m} \geq \frac{L - nr_t}{R} = \frac{L - nr_t}{r_t} \tag{17}$$

[Equation 18]

$$(C)\ \frac{v_h}{v_m} \geq \frac{L}{R} = \frac{\mathrm{mL}}{r_t}. \tag{18}$$

5. The developing device according to claim 1, wherein an electrification series of the surface of the toner transporting member, the non-magnetic toner, and the magnetic carrier is defined so that the magnetic carrier is arranged between the non-magnetic toner and the surface of the toner transporting member.

6. A developing device configured to develop an electrostatic image formed on an image bearing member by using a developer containing non-magnetic toner particles and magnetic carrier particles, comprising:

a developing member configured to carry the toner particles and configured to develop the electrostatic image formed on the image bearing member;

a toner transporting member configured to carry and transport the toner particles to the developing member at a toner transporting portion, the toner transporting member being disposed to contact with the developing member at the toner transporting portion and bearing the developer from a supplied position where the developer is supplied to a collected position where the magnetic carrier particles are collected and bearing the toner particles from the collected position to the toner transporting position; and a carrier collecting member configured to collect the magnetic carrier particles from the toner transporting member at the collected position, the carrier collecting member having a magnet to form a magnetic field between the magnet and the toner transporting member for collecting the magnetic carrier particles from the toner transporting member, wherein an outer surface of the toner transporting member includes a plurality of protrusion portions which extend along the outer surface of the toner transporting member in a direction intersecting a toner carrying direction of the toner transporting member and are aligned with a regular interval between adjacent protrusion portions, wherein the regular interval is equal to or larger than a particle diameter of a toner particle having an average particle diameter from among the particle diameters of the toner particles and smaller than a carrier particle diameter of a magnetic carrier particle having an average particle diameter from among the particle diameters of the magnetic carrier particles, and wherein the protrusion portions protrude from the outer surface of the toner transporting member with a height that is smaller than the average particle diameter of the toner particles, and wherein each protrusion portion has a first face formed at one side in a circumferential direction of the toner transporting member of an apex of each protrusion portion and a second face formed at the other side in the circumferential direction of the toner transport member of the apex of the each protrusion portion, and an inclination angle of the first face is less than an inclination face of the second face, wherein in the circumferential direction of the toner transport member, when a downward direction of the first face is set to be positive, a relative velocity of a surface velocity of the developing member to a surface velocity of the image bearing member is set to be positive at the transporting position.

7. The developing device according to claim 6, wherein the regular interval in the rotation direction is smaller than three times the particle diameter of the toner.

8. The developing device according to claim 6, wherein a maximum inclination angle |κL| of the first side surface is 0.5 or less, and a maximum inclination angle |κR| of the second side surface is 1.0 or more.

9. The developing device according to claim 6, wherein, when setting the particle diameter $r_t$ of the toner, a pitch L of the regular interval, a distance R between centers of the toner particles carried on the surface of the developing member, and natural numbers n and m, and a relation thereof is set to $n+1<(L/rt)\leq n+2$, and $m-1<(rt/L)\leq m$, a velocity ratio vh/vm of a moving velocity vh of the surface of the toner transporting member to a moving velocity vm of the surface of the developing member satisfies the following conditions:

[Equation 16]

$$(A)\ \frac{v_h}{v_m} \geq \frac{L}{R} = \frac{L}{r_t} \tag{16}$$

[Equation 17]

$$(B)\ \frac{v_h}{v_m} \geq \frac{L-nr_t}{R} = \frac{L-nr_t}{r_t} \tag{17}$$

[Equation 18]

$$(C)\ \frac{v_h}{v_m} \geq \frac{L}{R} = \frac{\mathrm{mL}}{r_t}. \tag{18}$$

10. The developing device according to claim 6, wherein an electrification series of the surface of the toner transporting member, the non-magnetic toner, and the magnetic carrier is defined so that the magnetic carrier is arranged between the non-magnetic toner and the surface of the toner transporting member.

11. An image forming apparatus comprising:

an image bearing member which is disposed rotatably and bears a latent image;

a developing device which develops the latent image formed on the image bearing member with a developer containing non-magnetic toner and magnetic carrier, the developing device comprising;

a concave-convex rotation member disposed rotatably and formed with a plurality of grooves on an outer surface in a crossing direction to a rotational direction of the concave-convex rotation member to bear and carry the developer on the outer surface, the concave-convex rotation member contacting with the image bearing member at a developing position facing the image bearing member to develop the latent image, a supplying portion which supplies the developer to the concave-convex rotation member at a supplying position, and a collecting portion which is disposed on a downstream side of the supplying position and on an upstream side of the developing position in the rotational direction of the concave-convex rotation member to collect the magnetic carrier from the concave-convex rotation member, wherein each of the grooves has a first side surface formed in a downstream side in the rotational direction of the concave-convex rotation member and a second side surface formed in an upstream side in the rotational direction of the concave-convex rotation member so as to face the first side surface, and each of the grooves is configured so that a first virtual sphere having an average diameter of the non-magnetic toner contacts with an inner surface of the groove of the concave-convex rotation member except at both ends of the groove with respect to the rotational direction of the concave-convex rotation member and so that a second virtual sphere having an average diameter of the magnetic carrier does not contact with the inner surface of the groove of the concave-convex rotation member except at the both ends of the groove, and so that the first virtual sphere protrudes outside of a line connecting at the both ends of the groove in a case when the first virtual sphere contacts the inside of the groove at a lowest position, and wherein in a cross-section perpendicular to a rotational axis of the concave-convex rotation member, each of the grooves is configured so that a first angle is larger than a second angle, the first angle is formed by the line and the first side surface, and the second angle is formed by the line and the second surface, and the second angle is an acute angle and the concave-convex rotation member rotates in a same direction as the image bearing member at the developing position, and a rotational speed of a peripheral surface of the concave-convex rotation member is larger than a rotational speed of a peripheral surface of the image bearing member.

12. The image forming apparatus according to claim 11, wherein each of the grooves is configured so the first virtual sphere contacts with both the first side surface and the second side surface except at the both ends of the groove.

13. The image forming apparatus according to claim 11, wherein a width of each of the grooves is less than three times an average particle diameter of the non-magnetic toner.

14. The image forming apparatus according to claim 11, wherein a width of each of the grooves is less than two times an average particle diameter of the non-magnetic toner.

15. The image forming apparatus according to claim 11, wherein each of the grooves is configured so that at most a single first virtual sphere contacts with an inside of the groove in the cross-section perpendicular to the rotational axis of the concave-convex rotation member.

16. The image forming apparatus according to claim 11, wherein an inclination angle of the first side surface is 1.0 or more.

17. The image forming apparatus according to claim 11, wherein an inclination angle of the second side surface is 0.5 or less.

18. The image forming apparatus according to claim 11, wherein in an electrification series of a surface of the concave-convex rotation member, the magnetic carrier and the non-magnetic toner are defined so that the magnetic carrier is arranged between the non-magnetic toner and the surface of the concave-convex rotation member.

19. An image forming apparatus comprising;

an image bearing member which is disposed rotatably and bears a latent image;

a developing device which develops the latent image formed on the image bearing member with a developer containing non-magnetic toner and magnetic carrier, the developing device comprising;

a concave-convex rotation member disposed rotatably and formed with a plurality of grooves on an outer surface in a crossing direction to a rotational direction of the concave-convex rotation member to bear and carry the developer on the outer surface, the concave-convex rotation member contacting the image bearing member at a developing position facing the image bearing member to develop the latent image, a supplying portion which supplies the developer to the concave-convex rotation member at a supplying position, and a collecting portion which is disposed on a downstream side of the supplying position and on an upstream side of the developing position in the rotational direction of the concave-convex rotation member to collect the magnetic carrier from the concave-convex rotation member, wherein each of the grooves has a first side surface formed in a downstream side in the rotational direction of the concave-convex rotation member and a second side surface formed in an upstream side in the rotational direction of the concave-convex rotation member so as to face the first side surface, and each of the grooves is configured so that a first virtual sphere having an average diameter of the non-magnetic toner contacts with an inner surface of the groove of the concave-convex rotation member except at both ends of the groove with respect to the rotational direction of the concave-convex rotation member and so that a second virtual sphere having an average diameter of the magnetic carrier does not contact with the inner surface of the groove of the concave-convex rotation member except at the both ends of the groove, and so that the first virtual sphere protrudes outside of a line connecting the both ends of the groove in a case when the first virtual sphere contacts with the inside of the groove at a lowest position, and wherein in a cross-section perpendicular to a rotational axis of the concave-convex rotation member, each of the grooves is configured so that a first angle is smaller than a second angle, the first angle is formed by the line and the first side surface, and the second angle is formed by the line and the second surface, and the first angle is an acute angle and the concave-convex rotation member rotates in a same direction as the image bearing member at the developing position, and a rotational speed of a peripheral surface of the concave-convex rotation member is smaller than a rotational speed of a peripheral surface of the image bearing member.

20. An image forming apparatus comprising;

an image bearing member which is disposed rotatably and bears a latent image;

a developing device which develops the latent image formed on the image bearing member with, the developing device comprising;

a concave-convex rotation member disposed rotatably and formed with a plurality of grooves on an outer surface in a crossing direction to a rotational direction of the concave-convex rotation member to bear and carry the developer on the outer surface, the concave-convex rotation member contacting the image bearing member at a developing position facing the image bearing member to develop the latent image, a supplying portion which supplies the developer to the concave-convex rotation member at a supplying position, and a collecting portion which is disposed on a downstream side of the supplying position and on an upstream side of the developing position in the rotational direction of the concave-convex rotation member to collect the magnetic carrier from the concave-convex rotation member, wherein each of the grooves has a first side surface formed in a first direction with respect to a peripheral surface of the concave-convex rotation member and a second side surface formed in a second direction opposite to the first direction, and each of the grooves is configured so that a first virtual sphere having an average diameter of the non-magnetic toner contacts with an inner surface of the groove of the concave-convex rotation member except at both ends of the groove with respect to the rotational direction of the concave-convex rotation member and so that a second virtual sphere having an average diameter of the magnetic carrier does not contact the inner surface of the groove of the concave-convex rotation member except at the both ends of the groove, and so that the first virtual sphere protrudes outside of a line connecting the both ends of the groove in a case when the first virtual sphere contacts with the inside of the groove at a lowest positon, and wherein in a cross-section perpendicular to a rotational axis of the concave-convex rotation member, each of the grooves is configured so that a first angle is larger than a second angle, the first angle is formed by the line and the first side surface, and the second angle is formed by the line and the second surface, and the second angle is an acute angle and defining the first direction as positive, a relative speed of the peripheral surface of the concave-convex rotation member against a peripheral surface of the image bearing member at the developing position is positive.

21. The image forming apparatus according to claim 20, wherein each of the grooves is configured so the first virtual sphere contacts with both the first side surface and the second side surface except in a cross-section perpendicular to the rotational axis of the concave-convex rotation member.

22. The image forming apparatus according to claim 20, wherein a width of each of the grooves is less than three times an average particle diameter of the non-magnetic toner.

23. The image forming apparatus according to claim 20, wherein a width each of the grooves is less than two times an average particle diameter of the non-magnetic toner.

24. The image forming apparatus according to claim 20, wherein each of the grooves is configured so that at most a single first virtual sphere contacts with an inside of the groove in the cross-section perpendicular to the rotational axis of the concave-convex rotation member.

25. The image forming apparatus according to claim 20, wherein an inclination angle of the first side surface is 1.0 or more.

26. The image forming apparatus according to claim 20, wherein an inclination angle of the second side surface is 0.5 or less.

27. The image forming apparatus according to claim 20, wherein in an electrification series of a surface of the concave-convex rotation member, the magnetic carrier and the non-magnetic toner are defined so that the magnetic carrier is arranged between the non-magnetic toner and the surface of the concave-convex rotation member.

28. An image forming apparatus comprising;

an image bearing member which is disposed rotatably and bears a latent image;

a developing device which develops the latent image formed on the image bearing member with a developer containing non-magnetic toner and magnetic carrier, the developing device comprising;

a concave-convex rotation member disposed rotatably and formed with a plurality of grooves on an outer surface in a crossing direction to a rotational direction of the concave-convex rotation member to bear and carry the developer on the outer surface, and a supplying portion which supplies the developer to the concave-convex rotation member at a supplying position, a collecting portion which is disposed on a downstream side of the supplying position in the rotational direction of the concave-convex rotation member to collect the magnetic carrier from the concave-convex rotation member at a collecting position, and a receiving member disposed on an upstream side of the supplying position and on a downstream side of the collecting position in the rotating direction of the concave-convex rotation member, which receives the non-magnetic toner from the concave-convex rotation member by contacting with the concave-convex rotation member, the receiving member carrying the non-magnetic toner received from the concave-convex rotation member to a developing position to face the image bearing member for developing the latent image, the receiving member rotating in a same direction as the image bearing member at the developing position, and a rotational speed ratio of a peripheral surface of the receiving member against a peripheral surface of the image bearing member is set between 1.0 and 1.1, wherein each of the grooves has a first side surface formed in a first direction with respect to a peripheral surface of the concave-convex rotation member and a second side surface formed in a second direction opposite to the first direction, and each of the grooves is configured so that a first virtual sphere having an average diameter of the non-magnetic toner contacts with an inner surface of the groove of the concave-convex rotation member except at both ends of the groove with respect to the rotational direction of the concave-convex rotation member and so that a second virtual sphere having an average diameter of the magnetic carrier does not contact with the inner surface of the groove of the concave-convex rotation member except at the both ends of the groove, and so that the first virtual sphere protrudes outside of a line connecting the both ends of the groove in a case the first virtual sphere contacts with the inside of the groove at a lowest position, and wherein in a cross-section perpendicular to a rotational axis of the concave-convex rotation member, each of the grooves is configured so that a first angle is larger than a second angle, the first angle is formed by the line and the first side surface, and the second angle is formed by the line and the second surface, and the second angle is an acute angle and defining the first direction as positive, a relative speed of the peripheral surface of the concave-convex rotation member against the peripheral surface of the image bearing member at the developing position is positive.

29. The image forming apparatus according to claim 28, wherein each of the grooves are configured so the first virtual sphere contacts with both the first side surface and the second side surface except at both upmost ends of the groove in the cross-section perpendicular to the rotational axis of the concave-convex rotation member.

30. The image forming apparatus according to claim 28, wherein a width of each of the grooves is less than three times an average particle diameter of the non-magnetic toner.

31. The image forming apparatus according to claim 28, wherein a width of each of the grooves is less than two times an average particle diameter of the non-magnetic toner.

32. The image forming apparatus according to claim 28, wherein each of the grooves is configured so that at least a single first virtual sphere contacts with an inside of each of the grooves in the cross-section perpendicular to the rotational axis of the concave-convex rotation member.

33. The image forming apparatus according to claim 28, wherein an inclination angle of the first side surface is 1.0 or more.

34. The image forming apparatus according to claim 28, wherein an inclination angle of the second side surface is 0.5 or less.

35. The image forming apparatus according to claim 28, wherein in an electrification series of a surface of the concave-convex rotation member, the magnetic carrier and the non-magnetic toner are defined so that the magnetic carrier is arranged between the non-magnetic toner and the surface of the concave-convex rotation member.

36. A developing device comprising;

a concave-convex rotation member disposed rotatably and formed with a plurality of grooves on an outer surface in a crossing direction to a rotational direction of the concave-convex rotation member to bear and carry a developer containing non-magnetic toner and magnetic carrier on the outer surface, the concave-convex rotation member developing a latent image on an image bearing member bearing the latent image at a developing position facing the image bearing member, a supplying portion which supplies the developer to the concave-convex rotation member at a supplying position, and a collecting portion which is disposed on a downstream side of the supplying position and on an upstream side of the developing position in the rotational direction of the concave-convex rotation member to collect the magnetic carrier from the concave-convex rotation member, wherein each of the grooves has a first side surface formed in a first direction with respect to a peripheral surface of the concave-convex rotation member and a second side surface formed in a second direction opposite to the first direction, and each of the grooves is configured so that a first virtual sphere having an average diameter of the non-magnetic toner contacts with inner surface of the groove of the concave-convex rotation member except at both ends of the groove and so that a second virtual sphere having an average diameter of the magnetic carrier does not contact with the inner surface of the groove of the concave-convex rotation member except at the both ends of the groove, and so that the first virtual sphere protrudes outside of a line connecting the both ends of the groove in a case the first virtual sphere contacts with the inside of the groove at a lowest positon, and wherein in a cross-section perpendicular to a rotational axis of the concave-convex rotation member, each of the grooves is configured so that a first angle is larger than a second angle, the first angle is formed by the line and the first side surface, and the second angle is formed by the line and the second surface, and the second angle is an acute angle and defining the first direction as positive, a relative speed of a peripheral of the concave-convex rotation member against a peripheral of the image bearing member at the developing position is positive.

37. The image forming apparatus according to claim 36 wherein each of the grooves is configured so the first virtual sphere contacts with both the first side surface and the second side surface except at both upmost ends of the groove in the cross-section in perpendicular to the rotational axis of the concave-convex rotation member.

38. The image forming apparatus according to claim 36, wherein a width of each of the grooves is less than three times an average particle diameter of the non-magnetic toner.

39. The image forming apparatus according to claim 36, wherein a width of each of the grooves is less than two times an average particle diameter of the non-magnetic toner.

40. The image forming apparatus according to claim 36, wherein each of the grooves is configured so that at least a single first virtual sphere contacts with an inside of each of the grooves in a cross-section perpendicular to a rotational axis of the concave-convex rotation member.

41. The image forming apparatus according to claim 36, wherein an inclination angle of the first side surface is 1.0 or more.

42. The image forming apparatus according to claim 36, wherein an inclination angle of the second side surface is 0.5 or less.

43. The image forming apparatus according to claim 36, wherein in an electrification series of a surface of the concave-convex rotation member, the magnetic carrier and the non-magnetic toner are defined so that the magnetic carrier is arranged between the non-magnetic toner and the surface of the concave-convex rotation member.

* * * * *